US005181709A

United States Patent [19]

Okada et al.

[11] Patent Number: 5,181,709

[45] Date of Patent: Jan. 26, 1993

[54] SHEET FEEDING APPARATUS

[75] Inventors: Kenji Okada, Ikoma; Toyoaki Namba, Nara, both of Japan

[73] Assignee: Sharp Kabushiki Kaisha, Osaka, Japan

[21] Appl. No.: 672,708

[22] Filed: Mar. 20, 1991

[30] Foreign Application Priority Data

Mar. 20, 1990 [JP] Japan ..... 2-70917

[51] Int. Cl.[5] ..... B65H 3/14

[52] U.S. Cl. ..... 271/97; 271/98; 271/99

[58] Field of Search ..... 271/98, 99, 97, 94, 271/11

[56] References Cited

U.S. PATENT DOCUMENTS

| | | | |
|---|---|---|---|
| 3,198,514 | 8/1965 | Barbera et al. | 271/12 |
| 4,418,905 | 12/1983 | Garavuso | 271/99 X |
| 4,469,319 | 9/1984 | Robb et al. | 271/171 X |
| 4,550,903 | 11/1985 | Moore | 271/98 |
| 4,627,605 | 12/1986 | Roller et al. | 271/98 X |

FOREIGN PATENT DOCUMENTS

| | | | |
|---|---|---|---|
| 25519859 | 5/1980 | Japan . | |
| 61-254439 | 11/1986 | Japan | 271/97 |
| 2286533 | 11/1990 | Japan | 271/99 |

*Primary Examiner*—David H. Bollinger
*Attorney, Agent, or Firm*—David G. Conlin; Donald R. Castle

[57] ABSTRACT

Recording papers stacked up on a tray are conveyed as being attracted in vacuum by the conveying belt located above or beneath. To convey the recording papers one by one, air flow is blown to the front edge of the recording papers to separate. Accordingly, plural nozzles are disposed in the widthwise direction of the recording paper, and the air flows from the nozzles are directed to converge at the upstream side in the conveying direction front the front edges of the recording papers. By setting this converging position near the both ends in the widthwise direction of the recording papers, the recording papers may be separated securely and stably.

41 Claims, 38 Drawing Sheets

SHEET FEEDING APPARATUS

BACKGROUND OF THE INVENTION

1. Field of the Invention

The present invention relates to an apparatus for feeding sheets such as single-form documents and recording papers in a copying machine or the like by separating one by one from a stacked state.

2. Description of the Prior Art

In a copying machine equipped with a recirculating document handler (RDH) for stacking up documents of single form in a plurality, separating and feeding the documents one by one from the top side or bottom side, and returning to the stacked position after reading the documents in the bottom side or top side, a sheet feeder is used, such as the feeding apparatus of documents and the feeding apparatus of separating and feeding the stacked recording sheets one by one. In printing apparatus and photographic printing device, too, an apparatus for separating and feeding stacked recording papers is employed. In such paper feeding device, it is necessary to separate the stacked sheets one by one, and various separating methods are known, such as the air flow separating method, separating claw method, and method for separating sheets by using a roller rotating in a reverse direction of sheet feeding direction.

As an example of the prior art of separating sheets by using air flow, "the sheet feeding apparatus" is disclosed in the Japanese Laid-open Patent No. 58-78932, and a similar structure is found in the U.S. Pat. No. 3,198,514 or the Japanese Patent Publication No. 55-19859. The structure is shown in FIG. 1, a side view, and in FIG. 2, a plan view. This composition is, for example in a copying machine of RDH method, a paper feeding 1 for feeding by separating the stacked recording papers one by one. The paper feeder 1 is provided with a support tray 3 on which recording papers 2 are stacked up.

At the downstream side of the feeding direction A1 of the recording paper 2 and near the middle of the widthwise direction of the support tray 3 intersecting with the feeding direction A1, a notch 4 is formed, and a feed belt 7 stretched on a pair of rotating rollers 5, 6 disposed beneath the support tray 3 and having many penetration holes formed is exposed at this notch 4. Between the rotating rollers 5, 6 is arranged an air intake duct 8 opposite to the notch 4 across the feed belt 7, and the recording paper 2 on the support tray 3 is attracted by vacuum to the feed belt 7, and is fed in the feeding direction A1 by running and driving of the feed belt 7.

On the other hand, since there is a possibility that plural recording papers 2 on the support tray 3 be attracted and fed together by the feed belt 7, an air injection duct 9 is disposed above the downstream side of the feeding direction A1 from the support tray 3, and nozzles **10*b* to 10*e* parallel to the feeding direction A1, and plural nozzles 10*a*, 10*f* directed toward the middle of the widthwise direction are communicated. On the other hand, the support tray 3 has a base part 15 in an extended shape from the downstream side to the upstream side of the feeding direction A1, and a side wing parts 15, 16 formed obliquely upward from the both sides of the widthwise direction of the base part 14, as shown in FIG. 3**.

The air injection duct 9 and support tray 3 in this prior art are arranged as shown in FIG. 1, and the air stream in a flat shape is concentrated near the middle position in the widthwise direction of the support tray 3 by the nozzles **10*a* to 10*f*. This state of distribution of air stream by the air injection duct 9 is indicated in the shaded area in FIG. 4**.

This prior art is capable of separating the recording papers 2 favorable as far as the size of the recording papers 2 is relatively small or the weight is relatively large.

However, in the case of recording paper of relatively large size or small weight, or therefore in the case of recording paper of weak consistency, favorable separation may not be always possible. That is, in this prior art, by concentrating the air stream near the middle position of the widthwise direction of the support tray 3, the air stream is inflated in the vertical direction near the middle position to realize the action of separating the recording papers. On the other hand, in the recording paper of large size or small weight, not only the lowermost recording paper but also plural recording papers are deformed with a relatively large deflection, in a recess 19 formed by the base part 15 and side wing parts 15, 16 of the support tray 3, in a shape corresponding to the pattern of the recess, and the gap for entry of air stream is hardly formed among the recording papers, and separation of recording papers may be sometimes unsuccessful.

Or among the recording papers indicated in the shaded area in FIG. 4, the area of separation region 17 mutually separated by entry of air from the air injection duct 9 becomes relatively smaller than the area of the non-separating region 18 where the recording papers adhere with each other, and therefore when the lowermost recording paper is attracted in vacuum by the conveying belt 7 and conveyed, duplicate feed may occur due to the frictional force in the non-separating region 18. At this time, in order to extend the separating region 17, when nozzles **10*g*, 10*h* indicated by double point chain line in FIG. 2 are disposed further outward in the widthwise direction of the nozzles 10*a*, 10*f* in the air injection duct 9 so as to be directed outward in the widthwise direction, in the case of recording paper 2 of which width W1 is smaller than the interval L11 shown in FIG. 2 between the nozzles 10*g*, 10*h*, the air stream from the nozzles 10*g*, 10*h* collides against the both ends 2*a*, 2*b* in the widthwise direction of the recording paper, and these end parts 2*a*, 2*b* come to flap. In this case, the stacked state of the recording papers 2 piled up in the paper feeder 1 is disturbed, and duplicate feed or defective feed may take place. Or when the recording paper 2 is relatively small in size, the separation capacity due to the air stream concentrated by the nozzles 10*a* to 10*f* is excessive, and the recording papers of small size may scatter about in the paper feeder 1**.

In the prior art, therefore, although the separating capacity is relatively favorable as far as the recording paper is limited in type, separation failure or feeding failure may occur from the viewpoint of versatility of separating recording papers in a wide variety of sizes effectively, and it is not sufficient in versatility, and the sheet feeding apparatus with versatility having the favorable separating capacity in a wide range of size and weight of recording paper is desired.

SUMMARY OF THE INVENTION

It is hence a primary object of the invention to solve the above-discussed technical problems and present an improved sheet feeding apparatus possessing a favorable separating and feeding capacity corresponding to sheets of a wide variety of sizes.

To achieve the above object, the invention presents a sheet feeding apparatus comprising:

a laying plate on which plural sheets are stacked up, feeding means disposed beneath or above the sheets for feeding by attracting in vacuum the bottom or top of the sheet of the stacked-up sheets, and air flow forming means disposed at the downstream side in feeding direction of the laying plate for injecting air flows from plural positions in the widthwise direction of the laying plate toward the feeding means and toward the vicinity of the end part of the stacked-up sheets, and blowing the air flows in between the sheets so as to be concentrated in the portion at the upstream side in the feeding direction of the sheets.

According to the invention, the laying plate is composed symmetrically on right and left sides with respect to the symmetrical surface passing the central position in the widthwise direction, and the air flows are formed symmetrically on right and left sides of the symmetrical surface.

The invention also presents a sheet feeding apparatus comprising:

a laying plate on which plural sheets are stacked up, having deforming parts for deforming the stacked-up sheets formed in plural positions in the widthwise direction, feeding means disposed beneath or above the sheets for feeding by attracting in vacuum the bottom or top sheet of the stacked-up sheets, and air flow forming means disposed at the downstream side in the feeding direction of laying plate for injecting air flows to the vicinity of the deforming parts respectively.

According to the invention, the laying plate is composed symmetrically on right and left sides with respect to the symmetrical surface passing the central position in the widthwise direction, and the deforming parts and the corresponding air flows are formed symmetrically on right and left sides corresponding to the symmetrical surface.

In the invention, the air flow forming means is designed to inject and form the air flows so as to be concentrated nearly toward the central line of each air flow.

In the invention, the air flow forming means is designed to inject and form the air flows so as to be nearly parallel to the central line of each air flow.

In the invention, the air flow forming means is designed to inject the air flows so as to distribute outward in the widthwise direction of the laying plate as going toward the upstream side in the feeding direction.

In the invention, the air flow forming means is designed to inject the air flows so as to distribute inward in the widthwise direction of the laying plate as going toward the upstream side of the feeding direction.

In the invention, the laying plate possesses a nearly horizontal central laying part, and lateral laying parts extending on both sides of the widthwise direction from the central laying part, the end part at the downstream side in the feeding direction of the central laying part is located at the upstream side in the feeding direction from the end part at the downstream side in the feeding direction of the lateral laying parts, and a notch is formed in the laying plate, the feeding means for feeding the bottom sheet of the stacked-up sheets is opposite to this notch, and the air flow forming means injects an air flow toward the boundary of the central laying part and the lateral laying parts of the laying plate.

In the invention, the boundary of the central laying part and lateral laying parts of the laying plate is parallel to the feeding direction.

In the invention, a vertical step difference is formed between the inner end part forming the boundary of the lateral laying parts and the feeding surface of the feeding means, and the air flow forming means injects an air flow from the central side in the widthwise direction toward this step difference.

In the invention, the height $\delta$ of the step difference is 1 to 5 mm vertically.

In the invention, the height $\delta$ of the step difference is about 2 mm vertically.

In the invention, the lateral laying parts are inclined upward as going away on both sides in the widthwise direction from the central laying part.

In the invention, the central laying part and the lateral laying parts form an angle $\beta$ of 3 to 10 degrees.

In the invention, the central laying part and the lateral laying parts form an angle $\beta$ of about 3.5 degrees.

In the invention, the lateral laying parts are almost horizontal, and are formed higher than the central laying part through a step difference.

In the invention, the boundary of the central laying part and lateral laying parts is formed continuously in bend.

In the invention, a projection is set up at the position where the notch is formed, and the air flow forming means injects an air flow toward the vicinity of this projection.

In the invention, the air flow is injected toward the side surface of the projection.

In the invention, the air flow is injected from inward in the widthwise direction toward the side surface of the projection.

In the invention, the air flow forming means comprises a nozzle member forming one or plural tubular nozzles disposed for every air flow, and a passage for commonly leading air into the nozzle holes of the nozzles.

In the invention, the air flow forming means comprises a nozzle member forming one or plural nozzles disposed for every air flow, and a passage for commonly leading air into the nozzle holes of the nozzles, and the nozzle holes are formed in this nozzles by guide pieces for guiding the air from the passage by orienting.

In the invention, the air flow forming means possesses plural nozzles for every air flow, and the central nozzle in the widthwise direction of the nozzles for each air flow injects air outward in the widthwise direction as going upstream in the feeding direction, while the outward nozzle in the widthwise direction injects air almost parallel to the feeding direction.

In the invention, the central nozzle in the widthwise direction has an angle of $\alpha 2$ of 20 to 45 degrees outward in the widthwise direction to the feeding direction.

In the invention, the central nozzle in the widthwise direction has an angle of $\alpha 2$ of about 30 degrees outward in the widthwise direction to the feeding direction.

In the invention, another nozzle is disposed at the further central side in the widthwise direction from the central nozzle in the widthwise direction, and this nozzle has an angle of $\alpha 1$ of 0 to 45 degrees outward in the widthwise direction to the feeding direction.

In the invention, another nozzle is disposed at the further central side in the widthwise direction from the central nozzle in the widthwise direction, and this nozzle has an angle of $\alpha 1$ of about 15 degrees outward in the widthwise direction to the feeding direction.

In the invention, another air flow is disposed further outward in the widthwise direction from the outward air flow in the widthwise direction, and the central line of this air flow has an angle of $\alpha 3$ to 0 to 45 degrees outward in the widthwise direction to the feeding direction.

In the invention, another air flow is disposed further outward in the widthwise direction from the outward air flow in the widthwise direction, and the central line of this air flow has an angle of $\alpha 3$ of about 30 degrees outward in the widthwise direction to the feeding direction.

In the invention, the air flow forming means possesses plural nozzles for every air flow, and the central nozzle in the widthwise direction of the nozzles for every air flow injects air outward in the widthwise direction as going upstream in the feeding direction, while the outward nozzle in the widthwise direction injects air inward in the widthwise direction as going upstream in the feeding direction.

In the invention, the air flow forming means forms plural sets of air flows making a pair on the right and left sides of the symmetrical surface, the first air flow of the set disposed at the central side in the widthwise direction is directed inward in the widthwise direction from both sides in the widthwise direction of the stacked-up sheets small in width, and the second air flow of the set disposed outward in the widthwise direction is directed outward in the widthwise direction than the first air flow, outward in the widthwise direction than the both sides of the sheets of small width, and inward in the widthwise direction from both ends in the widthwise direction of stacked-up sheets large in width.

In the invention, flow rate control means for the air flow to control the flow rate of the second air flow is disposed.

In the invention, the laying plate is formed almost horizontally, a notch open to the downstream side in the feeding direction is formed in the central position in the widthwise direction of laying plate, and the feeding means for feeding the bottom sheet of the stack-up sheets is opposite to this notch, and a projection is set up on the laying plate outward in the widthwise direction from the notch, and the air flow forming means injects an air flow toward the notch area.

In the invention, the protrusion has a slender shape extending along the feeding direction.

In the invention, the feeding means feeds the bottom sheet of the stacked-up sheets, and the air flow forming means injects an air flow toward the position in the feeding route at the downstream side in the feeding direction further from the end part of the downstream side in the feeding direction of the sheets stacked up on the laying plate, and the bottom sheet and the other remaining sheets are separated by the air flow after reflection of this air flow.

In the invention, a step difference becoming lower at the downstream side in the feeding direction of the laying plate is formed, and the air flow forming means injects an air flow to the vicinity of this step difference, and the flow rate of the air to the end part of the downstream side in the feeding direction of the stacked-up sheets is controlled by it.

In the invention, the feeding means has a feeding stretch belt with multiple air passage holes extended along the feeding direction, and this belt is rotated and driven, and a vacuum attraction box open upward is disposed immediately beneath the upper stretching part of the belt.

In the invention, the end part at the downstream side in the feeding direction of stacked-up sheets is located at the downstream side of the vacuum attraction box.

In the invention, a rear end defining member for aligning the ends of the stacked-up sheets at the upstream side in the feeding direction is disposed reciprocally movable in the feeding direction, and the rear end defining member is dislocated so that the end part at the downstream side in the feeding direction of the large sheets may be at the downstream side from the vacuum attraction box when the sheets are large, and that the end part at the downstream side in the feeding direction of the small sheets may be positioned as being deviated to the upstream side in the feeding direction from the end part at the downstream side in the feeding direction of the vacuum attraction box when the sheets are small.

In the invention, means for driving the rear end defining member, means for detecting the size of the sheets to be detected or the amount of stacking, and control means for actuating the driving means in response to the output from the detecting means are included.

In the invention, the feeding means is located above the stacked-up sheets.

According to the invention, plural sheets are stacked up on the laying plate, and the feeding means attracts in vacuum and feeds the sheets stacked up on the laying plate one by one from the bottom or from the top, while the air flow forming means injects air flows, at the downstream side in the feeding direction of the laying plate, toward the feeding direction of the feeding means, and toward the vicinity of the end part of the stacked-up sheets (that is, near the end part of the downstream side, or the front end part). Subsequently, air gets into the sheets on the laying plate at the upstream side in the feeding direction from the end part of the feeding direction downstream side. The air flows are blown into sheets so as to be concentrated in the area of the feeding direction upstream side of sheets, and therefore the air flow gets into the upper and lower sheets stacked up, from the end part of the sheets feeding direction downstream side. By thus focusing the air flows, the sheets are inflated vertically in the part of the upstream side of feeding direction of sheets, so that the sheets are securely separated up and down. As a result, separation of the bottom or top sheet attracted in vacuum to the feeding means and the other sheets is done easily, and it is possible to handle separately. Hence, simultaneous feed of plural sheets, that is, duplicate feed may be prevented.

According to the invention, moreover, the laying plate has deforming parts for deforming the stacked sheets, such as bent part, step difference and protrusion around the boundary of the central laying part and lateral laying parts as mentioned below, in plural positions in the widthwise direction, and by injecting air flow to such deforming parts, air flows are smoothly blow into the space between the bottom or top sheet attracted in vacuum by the feeding means and the remaining sheets, so that the sheets may be securely separated vertically.

Also according to the invention, the laying plate is formed symmetrically on right and left sides to the symmetrical surface passing the central position in the widthwise direction, and the air flows and also deforming parts are formed also symmetrically on right and left sides to the symmetrical surface.

Following the concept of the invention, the invention may be also realized in a constitution in which sheets with various shapes or widths are fed by aligning the sides on the laying plate, and hence the central position of the sheets in the widthwise direction differs individually.

Thus, according to the invention, since air flows are blown at plural positions in the widthwise direction of the stacked-up sheets, not only narrow sheets but also broad sheets may be separated vertically, and a sheet feeding apparatus with a favorable separating and feeding capability corresponding to sheets in a variety of sizes may be realized.

The air flows may be formed on both sides of the symmetrical surface one by one, that is, in a pair of right and left flows.

Or the air flows may be formed in plural sets, comprising pairs on both sides of the symmetrical surface, or in other words plural air flows may be formed at the left side of the symmetrical surface, and plural air flows at the right side. Such air flows formed on the right and left sides may be either flat in the widthwise direction of the laying plate or not flat.

The central line of each air flow may be nearly parallel to the feeding direction. The central line may be directed so as to diffuse to be outward in the widthwise direction as going upstream in the feeding direction, or may be directed to distribute inward in the widthwise direction, that is, to the central wide in the widthwise direction, as going upstream in the feeding direction.

In the invention, since air flows are injected from symmetrical positions about the symmetrical surface passing the central position in the widthwise direction of the laying plate in this way, air flows may be blown into the stacked sheets in the widthwise direction, and the bottom or top sheet of the stacked-up sheets and the remaining sheets may be securely vertically.

Again, according to the invention, the air flows from the air flow forming means are directed so as to be concentrated toward almost the central line of each air flow. Therefore, the air flows injected from the air flow forming means gets into the stacked sheets, and as the air flows are concentrated in the widthwise direction, the sheets are inflated in the vertical direction, so that the sheets stacked up can be separated individually and securely.

In the invention, moreover, the air flows from the air flow forming means are parallel flows to the central line of each air flow, and the flows will not converge. Even by such air flows, the stacked sheets may be separated and handled sufficiently, and simultaneous feed of plural sheets may be prevented.

The central line of each air flow may be parallel to the feeding direction as mentioned above, or may be also directed in the direction of going away from the symmetrical surface as going upstream in the feeding direction.

Also according to the invention, the air flows from the air flow forming means are directed outward in the widthwise direction of the laying plate as going upstream in the feeding direction, that is, in the direction of going away from the symmetrical surface, and the air flows may be also directed to converge toward the center of air flows or may be parallel flows not converging. Thus, as the air flows are directed outward in the widthwise direction of the laying plate, the sheets may be fed securely one by one as being sufficiently separated and handled near the both side ends of the stacked sheets.

Moreover, according to the invention, the laying plate is composed of nearly horizontal central laying part, and lateral laying parts disposed at both sides in the widthwise direction, and the end part at the downstream side in the feeding direction of the central laying part, that is, the front end part is notched, and the feeding means is opposite to this notch, so that the bottom sheet of the stacked-up sheets can be attracted in vacuum by the feeding means and fed. The air flows from the air flow forming means are injected toward the boundary of the central laying part and lateral laying parts, and air gets into the mutual gap of the stacked sheets near the boundary, so that the bottom sheet and the remaining sheets are separately securely.

The boundary may be parallel to the feeding direction, which makes it easier to manufacture the laying plate.

According to the invention, what is more, a vertical step difference is formed between the inner end forming the boundary of the lateral laying parts, that is, the inner end at the central side in the widthwise direction, and the feeding surface of the feeding means, and air flows are injected toward this step difference from the air flow forming means, from the central position in the widthwise direction. The bottom sheet of the stacked-up sheets is attracted in vacuum to the feeding surface of the feeding means, and its negative pressure is, for example, 40 to 50 $mmH_2O$, so that the bottom sheet may be tightly attracted in vacuum to the feeding surface, while the other sheets are not so much deformed as the bottom sheet, and are almost flat, and there is a gap between the bottom sheet and the remaining sheets even around the step difference. As the air is introduced into this gap, the bottom sheet and the remaining sheets may be securely separated vertically.

The height $\delta$ of the step difference is 1 to 5 mm vertically, or preferably about 2 mm, and by such step difference the upper and lower sheets may be separated securely.

Furthermore in the invention, the lateral laying parts are inclined upward as going away from the both sides in the widthwise direction from the central laying part, and the laying plate is, in other words, inclined approximately in a U-form, and therefore in the boundary of the central laying part and the lateral laying parts, a gap is produced between the bottom sheet attracted in vacuum by the feeding means and the remaining sheets, near the boundary, so that the mutual sheets may be separated easily.

The central laying part and lateral laying parts have an angle $\beta$ of 3 to 20 degrees, or preferably an angle $\beta$ of about 3.5 degrees, so that the gap between the bottom sheet and the remaining sheet near the boundary is increased to make it easier to separate the sheets up and down.

The lateral laying parts are nearly horizontal, and may be almost parallel to the central laying part, and a step difference may be formed near the boundary between the central laying part and lateral laying parts. Or a step difference may be also formed between the feeding surface of the feeding means disposed at the notch in the nearly horizontal central laying part and the nearly horizontal lateral laying parts as mentioned above. By constituting in this way, sheets may be easily separated vertically near the step difference.

The central laying part and lateral laying parts may be fabricated, for example, from a single metal plate by plastic processing to form a continuous boundary, for example, bent at an obtuse angle, and even in such constitution, by injecting air flow near the boundary, the bottom sheet and the remaining sheets may be easily separated up and down.

According furthermore to the invention, at the notch position, a projection is set up, for example, stretching parallel to the feeding direction, and the air flow is injected toward this projection, and/or is injected to the central side in the widthwise direction toward the vicinity of the projection from outward in the widthwise direction than the projection, and therefore a gap is produced between the bottom sheet attracted in vacuum to the feeding means near the projection, and the remaining sheets not attracted in vacuum, and the air flow gets into this gap to separate the sheets easily up and down. The projection may be extended, as mentioned above, parallel to the feeding direction, or may be also swollen without being extended slenderly, or plural projections may be formed adjacently at intervals in the feeding direction, being arranged straightly parallel to the feeding direction.

In the invention, the air flow is injected toward the side surface of the projection, and in particular when the air flow is injected to the side of the projection from inward in the widthwise direction, the diffusion of the air flow outward in the widthwise direction is suppressed, and the sheets may be separated securely up and down.

Again, in the invention, in the air flow forming means, each air flow is formed by the air injected from nozzle holes of one or plural tubular nozzles, and the tubular nozzles may be either right cylindrical or flat angular cylindrical or may be in any sectional profile.

Instead of such tubular nozzles, it may be also designed to inject the air by guiding with orientation into the nozzle holes of the nozzles, by guide pieces, from the air supply passage.

According to the invention, in the air flow forming means, each air flow is formed by the air injected from plural nozzles, and the central nozzle in the widthwise direction out of these nozzles injects air outward in the widthwise direction as going upstream in the feeding direction, that is, in the direction of diffusing to the right and left, while the outward nozzle in the widthwise direction injects air parallel to the feeding direction. Therefore, the air in the diffusion direction from the central nozzle in the widthwise direction is, so to speak, shielded by the air nearly parallel to the feeding direction from the outward nozzle in the widthwise direction, and air flows from nozzles are thus concentrated to inflate vertically among the sheets being stacked up, and the sheets are securely separated vertically, and thus formed air flow is effective to prevent flapping of the sheets at the side of the sheets being discharged outward in the widthwise direction of the stacked-up sheets.

The central nozzle in the widthwise direction injects air in the direction of diffusing to the right and left, and this central nozzle in the widthwise direction has an angle $\alpha 2$ of 20 to 45 degrees, or preferably 30 degrees outward in the widthwise direction to the feeding direction. The outward nozzle in the widthwise direction injects air almost parallel to the feeding direction. The central line of the air flow of the outward side in the widthwise direction an angle $\alpha 3$ of 0 to 45 degrees, or preferably about 30 degrees outward in the widthwise direction to the feeding direction. Hence, the air flows from nozzles are concentrated and blown into the gap between the upper and sheets being stacked up, and the sheets may be effectively separated vertically.

Also according to the invention, another nozzle is disposed at the central side in the widthwise direction form the central nozzle in the widthwise direction, and this nozzle has an angle $\alpha 1$ of 0 to 45 degrees, or preferably about 15 degrees outward in the widthwise direction to the feeding direction, so that the air may be more effectively blown into the gap between the upper and lower sheets being stacked up.

The outward nozzle in the widthwise direction may be also composed so as to inject air inward in the widthwise direction as going upstream in the feeding direction, that is, in the central direction in the widthwise direction.

Again, according to the invention, when the width of the sheets which are stacked up and fed is different, to separate narrow sheets, one set or plural sets of first air flows forming a pair of right and left at the central side in the widthwise direction are directed near the both lateral sides in the widthwise direction of the narrow sheets, so that narrow sheets may be separated vertically, and still more one set or plural sets of second air flows forming a pair of right and left to the symmetrical surface outward in the widthwise direction from the first air flows and also outward in the widthwise direction from both sides of the narrow sheets are directed inward in the widthwise direction than the both sides in the widthwise direction of the broad sheets being stacked up, so that the broad sheets are separated vertically by the first air flows and second air flows. Therefore, if the width of sheets is great, it is possible to separate securely, and simultaneous feed of plural sheets may be prevented.

Meanwhile, when feeding sheets of narrow width, since the second air flows are located outward in the widthwise direction from the first air flows, flapping of the sides of narrow sheets by such second air flows may be prevented.

Further according to the invention, the flow rate of the second air flows is controlled by the flow rate control means of air flows to form or not to form the second air flows. For example, when feeding narrow sheets, the second air flows are not formed by the flow rate control means of air flows, and flapping or disturbance of the sides of the narrow sheets by the second air flows is completely avoided. When feeding broad sheets, the second air flows are formed by the flow rate control means of air flows.

By thus controlling the flow rate of the second air flows, the second air flows may be either formed or not formed, and the flow rate of the second air flows may be regulated variously. For example, when feeding narrow sheets, the flow rate of the second air flows may be controlled to a small value other than zero by the flow rate control means, and when feeding broad sheets, the flow rate of the second air flows may be increased.

According also to the invention, a notch is formed in the nearly horizontal laying plate, and feeding means is disposed opposite to the notch, and further outside of the notch a protrusion is set up, extending along the feeding direction on the laying plate, and the air flow forming means injects an air flow toward the protrusion. Therefore, the bottom sheet of the stack is tightly attracted in vacuum to the feeding means, and this bottom sheets is largely bent and deformed near the protrusion, while the deformation of the remaining sheets is smaller than that of the bottom sheet near the protrusion, and a gap is produced between the bottom sheet and the remaining sheets, and as the air flow is injected into this gap, the sheets may be separately securely. This air flow may be also injected along the feeding direction toward the protrusion, or the air flow may be injected from an oblique side of the projection.

Moreover, in the invention, the air flows from the air flow forming means are injected toward the end part at the downstream side in the feeding direction of the sheet, that is, further downstream side in the feeding direction from the front end part, or the forward position, and when thus injected air flows are reflected, the reflected air flows can separate the bottom sheet attracted in vacuum to the feeding means securely from the other sheets.

Still more, in the invention, the air flows are injected from the downstream side in the feeding direction of the laying plate toward the upstream side to form a step difference being low at the downstream side in the feeding direction of the laying plate, and part of the air flows from the air flow forming means collides against this step difference, thereby decreasing the flow rate into the sheet end parts. Therefore, when only few sheets are stacked up on the laying plate or the width of the stacked sheets is narrow, an excessive air flow will not be blown against the stack of sheets. Hence, only the bottom sheets may be securely fed by the feeding means, while disturbance of the remaining sheets in stack is avoided. By this step difference, the flow rate of the air flow is reduced on both outsides in the widthwise direction of the laying plate, and raised at the central side in the widthwise direction, so that the sheets may be separated more securely.

The feeding means possesses multiple air passage holes, or a porous feeding stretch belt is disposed, and a vacuum attraction box is installed immediately beneath it confronting the upper stretching part of the belt, and this vacuum attraction box is open upward, and by connecting a vacuum source such as fan to the vacuum attraction box, the bottom sheet of the stack of sheets may be attracted in vacuum to the upper stretching part.

Since the end part at the downstream side in the feeding direction of sheets, that is, the front end part is located at the downstream side from the vacuum attraction box, that is, at the forward side, the air flow from the air flow forming means is not directly attracted into the vacuum attraction box, and imperfect separation or handling of the sheets may be prevented.

In the invention, meanwhile, the end parts of the sheets stacked up on the laying plate at the upstream side in the feeding direction, that is, the rear end parts may be aligned by the rear end defining member capable of reciprocally dislocating before and after along the feeding direction, and when the sheets are broad or long or large in size, therefore when generally, heavy, in order to prevent the air flow from the air flow forming means from being attracted into the vacuum attraction box, the end part of the sheets at the downstream side in the feeding direction is located at the downstream side that the vacuum attraction box by moving the rear end defining member, or when the sheets are narrow or short or small in size, that is, when generally light in weight, in order to prevent the air flow of excessive flow rate or velocity from being blown into the sheets to prevent disturbance of sheets, the end part of the small sheets at the downstream side in the feeding direction is shifted to the upstream side in the feeding direction than the end part at the downstream side in the feeding direction of the vacuum attraction box, so that part of the injected air flow is attracted into the vacuum attraction box, thereby preventing air flow of excessive flow rate or velocity from being blown against small sheets.

The rear end defining member detect the width or size of the sheets stacked up or the amount of stack by the detecting means, and the control means responding to the output of this detecting means actuates the driving means, thereby controlling automatically so that the end part of the sheets at the downstream side in the feeding direction may be located before or after the end part of the vacuum attraction box at the downstream side in the feeding direction as mentioned above, depending on the size or stack amount of sheets.

The invention may be also executed in relation to the constitution in which the feeding means is located above the stacked-up sheets.

Thus, according to the invention, sheets are stacked up on the laying plate, and the top or bottom sheet is attracted in vacuum, out of the stack of sheets, by the feeding means, and the air flow forming means injects at this time air flows from plural positions in the widthwise direction from the downstream side in feeding direction of the laying plate toward the feeding means, and toward the vicinity of the end part of the downstream side in feed direction of the stacked-up sheets, and the bottom or top sheet being tightly attracted in vacuum to the feeding means may be securely separated from the remaining sheets. As a result, simultaneous feed of plural sheets may be prevented.

The air flow is attracted into the sheets so as to be focused in the upstream part in feeding direction of sheets, and the air blown into the sheets is inflated vertically, so that vertical separation of sheets is securely realized.

Also according to the invention, the laying plate comprises deforming parts for deforming the stacked-up sheets, and bent part, step difference or protrusion near the boundary of the central laying part and lateral laying parts as mentioned above at plural positions in the widthwise direction, and by injecting air flows near the deforming parts, the air is blown in between the top or bottom sheet being attracted in vacuum to the feeding means, and the second and remaining sheets, so that the sheets may be separated securely, and these air flows may be either focused or parallel to the center line.

In this way, according to the invention, since air flows are blown in at plural positions in the widthwise direction of stacked-up sheets, not only narrow sheets but also broad sheets can be separated vertically, and a sheet feeding apparatus possessing a favorable separating and feeding capability to deal with sheets in a wide variety of sizes is realized.

The air flows are directed so as to be concentrated toward the center line of each air flow, and hence the air getting in between the sheets is inflated vertically, and the stacked sheets can be separated securely. Such air flows may be also nearly parallel to the center line of the air flows, and the air flows are injected in the direction of distributing outward or inward in the widthwise direction of the laying plate as going upstream in the feeding direction.

Moreover according to the invention, the laying plate comprises a nearly horizontal central laying part, and lateral laying parts extending to both sides from the central laying part, and air is injected toward the vicinity of their boundary, and a step difference is found near the boundary, or the lateral laying parts are inclined toward the nearly horizontal laying part, and the air flow is injected into the gap near the boundary of the bottom sheet attracted in vacuum and the remaining sheets, so that vertical separation may be done easily and securely. The step difference is a vertical step between the inner end part forming the boundary of the lateral laying parts and the feeding surface of the feeding means, and the height $\delta$ of this step difference is 1 to 5 mm vertically, or preferably about 2 mm, so that air may be effectively blown in between the bottom sheet and the remaining sheets.

Besides, the inclined lateral laying parts are inclined to the nearly horizontal central laying part as mentioned above, and by selecting this angle $\beta$ at 3 to 10 degrees, or preferably about 3.5 degrees, it is easily possible to blow air into the gap between the bottom sheet and the remaining sheets. Or when the lateral laying parts are nearly horizontal and these lateral laying parts are formed higher than the central laying part or the feeding surface of the feeding means with a level difference, by injecting air toward this level difference, the sheets may be easily separated vertically.

The boundary is parallel to the feeding direction, so that manufacture may be easy.

Furthermore, by setting up a protrusion on the laying plate, and injecting air flow toward this protrusion, the sheets may be easily separated vertically. This protrusion may be formed to extend slenderly toward the feeding direction, and it is further easier to blow air into the gap between the bottom sheet and the remaining sheets. The air flow is injected from inward or outward in the widthwise direction of the laying plate toward the side of the protrusion, and particularly injected from inward in the widthwise direction to the side of the protrusion, so that the air flow diffusion outward in the widthwise direction is inhibited, so that the sheets may be securely separated vertically.

According to the invention, the air flows may be formed by one or plural tubular nozzles, or it is also possible to compose to inject air in a specific direction by using a guide piece in each nozzle hole.

Moreover, according to the invention, the air flow forming means forms air flows by forming a pair on both sides of the symmetrical surface, and possesses plural nozzles for each air flow, and injects air outward in the widthwise direction, that is, in the diffusing direction as going upstream in the feeding direction, by the central nozzle in the widthwise direction out of the nozzles for each air flow, at an angle $\alpha 2$ of 20 to 45 degrees or preferably about 30 degrees, and injects air parallel to the feeding direction by the outward nozzle in the widthwise direction, thereby gathering the air flows from the nozzles, so that the stacked-up sheets may be separated easily in the vertical direction.

In the invention, another nozzles is disposed at the central side in the widthwise direction further from the central nozzle in the widthwise direction, and this nozzle has an angle $\alpha 1$ of 0 to 45 degrees or preferably about 15 degrees outward in the widthwise direction to the feeding direction, so that vertical separation of the stacked-up sheets may be done more securely. Or else another air flow is formed outward in the widthwise direction further from the outer nozzle in the widthwise direction, and a diffusing air flow is formed. The center line of the another air flow may have an angle $\alpha 3$ of 0 to 45 degrees, or preferably about 30 degrees outward in the widthwise direction to the feeding direction, and thus broad sheets may be separated securely.

In order to form the air flows in a converging manner, the central nozzle in the widthwise direction injects an air flow outward in the widthwise direction as going upstream in the feeding direction, that is, in the diffusing direction, while the outer nozzle in the widthwise direction injects air inward in the widthwise direction as going upstream in the feeding direction, that is, the inner direction.

Also by the invention, the air flow forming means forms plural sets of air flows forming a pair of right and left sides about the symmetrical surface, and narrow sheets are separated by the set of first air flows disposed at the central side in the widthwise direction, while broad sheets may be separated easily by using, together with the first air flows, the second air flows disposed outward in the widthwise direction than the first air flows, and outward in the widthwise direction than the both sides of the narrow sheets and also inward in the widthwise direction than both sides of broad sheets.

By the flow rate control means of the air flows, the second air flows are not formed in the case of narrow sheets, and are formed in the case of broad sheets, thereby preventing unstable feed or disturbance of stack of narrow sheets due to injection of excessive air flow rate or velocity to the narrow sheets. The flow rate control means of the air flows controls the flow rate of the second air flows, and reduces the flow rate of air flows when the sheets are small, and increases the flow rate when the sheets are wide.

Also by the invention, the air flow from the air flow forming means is injected toward the position of the feeding route at the downstream side in feeding direction further from the end part at the downstream side in feeding direction of sheets, and by the air flow after reflection, the bottom sheet and the remaining sheets may be separated securely.

Also according to the invention, by the step difference becoming lower at the downstream side in feeding direction of the laying plate, part of air flow collides, and therefore the air flow of excessive flow rate or velocity is prevented from being injected to the sheets.

In the invention, the feeding means comprises a feeding stretch belt possessing air passage holes, and a vacuum attraction box disposed immediately beneath the upper stretching part of the belt, and depending on the size of stack amount of the stacked-up sheets, the rear end defining member is adjusted by reciprocally dislocating in the feeding direction, and part of the air flow is attracted into the vacuum attraction box when the sheet width, length or size or stack amount is small, thereby preventing flapping of sheets, or when the sheet width, length or size of stack amount is large, the vacuum attraction box is plugged by the sheet, so that the sheets may be securely separated by the air flow.

Meanwhile, the invention may be also composed and realized in such a structure in which the feeding means for feeding the sheets one by one from the top is disposed above the stack of sheets, and thus the invention may be effectively executed in a wide range.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
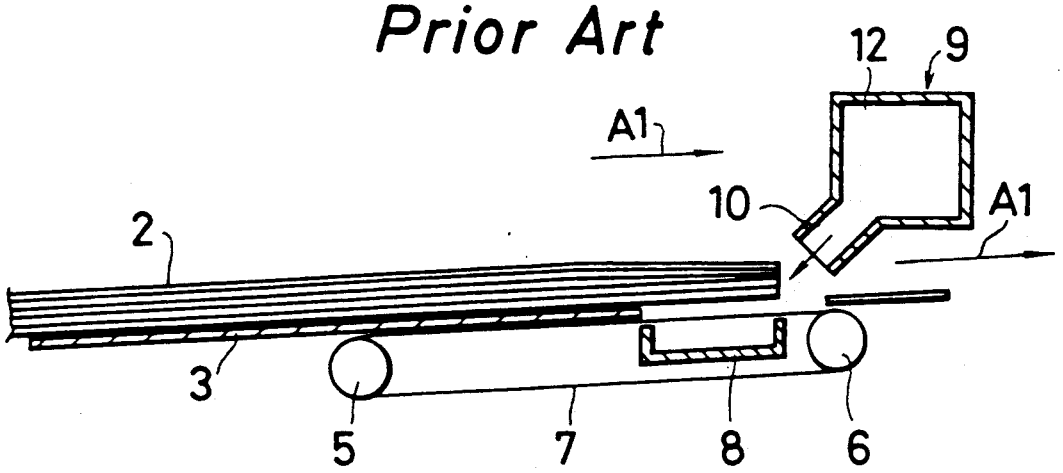
Fig. 1 Prior Art
FIG. 1 is a side view of a typical conventional paper feeder.
Figure 2:
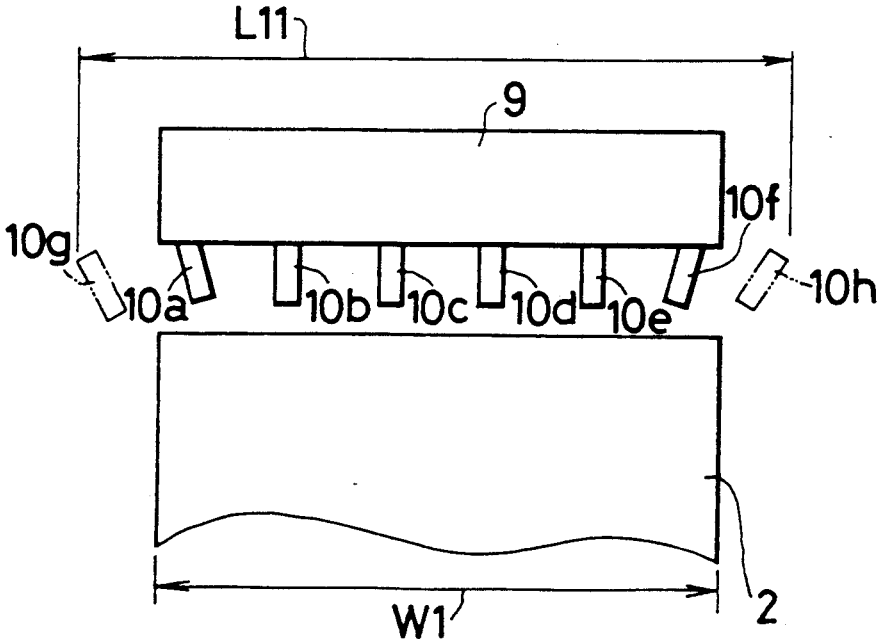
Fig. 2 Prior Art
FIG. 2 is a sectional view for explaining the layout of an air injection duct 9 and nozzle 10 used in the paper feeder 1.
Figure 3:
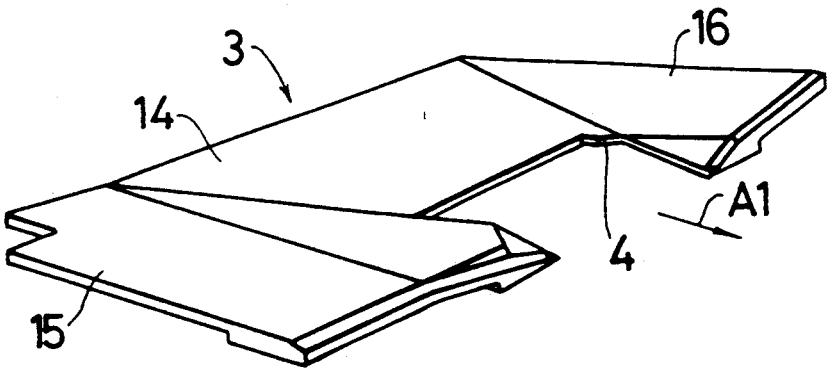
Fig. 3 Prior Art
FIG. 3 is a perspective view of a support tray used in the paper feeder 1.
Figure 4:
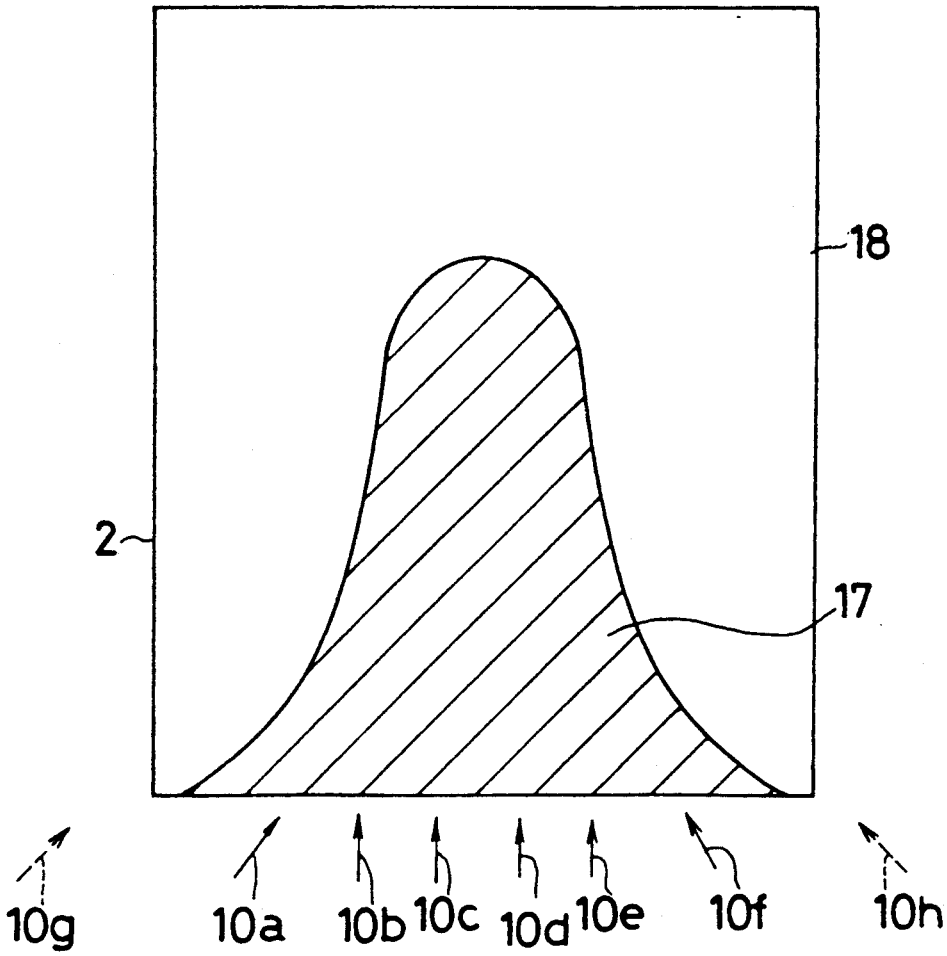
Fig. 4 Prior Art
FIG. 4 is a plan view for explaining the state of air stream in the prior art.

Now referring to the drawing, preferred embodiments of the invention are described below.

Figure 5:
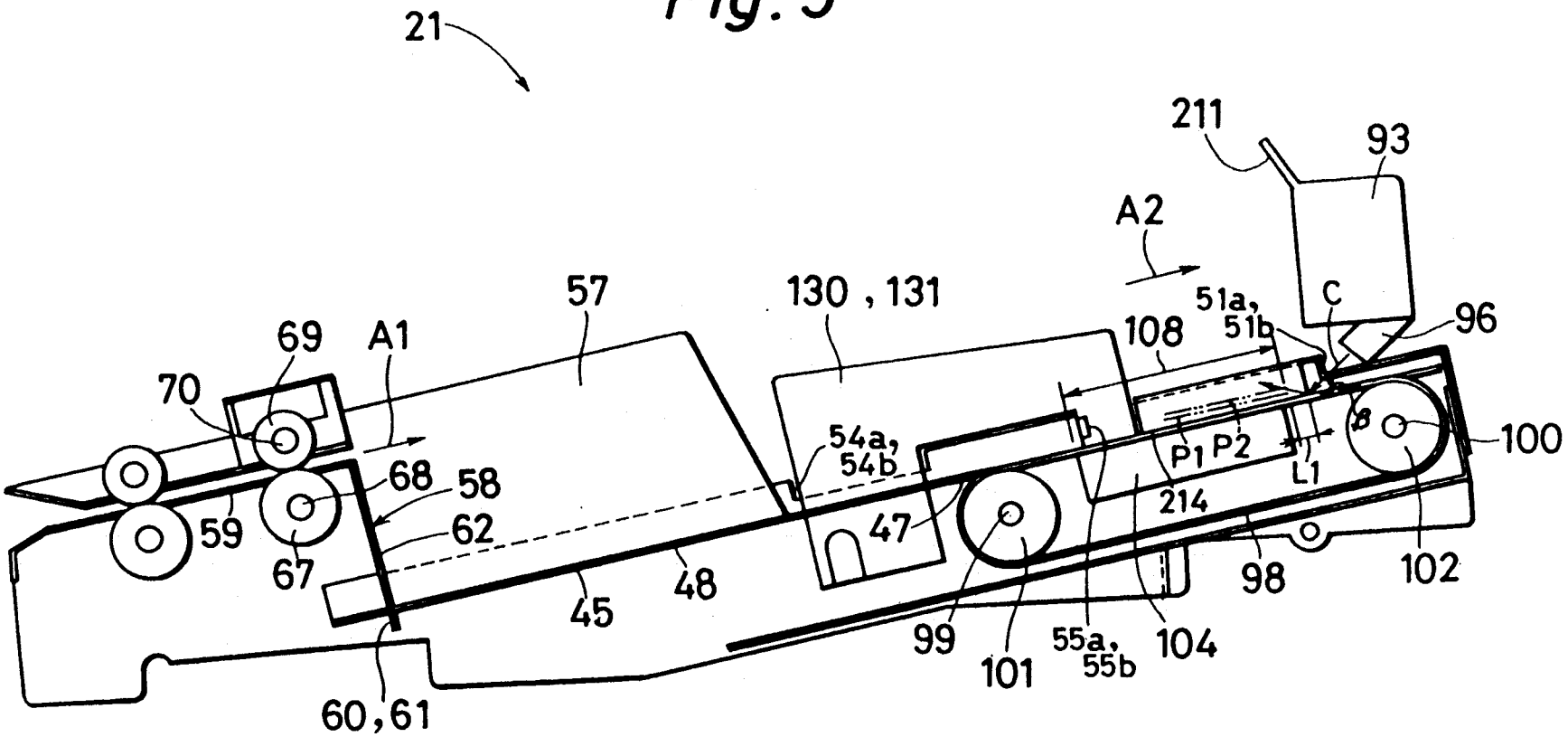
FIG. 5 is a sectional view of a paper feeder 21 in an embodiment of the invention.
Figure 6:
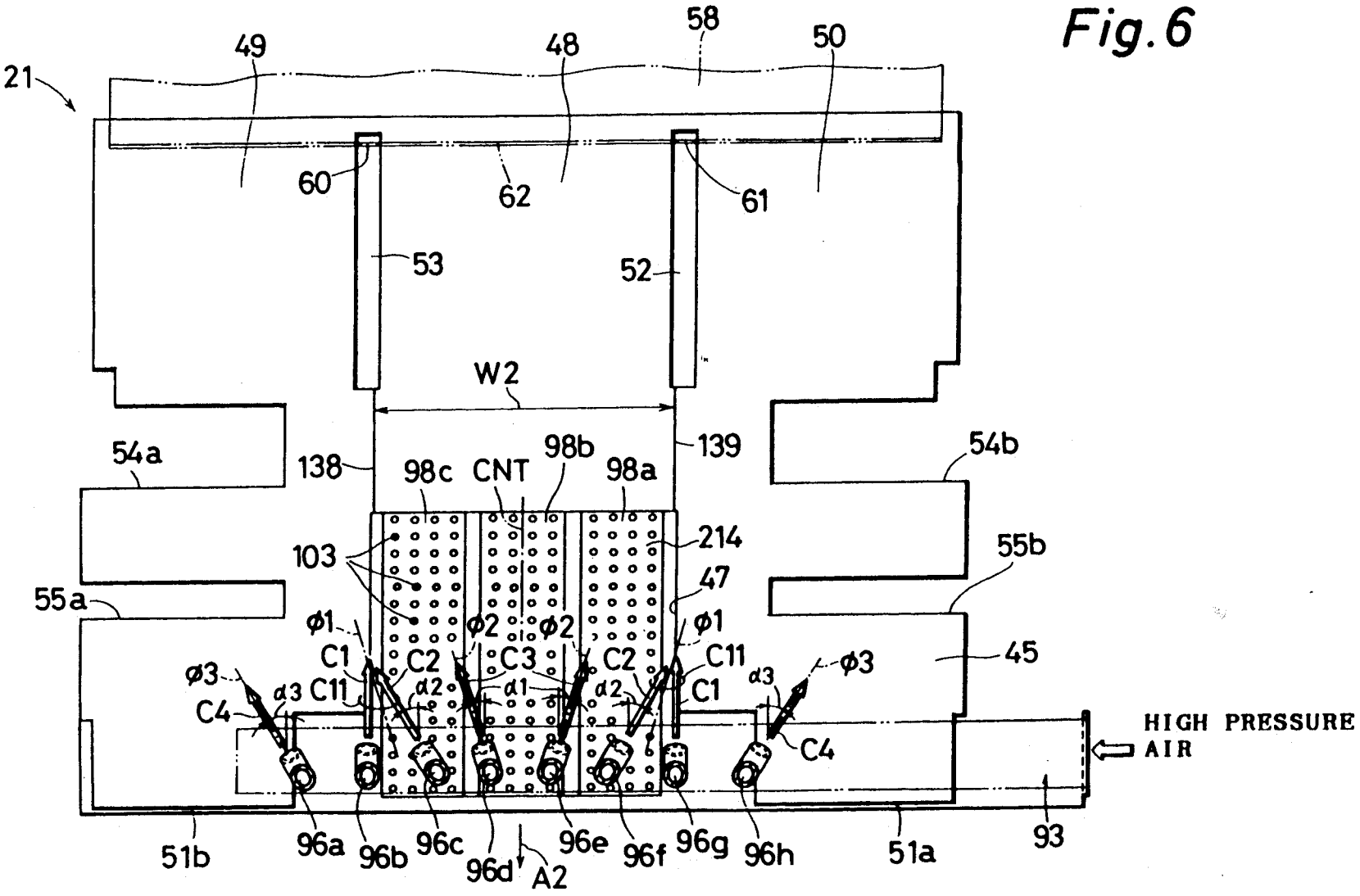
FIG. 6 is a plan view of the paper feeder 21.
Figure 7:
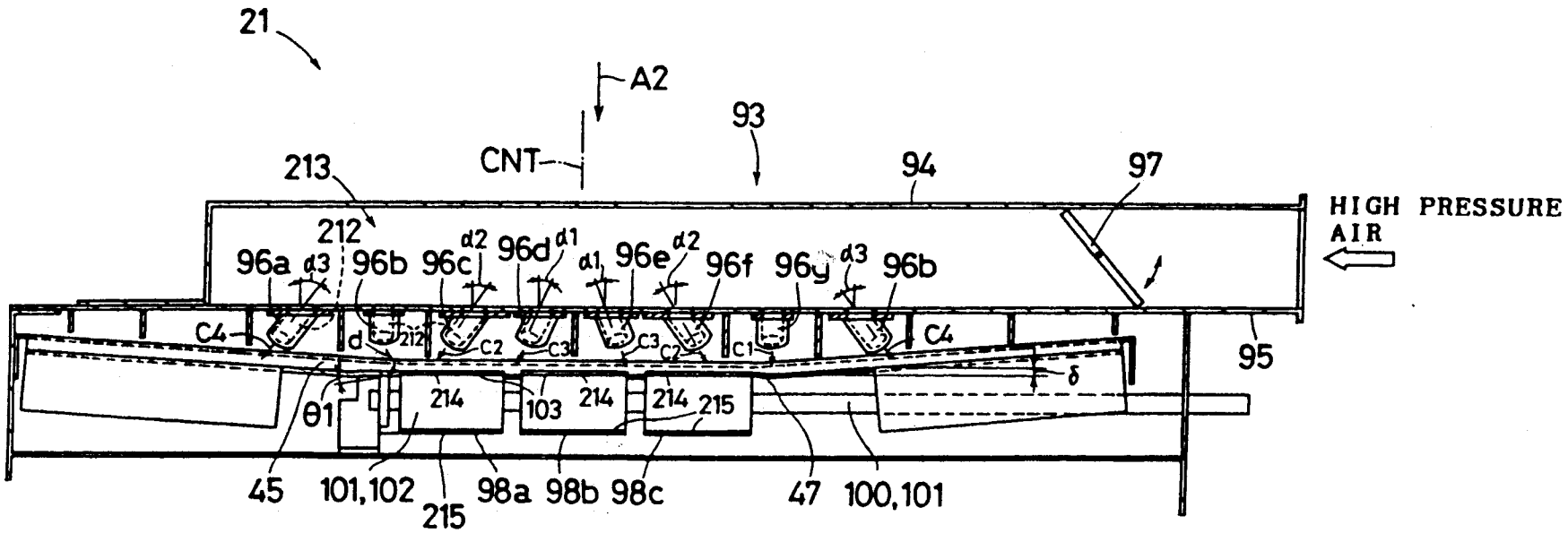
FIG. 7 is a side view thereof.
Figure 8:
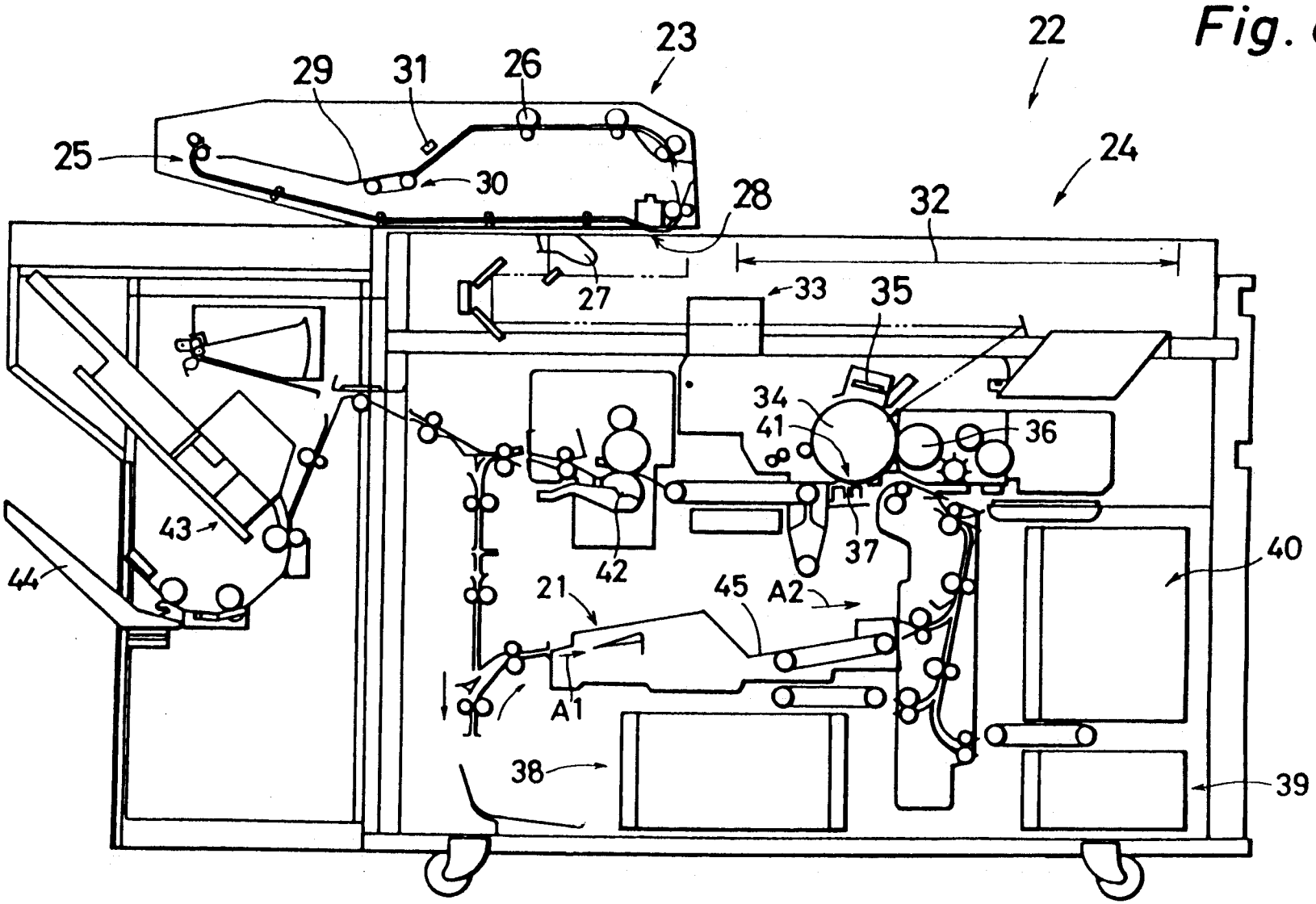
FIG. 8 is a sectional view of a copying machine 22 employing the paper feeder 21.

FIG. 5 is a side view showing a section of a paper feeder 21 called an intermediate tray in an embodiment of the invention, FIG. 6 is a plan view of the paper feeder 21, FIG. 7 is a front view thereof, and FIG. 8 is a sectional view of a copying machine 22 employing such paper feeder 21. The copying machine 22 comprises a recirculating document handler unit (hereinafter called RDH unit) 23, and a main body 24. The RHD unit 23 has a document feeder 25 of so-called bottom-take top-return system, and the taken document is exposed in an exposure region 28 by a light source 27 while being conveyed through a conveying route 26, and is returned to the document feeder 25. The document feeder 25 comprises a document laying plate 29, paper feeder 30, and air injection unit 31.

The main body 24 has the light source 27 in its inside, and an exposure region 28 of the RDH unit 23 by the light source 27 and an exposure region 32 of the main body 24 are set. The document reflected light beams from the exposure regions 28, 32 are focused on a photosensitive drum 34 through an optical system 33. Around the photosensitive drum 34 are arranged a charger 35, a developer 36, and a transfer unit 37, and recording papers of various sizes are supplied from three paper feeders 38, 39, 40 to the transfer region 41 between the transfer unit 37 and the photosensitive drum 34, and the document images by the document reflected light are recorded. The recording papers after transfer are fixed in a fixing unit 42, and filed in every specified number of pieces in a bundling unit 43, and stored in a discharge tray 44.

In the paper feeder 21, the copied recording papers are carried in the direction of arrow A1, and fed along the direction of arrow A2. The laying plate 45 of the paper feeder 21 which is explained below is positioned at an inclination of, for example, 10.4 degrees to the horizontal direction so that the upstream side may be lower than the downstream side of the paper feeding direction A2 with respect to the horizontal direction.

Figure 9:
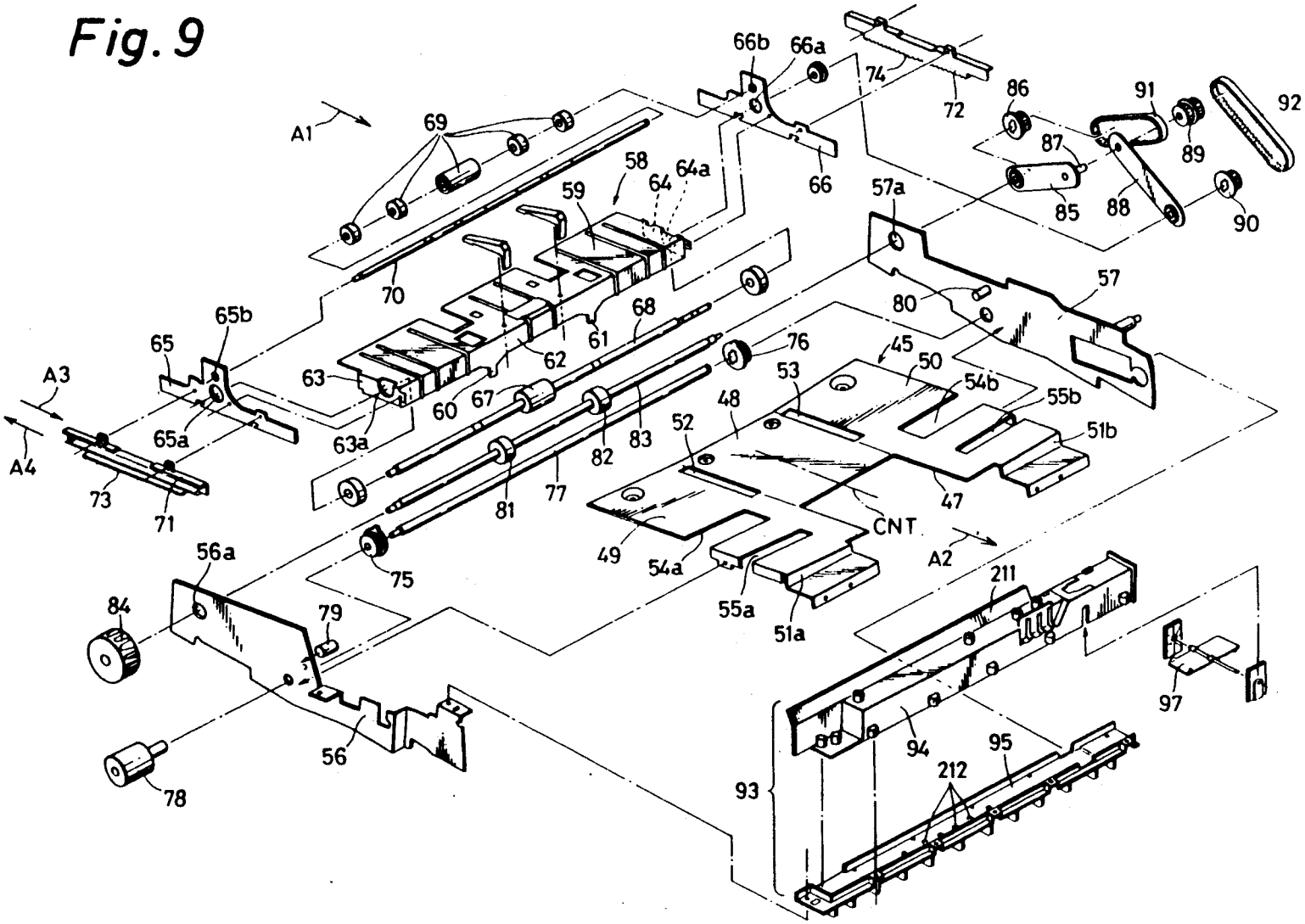
FIG. 9 and FIG. 10 are exploded perspective views of the paper feeder 21.
Figure 10:
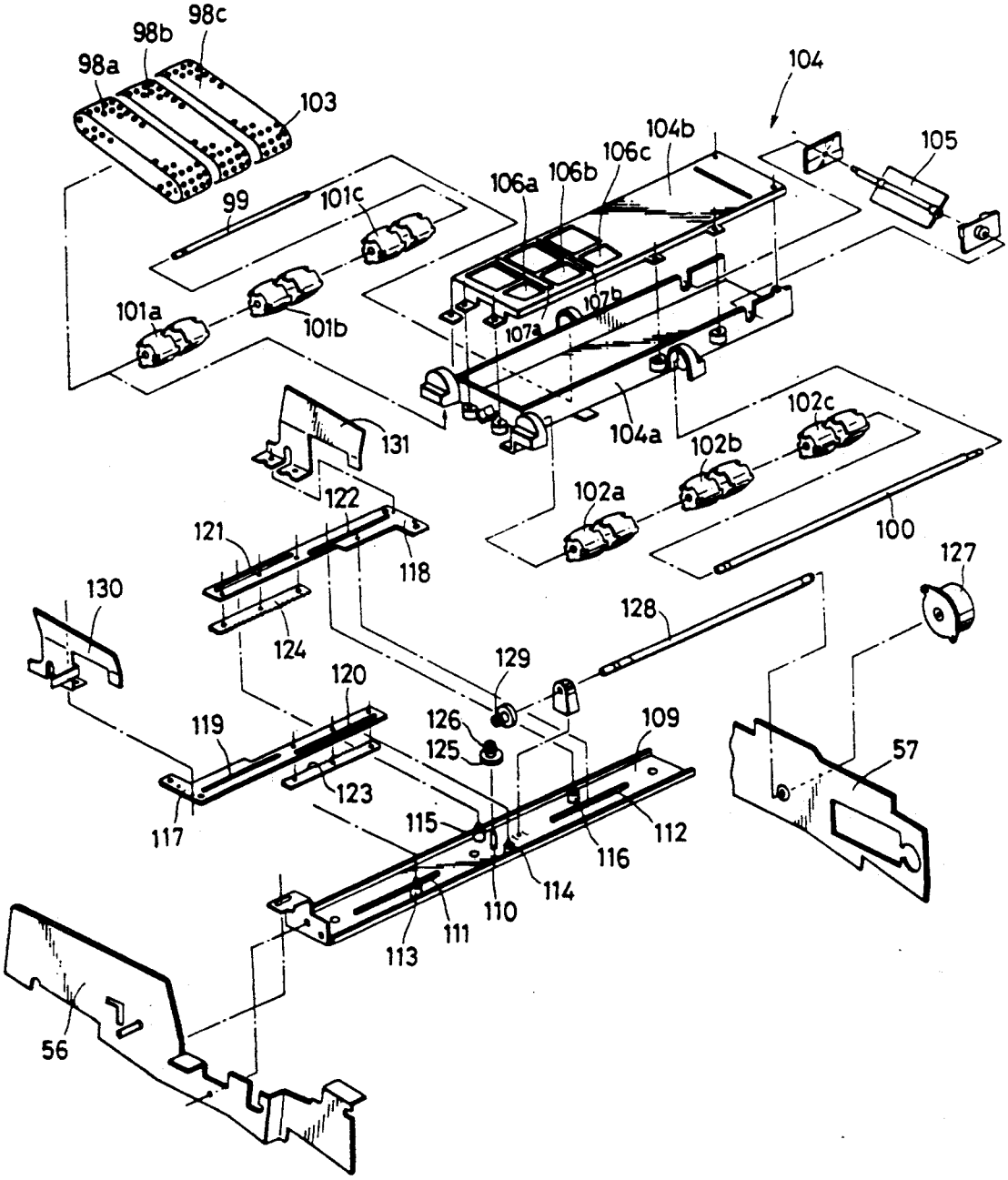

FIG. 9 and FIG. 10 are exploded perspective views of the paper feeder 21. Referring also to FIG. 5 to FIG. 7, the paper feeder 21 is described below. The paper feeder 30 of the document feeder 25 is composed basically same as the paper feeder 21 described below. The paper feeder 21 comprises the laying plate 45 on which the recording papers conveyed in the conveying direction A1 are stacked up. A notch 47 is formed in this laying plate 45, and the upper stretching parts of the belts 98*a*, 98*b* and 98*c* (collectively indicated by numeral 98 where necessary) stretched for feeding the recording paper mounted for composing the feeding means together with the laying plate 45 are opposite to the recording paper upward, and are exposed through this notch 47.

The laying plate 45 comprises a central laying part 48 having a predetermined length W2 in the widthwise direction orthogonal to the recording paper feeding direction A2, and lateral laying parts 49, 50 formed by plastically folding so as to be bent upward along the widthwise outward direction by forming an angle of $\theta 1$ to the central laying part 48 intetrally communicating with the both ends in the widthwise direction of the central laying part 48. The lateral laying parts 49, 50 are extended longer than the central laying part 48 toward the downstream side of the feeding direction A2, and downward drooping stepped parts 51*a*, 51*b* are formed near the end parts thereof. A pair of parallel slots 52, 53 are formed along the paper feeding direction A2 in the laying plate 45, and pairs of slots 54*a*, 54*b*, 55*a*, 55*b* are formed in the same direction in the individual lateral laying parts 49, 50. Such laying plate 45 is formed symmetrically to the widthwise central position CNT. The laying plate 45 is screwed to the lateral plates 56, 57 at both ends in the widthwise direction.

At the upstream side of the paper feeding direction A1 of the laying plate 45, a rear end defining member 58 is disposed. The rear end defining member 58 communicates with a guide plate 59 for guiding the recording paper delivered along the conveying direction A1 by supporting from beneath, and the downstream side of the conveying direction A1 of the guide plate 59, and comprises a defining plate 62 having slots 52, 53 formed in the front ends, forming guide pieces 60, 61 slidable along the longitudinal direction of the slots 52, 53, contacting against the upstream side end part of the paper feeding direction A2 of the recording papers stacked up on the laying plate 45, and aligning the upstream side end parts of the stacked-up recording papers.

As mentioned above, the laying plate 45 is composed so that the upstream side of the paper feeding direction A2 may be lower than the downstream side with respect to the horizontal direction. Therefore, as shown in FIG. 5, the recording paper delivered in the arrow A1 direction onto the laying plate 45 by the rollers 67, 69 slides to the downstream side of the paper feeding direction A2 on the laying plate 45, and collides against a collision plate 211 of, for example, a draft duct 93 mentioned below and stops, and returns to the upstream side of the paper feeding direction A2 due to the slope stated above, that is, to the rear end defining member 58 side, and stops by contacting against the defining plate 62 of the rear end defining member 58. In this way, the upstream side end portions of the feeding direction A2 of the recording papers stacked up on the laying plate 45 are aligned, and hence the downstream side end portions of the feeding direction A2 of the recording papers having the same shape are also aligned.

At both ends in the widthwise direction of the guide plate 59, side plates 63, 64 are drooping and formed, and mounting plates 65, 66 are affixed to the side plates 63, 64, respectively. In the side plates 63, 64 and mounting plates 65, 66, coaxial mounting holes 63*a*, 64*a*, 65*a*, 66*a* are formed, and a rotary shaft 68 on which the roller 67 is fixed is free to rotate and penetrate. In the mounting plates 65, 66, furthermore, mounting holes 65*b*, 66*b* are formed above the mounting holes 65*a*, 66*a*, and a rotary shaft 70 on which plural rollers 69 are fixed is free to rotate and penetrate.

On the mounting plates 65, 66, driving members 71, 72 with an approximately C-section in the section orthogonal to the longitudinal direction are fixed with the open ends directed outward in the widthwise direction. At the lower end parts of the driving members 71, 72, racks 73, 74 are formed along the longitudinal direction. On the side plates 56, 57, a rotary shaft 77 on which pinions 75, 76 to be engaged with the racks 73, 74 at both ends is rotably mounted, and is rotated by a pulse motor 78.

At the located positions of the driving members 71, 72 in the side plates 56, 57, the rotary rollers 79, 80 are rotatably installed, and the driving members 71, 72 are composed so as to contain the rotary rollers 79, 80 therein, respectively. Therefore, the driving members 71, 72 are supported so as not to fall downward by the rotary rollers 79, 80, and are free to slide easily along the longitudinal direction. That is, by the pulse motor 78, as the rotary shaft 77, hence, pinions 75, 76 are put into rotation, the driving members 71, 72 are displaced reciprocally in the direction of arrows A3, A4 along the longitudinal direction thereof, so that the rear end defining member 58 may be displaced reciprocally to the downstream side and upstream side of the feeding direction A2.

The mounting holes 56*a*, 57*a* are formed in the side plates 56, 57, and the rotary shaft 83 on which the rollers 81, 82 are fixed is free to rotate and penetrate. The rotary shaft 83 is manually rotated by a knob 84 affixed to this shaft. The opposite side to the knob 84 of the rotary shaft 83 is fixed to a gear 86 by rotatably penetrating one end of the longitudinal direction of the coupling plate 85 formed slenderly. On the opposite side of the coupling plate 85, a pivot 87 is projecting toward the outside of the widthwise direction, and is rotatably inserted into one end in the longitudinal direction of a coupling plate 88 in the same shape as the coupling plate 88, and is further fixed in a gear 89. At the other end of the coupling plate 88, one end of the rotary shaft 68 is rotatably inserted to be fixed with the gear 90. Between the gears 86, 89, a tiny belt 92 is streched, and between the gears 89, 90, a timing belt 92 is stretched.

That is, when the knob 84 is turned by hand, the rotary shafts 68, 83 rotate in synchronism even if the rear end defining member 58 on which the rotary shaft 68 is mounted is at an arbitrary position along the conveying direction A1, so that jamming may be cleared.

At the downstream side of the feeding direction A2 of the laying plate 45, a nozzle member 93 fixed to the side plates 56, 57 is disposed as being stretched in the widthwise direction. The nozzle member 93 is composed of a main body 94 forming a bottomless box longitudinal in the widthwise direction, and a cover body 95, and an air passage 213 is formed inside. The cover body 95 has nozzles 96*a* to 96*h* having nozzle holes 212, respectively formed in plural pairs at symmetrical positions with respect to the widthwise direction central position CNT of the laying plate 45, and draft/stop is realized to the laying plate 45 by the angular displacement state of a damper 97 installed in the nozzle member 93.

Beneath the laying plate 45, three feeding stretch belts 98*a*, 98*b*, 98*c* are disposed, for example, opposite to the notch 47, and they are stretched between the driving rollers 101*a*, 102*a*; 101*b*, 102*b*; 101*c*, 102*c* fixed on the rotary shafts 99, 100, resepctively.

At the upper ends of the feeding stretch belts 98*a* to 98*c*, between the upper stretching portion 214 forming the paper feeding surface and the central laying part 48 of the laying plate 45, a step difference of height δ is set so that the upper stretching part 214 of the feeding stretch belts 98*a* to 98*c* may be lower as shown in FIG. 7. This step difference height δ is selected in a range of 1 to 5 mm, or preferably about 2 mm. The step difference height δ is, as described in detail below, intended to produce a gap to the second recording paper from the bottom by deflecting downward by the step difference height δ from the central laying part 48 of the laying plate 45, when the lowest recording paper of the stack of the recording papers P on the laying plate 45 is attracted in vacuum to the feeding stretch belts 98*a* to 98*c*, thereby separating smoothly. Accordingly, if the step difference height δ is too small, the separating capacity is insufficient, or if excessive, attracting of the recording paper to the feeding stretch belts 98*a* to 98*c* is insufficient, and conveying failure may occur.

In the feeding stretch belt 98, multiple penetration holes 103 are formed as the air vent holes, and inside the feeding stretch belt 98 there is a vacuum attracting box 104 for attracting in vacuum the recording paper by negative pressure on the feeding stretch belt 98 through the penetration holes 103. The vacuum attracting box 104 is composed of a box-shaped main body 104*a* and a cover body 104*b*, and attracting holes 106*a* to 106*c* are formed in the cover body 104*b* at positions corresponding to the feeding stretch belts 98*a* to 98*c*. Among the attracting holes 106*a* to 106*c* there are formed protrusions 107*a*, 107*b* extending along the feeding direction A2, and they are selected at a height projecting higher than the upper stretching part 214, among the feeding stretching belts 98*a* to 98*c*. The vacuum attracting box 104 is connected to a vacuum source (not shown), and executes and stops the attracting action of the recording paper by the angular displacement action of the damper 105 contained inside.

As shown in the plan view in FIG. 6, the nozzles 96*b*, 96*g* possessing a second nozzle hole for forming an air injection flow C1 parallel to the feeding direction A2 are composed parallel to the feeding direction A2 in a plan view. The angle α2 of the nozzles 96*c*, 96*f* having a first nozzle hole forming an injection flow C outward in the widthwise direction colliding against the injection flow C1 formed with the feeding direction A2 in a plan view is 20 to 45 degrees, or preferably selected around 30 degrees. Concerning the air flow C11 combining these injection flows C1, C2, the central line φ1 of each air flow is assumed.

The angle α1 of the nozzles 96*d*, 96*e* forming an injection flow parallel to the central line φ2 outward in the widthwise direction and an air flow C2, inward in the widthwise direction from the nozzles 96*c*, 96*f*, formed with the feeding direction A2 in a plan view is 0 to 45 degrees, or preferably selected around 15 degrees. Besides, the angle α3 of the nozzles 96*a*, 96*h* forming an injection flow parallel to the central line φ3 outward in the widthwise direction and an air flow C4, disposed outward in the widthwise direction of the nozzles 96*b* to 96*g*, with the feeding direction A2 in a plan view is 9 to 45 degrees, or preferably selected around 30 degrees.

On the other hand, the angle β of the nozzles 96*a*, 96*h* formed with the feeding direction A2 in the side view shown in FIG. 5, that is, with the central laying part 48 is 3 to 10 degrees, or preferably selected around 3.5 degrees, and is determined as follows. First of all, by the entire structure of the copying machine 22 including the paper feeder 21, the configuration of the nozzle member 93 is determined, and therefore the base end positions of the nozzles 96*a* to 96*h* determined. On the other hand, as shown in FIG. 5, the air flow C in the side view of each nozzle 96 is above the feeding stretch belt 98, and is injected to a position remote from the suction region 108 set on the feeding stretch belt 98 by the vacuum attracting box 104 by a predetermined distance L1 to the downstream side of the feeding direction A2.

In this embodiment, in other words, the air flow C is not directly blown to the downstream side end part of the feeding direction A2 of the recording papers P stacked up as shown in FIG. 6 on the laying plate 45 including the range above the feeding stretch belt 98, but it is once injected to the feeding stretch belt 98 at the downstream side of the feeding direction than the downstream side end portion of the feeding direction of the stacked-up recording papers, and the reflected air flow collides against the downstream side end part in the feeding direction A2 of the recording papers P, thereby separating the bottom recording paper P1 from the second recording paper P2. That is, if the air flow C is directly injected to the downstream side end part of the recording paper, such air flow generates a force for pressing the recording papers P to the downward side, which may be inconvenient for separating the recording papers. By using the reflected flow, the recording paper P is blown upward, apart from the feeding stretch belt 98, so that the separation action may be done smoothly. Besides, the air flow from the nozzle 96 does not contribute to the separation of recording papers, which is effective to prevent undesired attracting to the vacuum attracting box 104.

The configuration of the nozzles 96*b*, 96*g* is selected so that the distance L1 of the nozzles 96*b*, 96*g* may be shorter than the length L2 of the longer side of the recording paper of the minimum width assumed to be used, for example, the B5 format of JIS, and the air flow C11 composed of the injection flow C1 from the nozzles 96*b*, 96*g*, and the injection flow C2 from the nozzles 96*c*, 96*f* is directed inward in the widthwise direction than the both end parts of the widthwise direction of the recording paper of the minimum width. Besides, the configuration of the nozzles 96*a* and 96*h* is determined so that their distance L3 may be shorter by a specific extent than the length of the longer side of the maximum recording paper assumed to be used, for example, B4 or A3 of JIS or the double letter size WLT generally used in English-speaking nations (11 inches by 17 inches), and the air flow C4 from these nozzles 96*a* and 96*h* is directed inward in the widthwise direction than the both end parts of the widthwise direction of the maximum recording paper.

Beneath the feeding stretch belt 98, the side plate 56 is fixed, and a longitudinal support plate 109 is disposed in the widthwise direction. In the central position of the support plate 109 in the widthwise direction, a pivot 110 is set up, and relating to the pivot 110, guide grooves 111 and 112 extending in the widthwise direction are formed at both sides in the widthwise direction. Guide pins 113 to 116 are set up on the support plate 109, and these guide pins 113 to 116 are inserted into slots 119, 120; 121, 122 formed on the support plate 109 and extending in the widthwise direction of longitudinal dirving members 117 and 118 in the widthwise direction, and the driving members 117 and 118 are defined in the moving direction in the widthwise direction by the guide pins 113 to 116.

In the mutually confronting edge parts of the driving members 117, 118, racks, 123, 124 are formed respectively, and are engaged with a gear 125 rotatably installed in the pivot 110 mutually from the opposite sides. On this gear 125, a bevel gear 126 is coaxially fixed, and it is engaged with a bevel gear 129 fixed at the front end of a rotary shaft 128 rotated by a pulse motor 127 fixed on the side plate. At the outer end parts in the widthwise direction of the driving members 117, 118, there are fixed lateral end defining plates 130 and 131 engaged with the slots 54*a*, 55*a*; 54*b*, 55*b* of the laying plate 45, and arranged being projected upward from the laying plate 45.

That is, in the copying machine 22, when any of the paper feeders 38 to 40 in which recording papers of various sizes are stored is selected, the pulse motor 127 is driven in a specified direction by the action of the control unit mentioned later, and the amount of rotation depends on the engagement of the bevel gears 129, 126, and the driving members 117, 118 are displaced inward or outward along the widthwise direction, and the gap of the lateral end defining plates 130, 131 is set to the size of the selected recording paper, thereby aligning the lateral ends in the widthwise direction of the recording papers delivered onto the laying plate 45.

Figure 11:
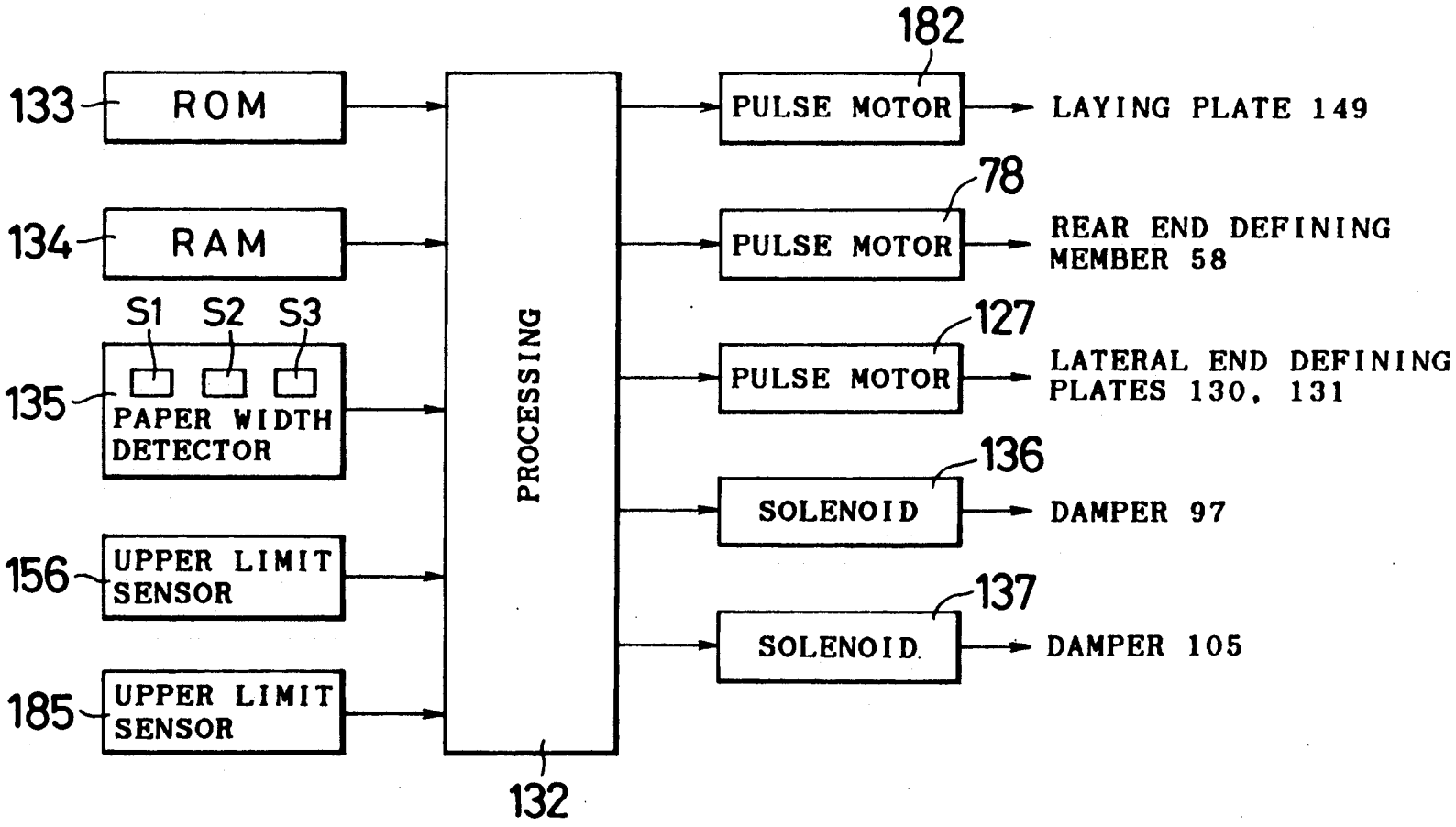
FIG. 11 is a block diagram showing an electrical structure of the copying machine 22.

FIG. 11 is a block diagram showing an electric composition of the copying machine 22, in which only essential parts are shown for the sake of simplicity of explanation. The copying machine 22 comprises, for example, a central processing unit (CPU) 132 containing a microprocessor, and the CPU 132 controls the actions of the copying machine 22, for example, according to the action program stored in a ROM (read-only memory) 133. The CPU 132 comprises a RAM (random access memory) 132 for storing the input data such as number of copies and various operation modes, and a paper width detector 135 for detecting the width of the recording papers stored in the paper feeders 38 to 40.

A constitutional example of the paper width detector 135 is shown later in FIG. 31, and anyway in the paper feeding apparatus 21, the lateral end defining plate 131 is manually operated, and limit switches or other position sensors are disposed for every moving position of the lateral end defining plate 131, corresponding to JIS sizes such as B4, B5 and A4, or American or European sizes such as letter size LT (11 inches by 8.5 inches), regal size RG (14 inches by 8.5 inches) and double letter size WLT (17 inches by 11 inches).

The pulse motors 78 and 127 are connected to the CPU 132, and on the basis of the dimension in the widthwise direction of the recording paper being used detected by the paper width detector 135, the rear end defining member 58 is moved to the upstream side or downstream side of the feeding direction A2, and the lateral end defining plates 130 and 131 are moved inward or outward in the widthwise direction. Moreover, electromagnetic solenoids 136 and 137 are connected to open or close the dampers 97 and 105. Furthermore, the CPU 132 controls the pulse motor 132 which moves up and down the laying plate 45 of the recording papers of the paper feeders 38 to 40 within the paper feeders 38 to 40.

Figure 12:
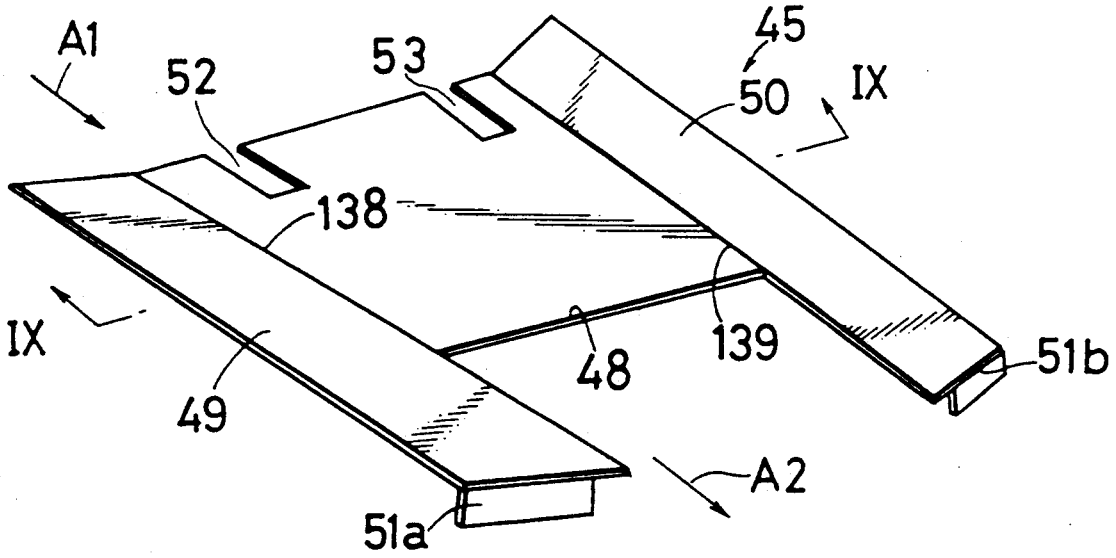
FIG. 12 is a perspective view of a laying plate 45.
Figure 13:
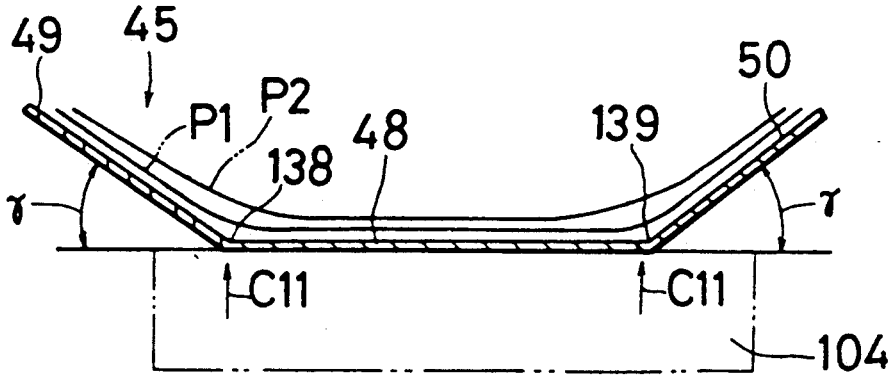
FIG. 13 is a sectional view of the laying plate 45.

FIG. 12 is a simplified magnified perspective view of the laying plate 45, and FIG. 13 is a sectional view from sectional line X13—X13 of FIG. 12. Regarding the central laying part 48 of the laying plate 45, the both side laying parts 49 and 50 are bent upward by the angle $\gamma$ (3 to 10 degrees, preferably about 3.5 degrees) as predetermined as going outward in the widthwise direction, and bent parts 138 and 139 are formed in their boundary, parallel to the feeding direction A2. In the feeding apparatus 21 of the embodiment, in order to separate the bottom recording paper P2 and the second recording paper P2 in the stacked recording papers P, it is necessary that the gap in which the air flow from the nozzle 96 is blown and injected be formed between the recording papers P1 and P2. Accordingly, in this embodiment, the angle $\gamma$ is set between the central laying part 48 of the laying plate 45 and the lateral laying parts 49, 50, and the bent parts 138, 139 are composed. Moreover, the step difference height $\delta$ is provided between the inward end part i the widthwise direction of the lateral laying parts 40, 50 and the feed stretch belt 98.

Figure 14:
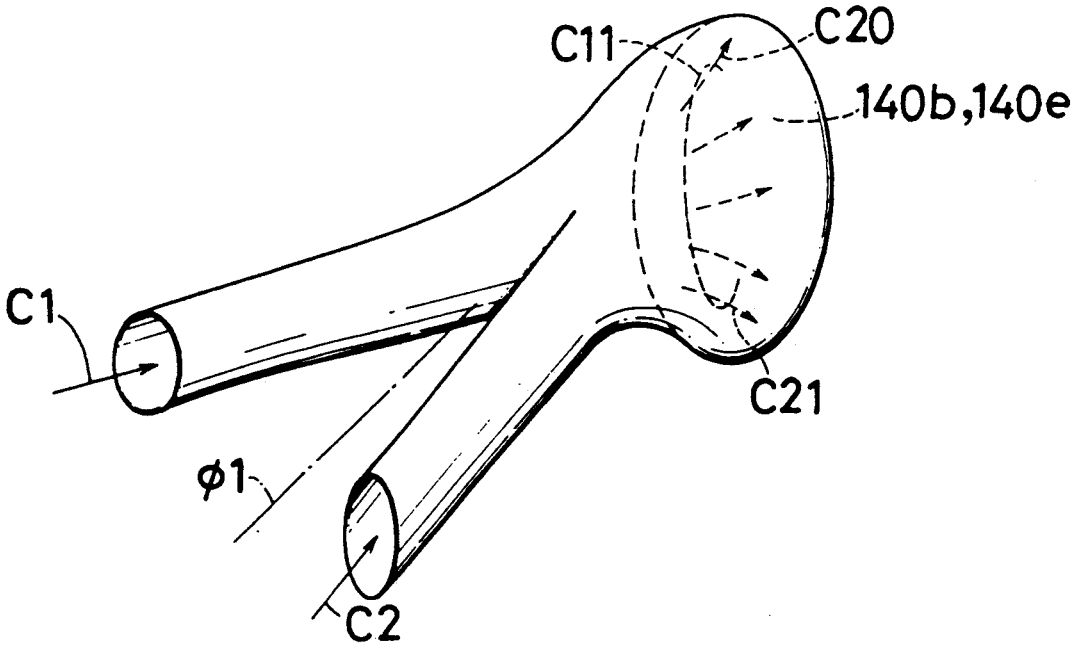
FIG. 14 is a perspective view showing the state of air streams from nozzles 96*b*, 96*c* in the embodiment.
Figure 15:
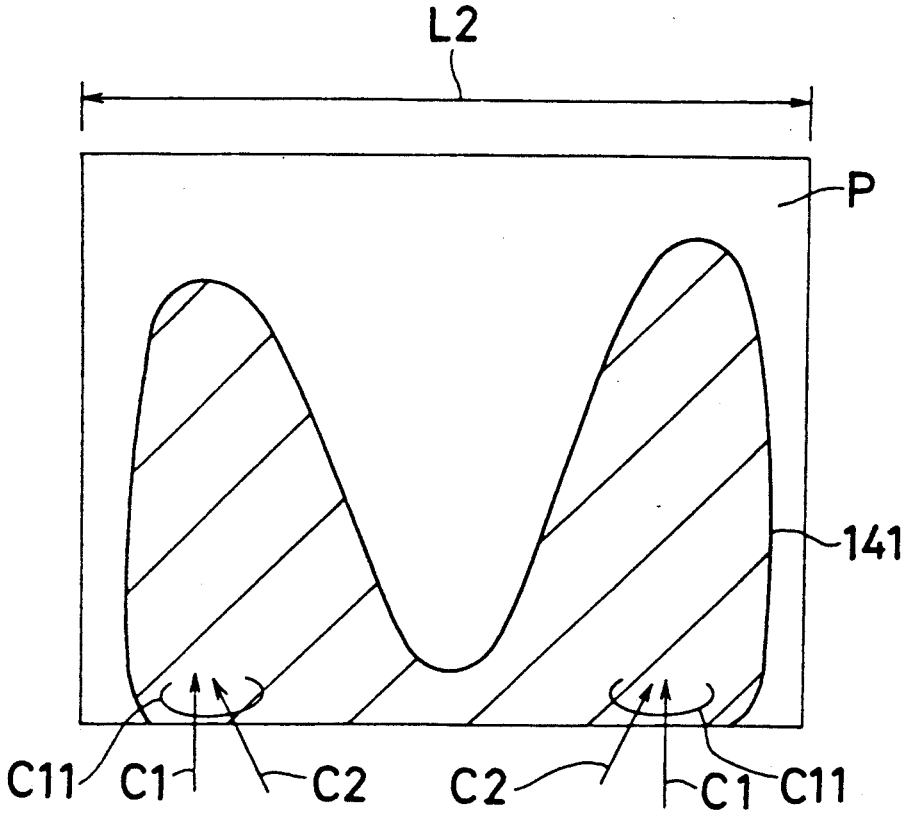
FIG. 15 is a plan view for explaining the state of air streams from nozzles 96*b*, 96*c*; 96*f*, 96*g* in the embodiment.
Figure 17:
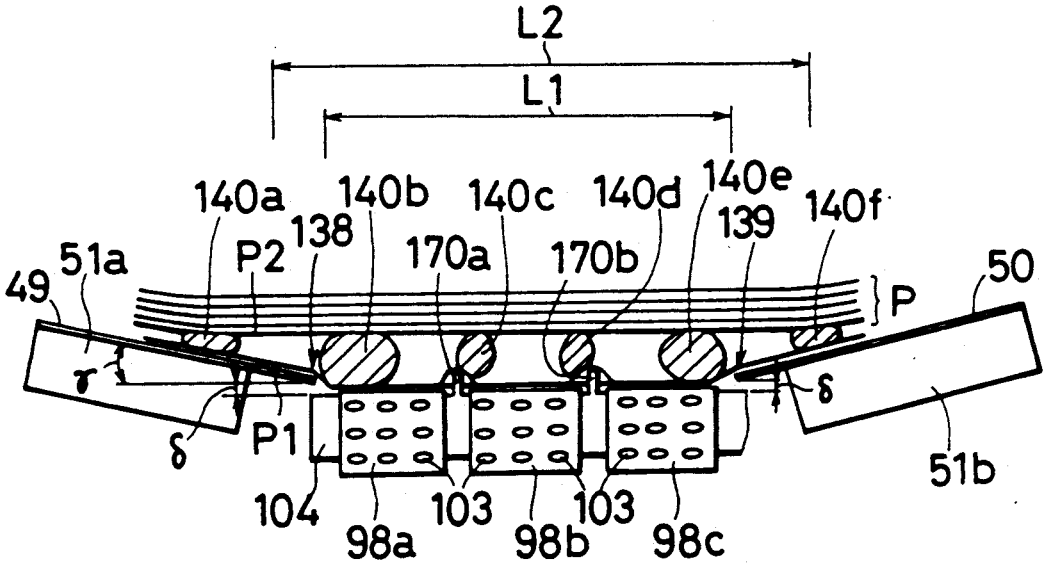
FIG. 17 is a side view for explaining the action of this embodiment.

Therefore, when the recording paper P1 is attracted as shown in FIG. 13 by the negative pressure by the vacuum attracting box 104 to the feeding stretch belts 98*a* to 98*c*, a gap is formed between the recording papers P1 and P2, at least near the bent parts 138 and 139. The nozzles 96*b*, 96*c*; 96*f*, 96*g* are composed so as to blow the air flow C11 into the gap around the bent parts 138, 139 along the center line 11 as shown in FIGS. 14, 15, and therefore the blown air flow C11 is inflated in the vertical direction. The vacuum attracting box 104 has protrusions 107*a*, 107*b*, and the recording paper P1 is curved in a profile along these protrusions 107*a* and 107*b* as shown in FIG. 17. On the other hand, since the second recording paper P2 is not attracted by the vacuum attracting box 104, a gap is produced against the recording paper P1 at both sides of the protrusions 107*a* and 107*b*.

The nozzles 96*d* and 96*e* blow air flow into the gap at the inward side in the widthwise direction of the protrusions 107*a*, 107*b*, and this air flow collides against the side walls of the protrusions 107*a*, 107*b* to inflate in the vertical direction. As a result, regions 140*c*, 140*d* shown in FIG. 17 are created, which contributes to separation of the recording papers P1 and P2. At this time, as mentioned above, the layout gap L1 between the nozzles 96*b*, 96*g* is set shorter than the length L2 of the longer side of the recording paper in, for example, B5 format of JIS. Still more, the injection flows indicated by arrows C2, C3 directed from inward to outward in the widthwise direction of the nozzles 96*c* to 96*f* are blocked by the injection flows parallel to the feeding direction A2 as indicated by arrow C1 of the nozzles 96*b*, 96*g* to be united into one air flow C11, which runs in the direction of arrow C11 and is inflated in the vertical direction as mentioned above, thereby realizing the separating region C14 shown in FIG. 16. It is therefore possible to avoid flapping of the widthwise end parts, or disturbance of stacked state or emission of noise, due to ejection of the air flow C11 from the widthwise ends of the recording paper with width L2.

FIG. 17 is a front view for proving the separation action of recording papers in this embodiment. The shaded regions 140*a* to 140*f* in FIG. 17 indicate the size and range of the air flow for separating the bottom recording paper P1 in the stack of recording papers P from the second recording paper P2 and others, by the injection of the air flow by the nozzles 96*a* to 96*h* mentioned above. In the regions 140*b*, 140*e*, the jet flows are concentrated in the widthwise direction as indicated by arrows C1, C2 by the nozzles 96*b*, 96*c*; 96*f*, 96*g*. Therefore, the jet flows concentrated along the widthwise direction as shown in FIG. 14 inflate vertically as shown by arrows C20, C21, and the recording papers P1, P2 are separated by this pressure. The occupied areas of the air flows inflating in the vertical direction are indicated as regions 140*b* and 140*e* in FIG. 17.

As examples of recording paper with wider width L4 than the width L2, there are double letter size and B4 size recording papers, and when separating such wide recording papers, the gap L3 of the nozzles 96*a* to 96*h* is selected smaller than the width L4 as mentioned above. Moreover, the laying plate 45 has step different parts 51*a*, 51*b* in the running direction of air flow from the nozzles 96*a*, 96*h* as stated above. That is, the majority of the air flow from the nozzles 96*a*, 96*h* collides against the step parts 51*a*, 51*b*, and flows in other direction than the laying plate 45, so that the flow rate and speed may be suppressed.

Therefore, the air flow from the nozzles 96*a*, 96*h* indicated by arrow C4 is relatively weakened, and injected between the recording papers p1, P2. In consequence, the separating region 142 in the recording paper P with width L4 becomes a region indicated by shading enclosed with broken lines in FIG. 16, and a wider area is realized than in the case of the separating region 141 for the recording paper P of smaller size. In this embodiment, more specifically, even if the recording papers are greater in width or size, it is possible to separate effectively. Still more, near the both ends in the widthwise direction of larger recording paper P, as mentioned above, the air flow from the nozzles 96*a* to 96*h* is controlled in flow rate to be injected. Therefore, it is possible to avoid disturbance of stacked state or generation of noise due to flapping of the end parts of the recording papers as mentioned above, resulting from the leak of air flow from both sides in the widthwise direction of the larger recording papers P.

Figure 18:
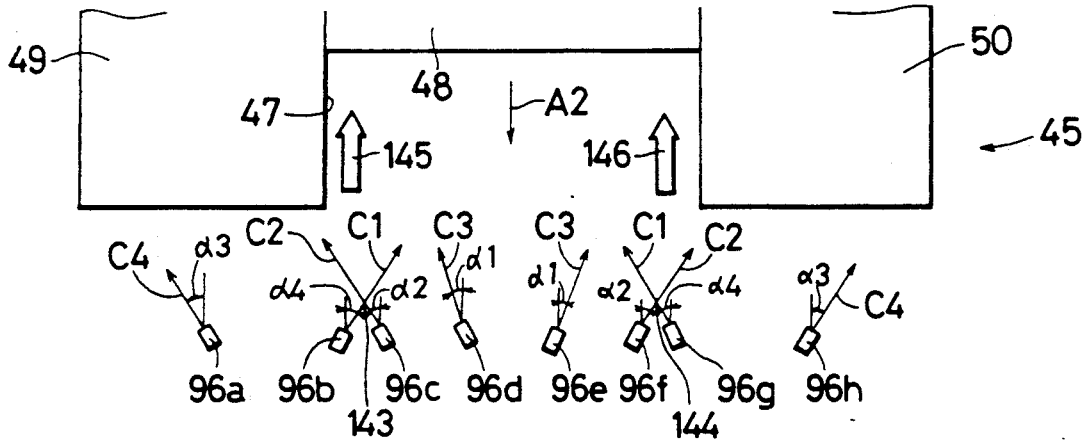
FIG. 18 through FIG. 21 are plan views for explaining other layouts of nozzles 96*a* to 96*h* of the same embodiment.

According to the embodiment, a relatively large separating capacity is realized by concentrating the air flows in the regions 140*b*, 140*e* shown in FIG. 17, and the separating capacity is further enhanced by injecting the air flow at specified flow rate into the regions 140*a*, 140*c*, 140*d*, 140*f*. Therefore, the configuration of the nozzles 96*a* to 96*h* for realizing the characteristic action is not limited to the layout shown in FIGS. 6 and 7. A first modification example of configuration of nozzles 96*a* to 96*h* is shown in FIG. 18, in which the nozzles 96*b*, 96*g* in the above embodiment are inclined by an angle of $\alpha 4$ inward in the widthwise direction with respect to the feeding direction A2.

In this embodiment, the injection flows C1, C2 from the nozzles 96*b*, 96*c*, and the injection flows C1, C2 from the nozzles 96*f*, 96*g* respectively collide against the collision positions 143, 144 in the widthwise direction, forming air flows 145, 146 parallel to the feeding direction A2, so that the regions 140*b*, 140*e* shown in FIG. 17 may be realized. The actions of the other nozzles 96*a*, 96*d*, 96*e*, 96*h* are same as in the foregoing embodiment.

Figure 16:
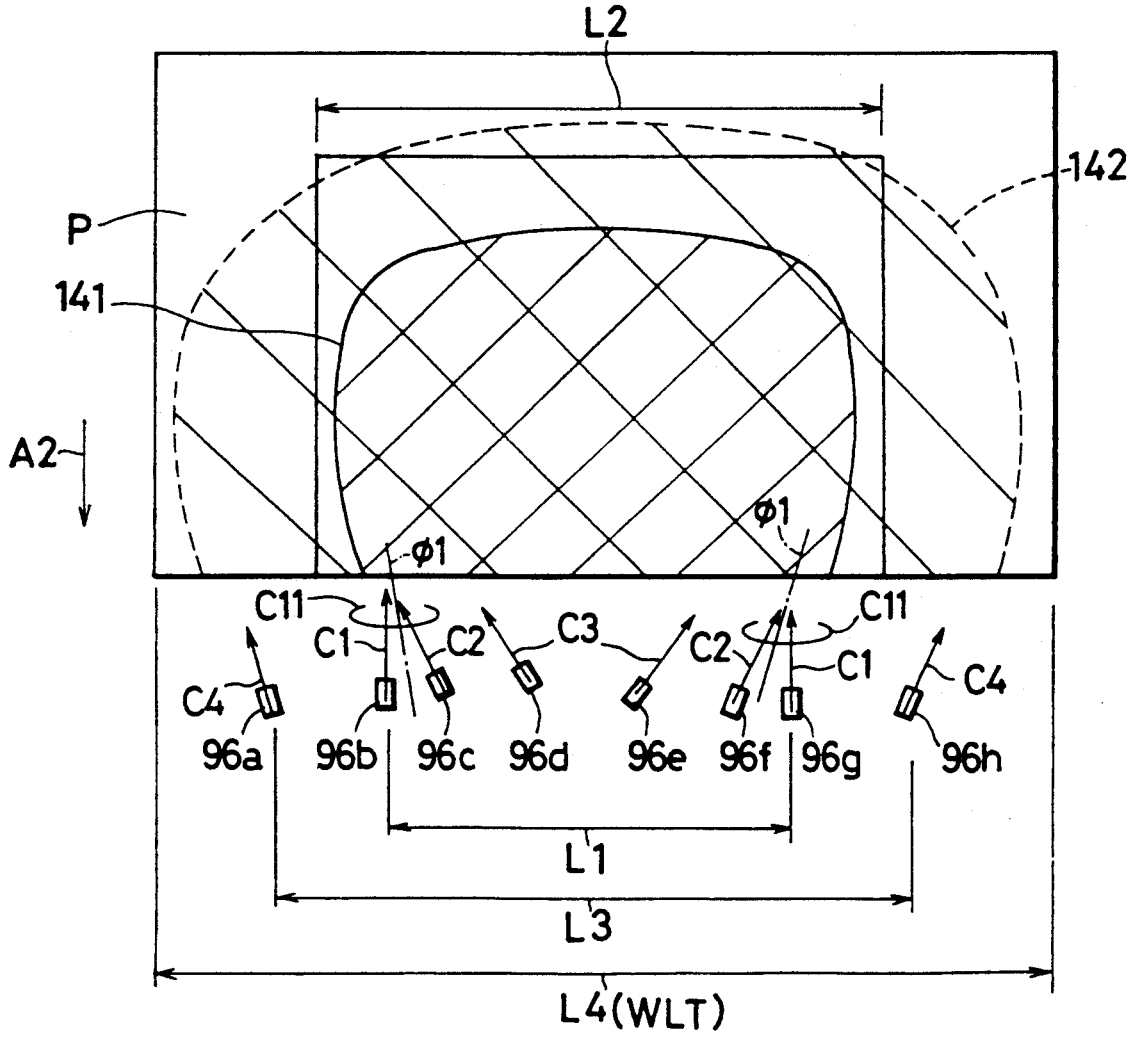
FIG. 16 is a plan view for explaining the state of air streams from nozzles 96*a* to 96*h*.
Figure 19:
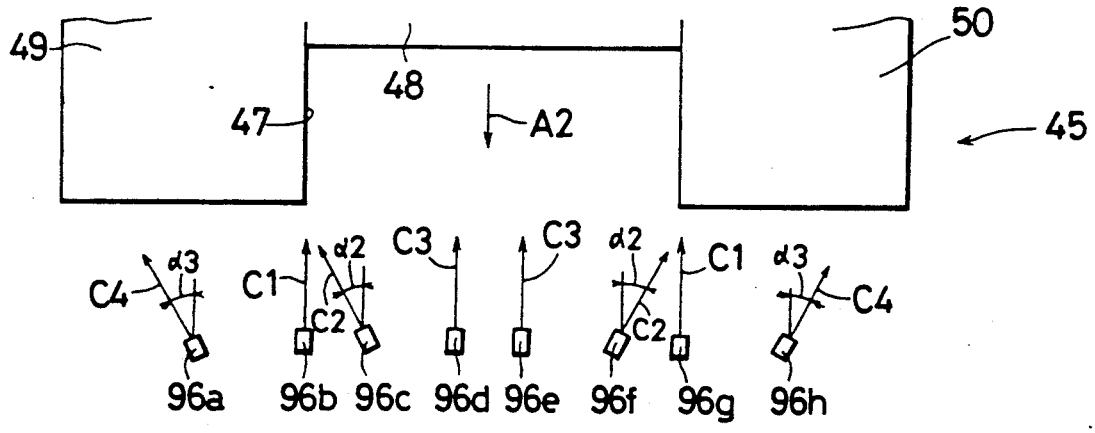

A second modification is shown in FIG. 19, in which the nozzles 96*d*, 96*e* are formed parallel to the feeding direction A2. The actions of the nozzles 96*a* to 96*c*, and nozzles 96*f* to 96*h* in this embodiment are same as in the first embodiment. The nozzles 96*d* to 96*e* of the embodiment are to inject air flow parallel to the protrusions 107*a*, 107*b* in the gap between the recording papers P1, P2 formed by the protrusions 107*a*, 107*b* formed in the vacuum attracting box 104 as explained by reference to FIG. 17. The stacked recording papers P are mutually contacting with each other, at widthwise both ends and upstream side end of feeding direction A2, as shown in FIG. 16. Accordingly, when air flow is injected into the gap, it produces a positive static pressure within the enclosed separating regions 141, 142, thereby realizing the separation in the vicinity of the widthwise central part of the recording papers P. By this embodiment, too, the same effect as in the foregoing embodiment may be realized.

Figure 20:
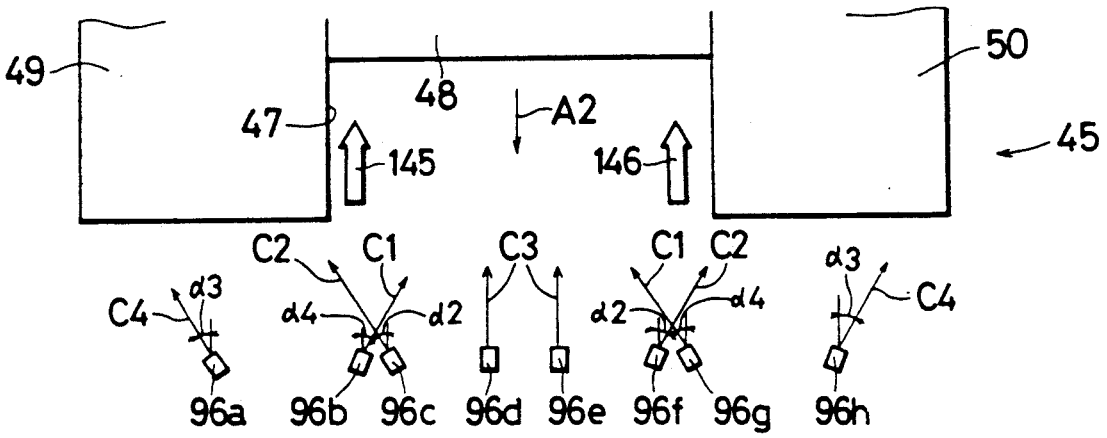

A third modification example is given in FIG. 20. The characteristic point of this embodiment is that the nozzles 96*b*, 96*g* in the second modification example are inclined inward in the widthwise direction by an angle $\alpha 4$, same as in the first modification example. In this embodiment, the action of the nozzles 96*a*, 96*h* is same as in the first embodiment, the action of the nozzles 96*b*, 96*c*; 96*f*, 96*g* is same as in the first modification, and the action of the nozzles 96*d*, 96*e* is same as in the second modification. In such embodiment, too, the same effect as in the preceding embodiments may be realized.

Figure 21:
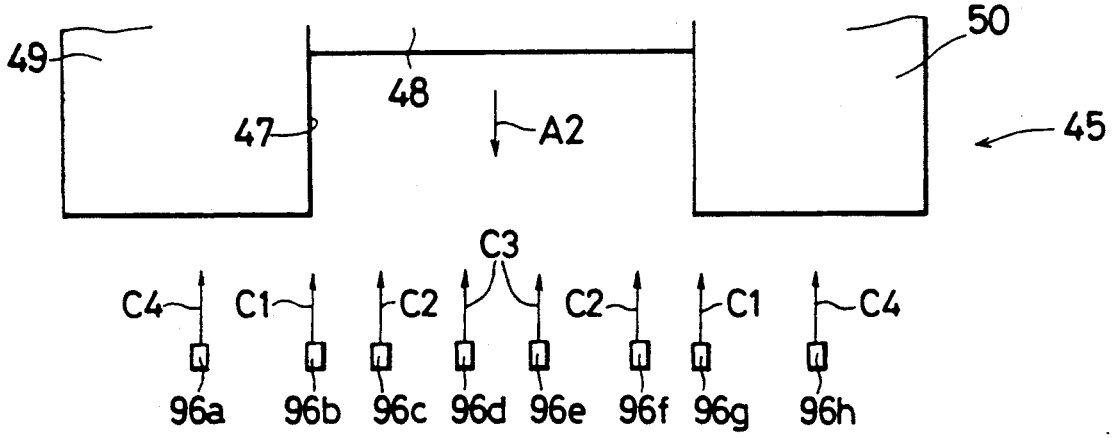

A fourth modification example is shown in FIG. 21. Its feature is that the nozzles 96*a* to 96*h* are parallel to the feeding direction A2 in a plan view. As explained by reference to FIG. 16, the upstream side end of the feeding direction A2 and the both widthwise end parts of the stacked papers P are contacting with each other. Therefore, even when injecting air to the recording papers P using the nozzles 96*a* to 96*h* all parallel to the feeding direction in a plan view, a positive static pressure can be produced among the recording papers P, so that the same effect as in the foregoing embodiments may be achieved.

Figure 22:
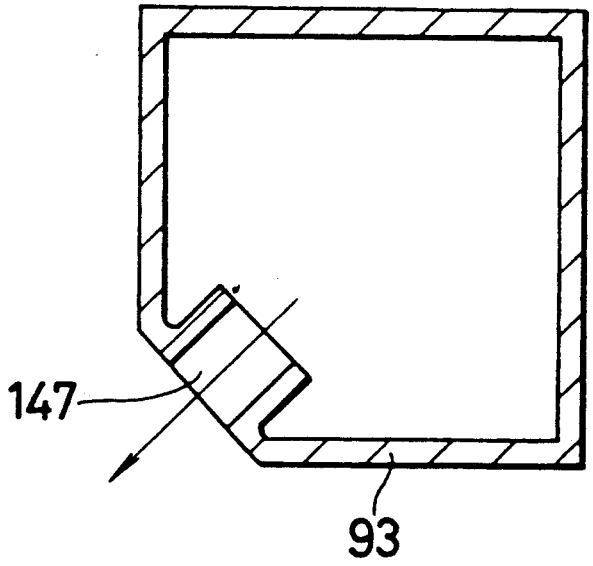
FIG. 22 is a sectional view showing other layout of nozzle member 93 and nozzle 96.

FIG. 22 is a sectional view showing a modified example of the nozzle member 93 in the foregoing embodiment. As shown in FIG. 5, the means for forming injection flow and air flow for separating the recording papers in the nozzle member 93 is not limited to the nozzles 96*a* to 96*a* as in the foregoing embodiment. For example, as shown in FIG. 22, in the nozzle member 93, plural nozzle holes 147 are formed in the longitudinal direction of the nozzle member 93, that is, along the widthwise direction, and the axial direction of the nozzle holes 147 is identified with the axial direction of the nozzles 96*a* to 96*h*. In such embodiment, too, the same air flows as in the preceding embodiments may be formed, and the same effects as before are obtained.

Figure 23:
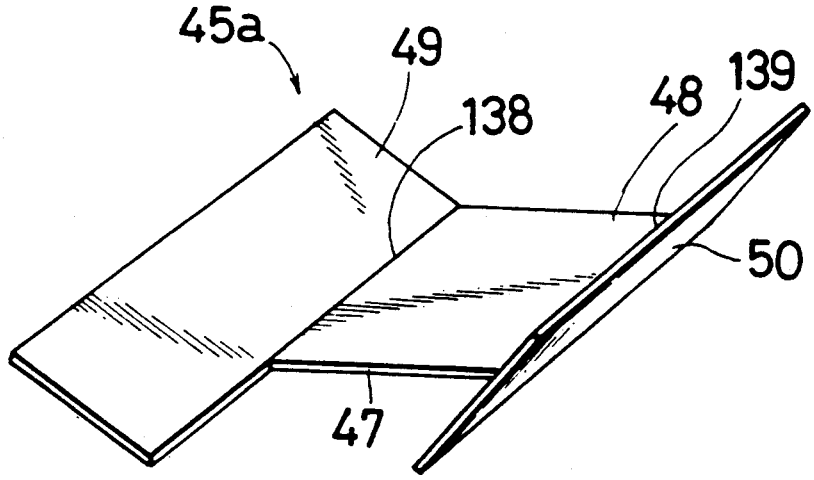
FIG. 23 through FIG. 26 are perspective views showing other layouts of laying plate 45.

The laying plate 45 in the foregoing embodiments forms stepped parts 51*a*, 51*b* at the downstream side end parts of the feeding direction A2 of the lateral laying parts 49 and 50. On the other hand, the essential constitution of the invention is to compose the regions 140*a*, 140*f* explained by reference to FIG. 17, in the bent parts 138, 139 of the laying plate 45, and therefore the structure of the laying plate 45 for realizing this action is not limited to the foregoing embodiments alone. A first modification example of the laying plate 45*a* is shown in FIG. 23, in which stepped parts 51*a*, 51*b* are not provided. Even in such constitution, the same effect as in the foregoing embodiments may be evidently achieved.

In the above embodiment, the action of stepped parts 51*a*, 51*b* has been explained, but when it is supposed that the flow rate form the nozzles 96*a*, 96*h* may be excessive as compared with that from the other nozzles 96*b* to 96*g*, the nozzles 96*a*, 96*h* may be reduced in diameter, and thus the supposed problem may be favorably avoided by modifications belonging to the scope of the properties of the invention.

Figure 24:
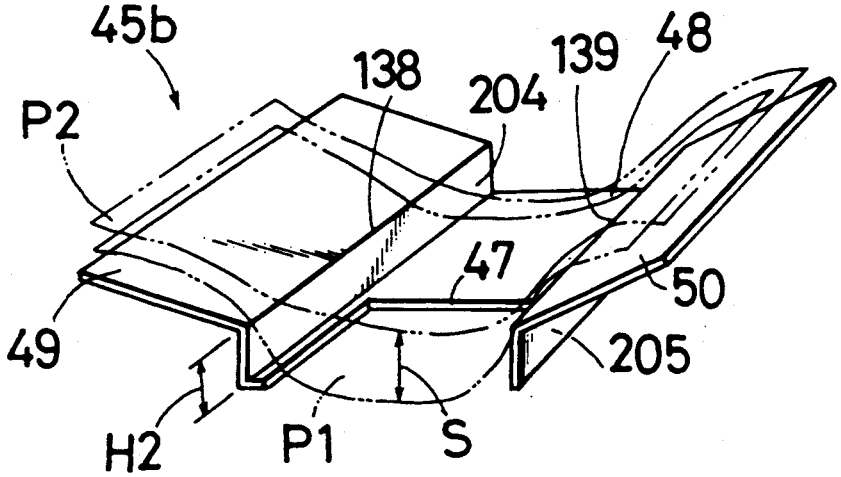

A second modification is given in FIG. 24. In this embodiment of the laying plate 45*b*, stepped parts 204, 205 with height H2 are disposed between the central laying part 48 and the lateral laying parts 49, 50, so that the central laying part 48 may be lower by the height H2 than the inward end of the widthwise direction of the lateral laying parts 49, 50. In this embodiment, the action due to the height δ of the step difference between the central laying part 48 and the upper stretching part 214 of the feeding stretch belt 98 explained in the foregoing embodiment may be further enhanced. That is, the bottom recording paper P1 of the recording papers P stacked on the laying plate 45*b* is largely curved and fits into the recess formed by the central laying part 48 and the stepped parts 204, 205, and the gap S to the second recording paper P2 may be set larger than in the foregoing embodiment. In such embodiment, not only the same effect as in the foregoing embodiment may be achieved, but also the separating capacity of the recording papers P may be further increased.

Figure 25:
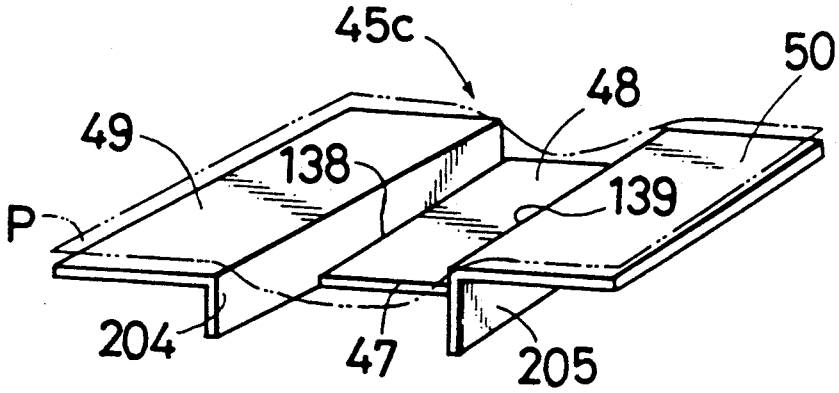

A third modification example is shown in FIG. 25. This laying plate 45*c* is similar to the laying plate 45*b* in FIG. 24, and the angle γ formed between the lateral laying parts 49, 50 and the central laying part 48 is set nearly at 0 degree. That is, the stepped parts 204, 205 and the lateral laying parts 49, 50 are set to cross nearly orthogonally with each other, and the both lateral laying parts 49, 50 are determined within a same plane. In such embodiment, too, the separating capacity as in FIG. 24 may be achieved. In this modification, too, as compared with the inclined lateral laying parts 49, 50, the recording papers P stacked up on the laying plate 45*c* are prevented from producing an inward force in the widthwise direction due to the weight of the stacked recording papers. Therefore, even if the recording papers P are extremely low in the coefficient of friction, sliding of the recording papers in the widthwise inward direction is prevented.

Figure 26:
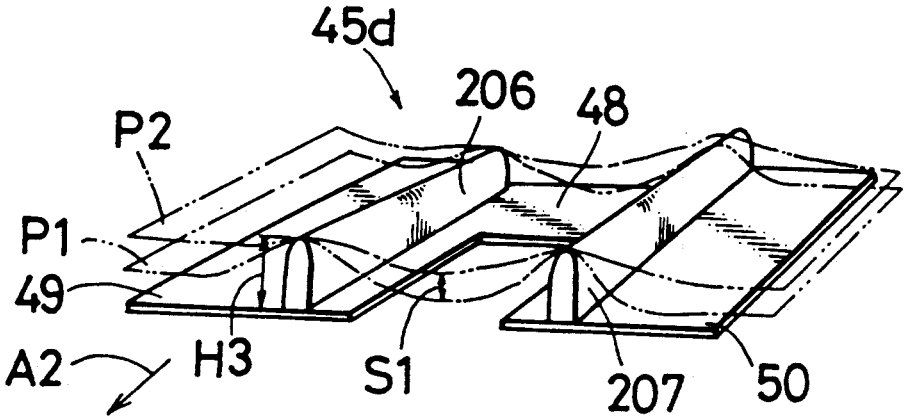

A fourth modification example is shown in FIG. 26. In this modified laying plate 45*d*, the central laying part 48 and lateral laying parts 49, 50 are formed flatly on a same plane. Besides, in the widthwise direction setting positions of the bent parts 138, 139 of the laying plates 45*a* to 45*c* in the above embodiments, protrusions 206, 207 extending parallel to the feeding direction A2 and projecting upward are formed in a height of, for example H3. This height H3 may be selected equal to the height H2 of the stepped parts 204, 205.

In such embodiment, the bottom recording paper P1 of the recording papers P stacked up on the laying plate 45*d* is curved along the shape of the laying plate 45*d*, but the second recording paper P2 is not exposed to the vacuum attracting action from the feeding stretch belt 96, so that a relatively large gap S1 may be formed between the recording papers P1 and P2. By such constitution, too, the same effect as in the preceding embodiments may be realized.

Figure 27:
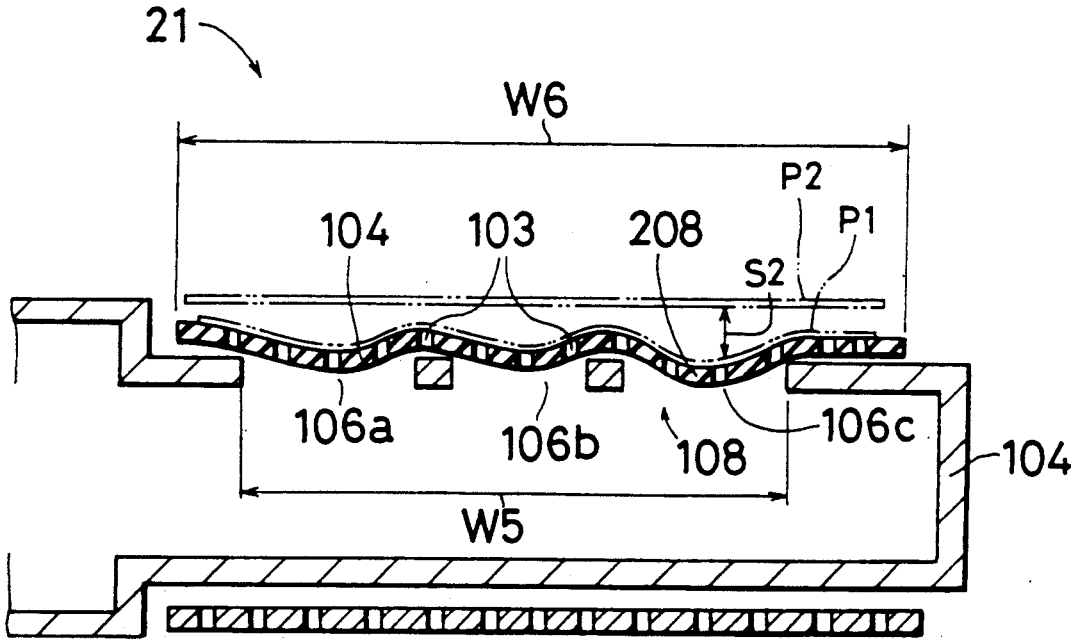
FIG. 27 is a sectional view showing other layout of the embodiment.

FIG. 27 is a sectional view showing a modified example of the feeding apparatus 21. The feature of this embodiment is that the feeding stretch belt 208 externally surrounding the vacuum attracting box 104 is composed of a single endless belt having a width W6 greater than the widthwise length W5 of the attracting region 108 in the vacuum attracting box 104. Multiple penetration holes 103 same as in the foregoing embodiments are formed in this feeding stretch belt 208, which is made of a relatively flexible material.

Therefore, the upper stretching part 214 stretched near the attracting region 108 of such feeding stretch belt 208 is curved largely as shown in FIG. 27 as being attracted by the negative pressure to the attracting ports 106*a* to 106*c*. Therefore, the bottom recording paper P1 of the stacked recording papers P is attracted in vacuum to the feeding stretch belt 208, and contacts with the feeding stretch belt 208 in the same deflection state. On the other hand, the second recording paper P2 is not exposed to such attracting action from the feeding stretch belt 208, and therefore a gap S2 is produced against the bottom recording paper P1. Thus, in this constitution, too, the same effect as in the foregoing embodiments may be obtained.

Figure 28:
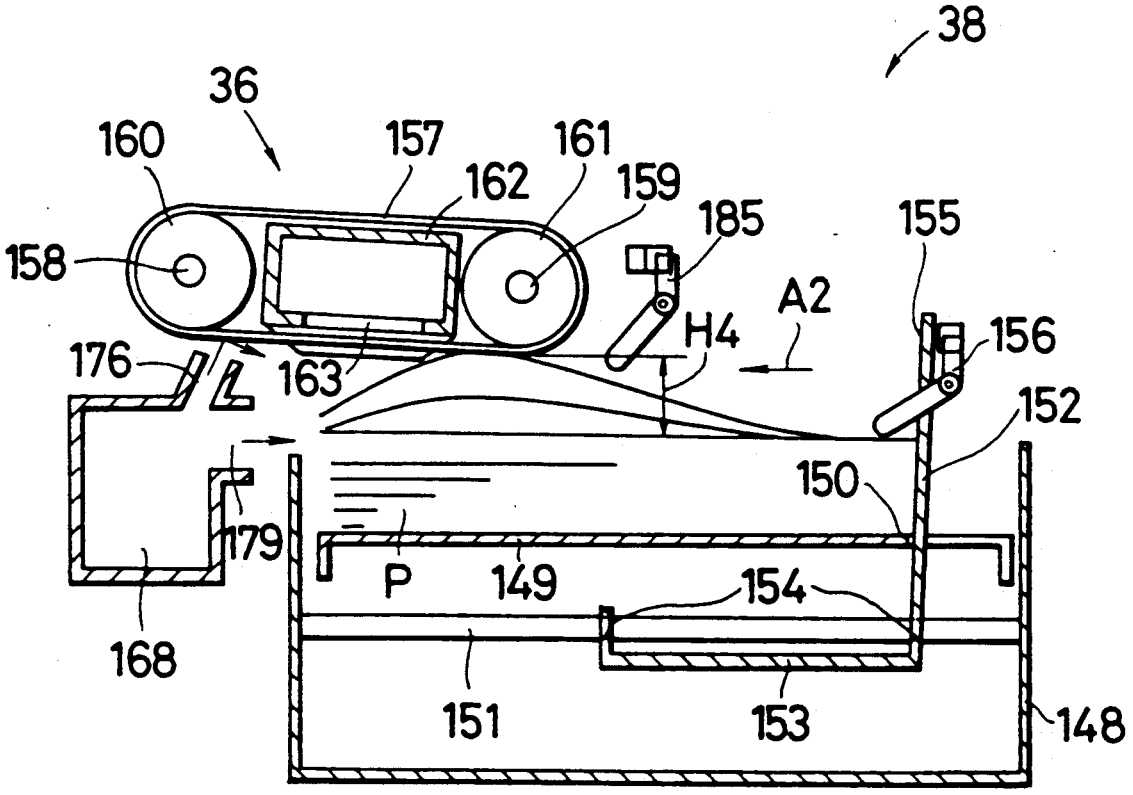
FIG. 28 is a side view showing the composition of the paper feeder 38.
Figure 29:
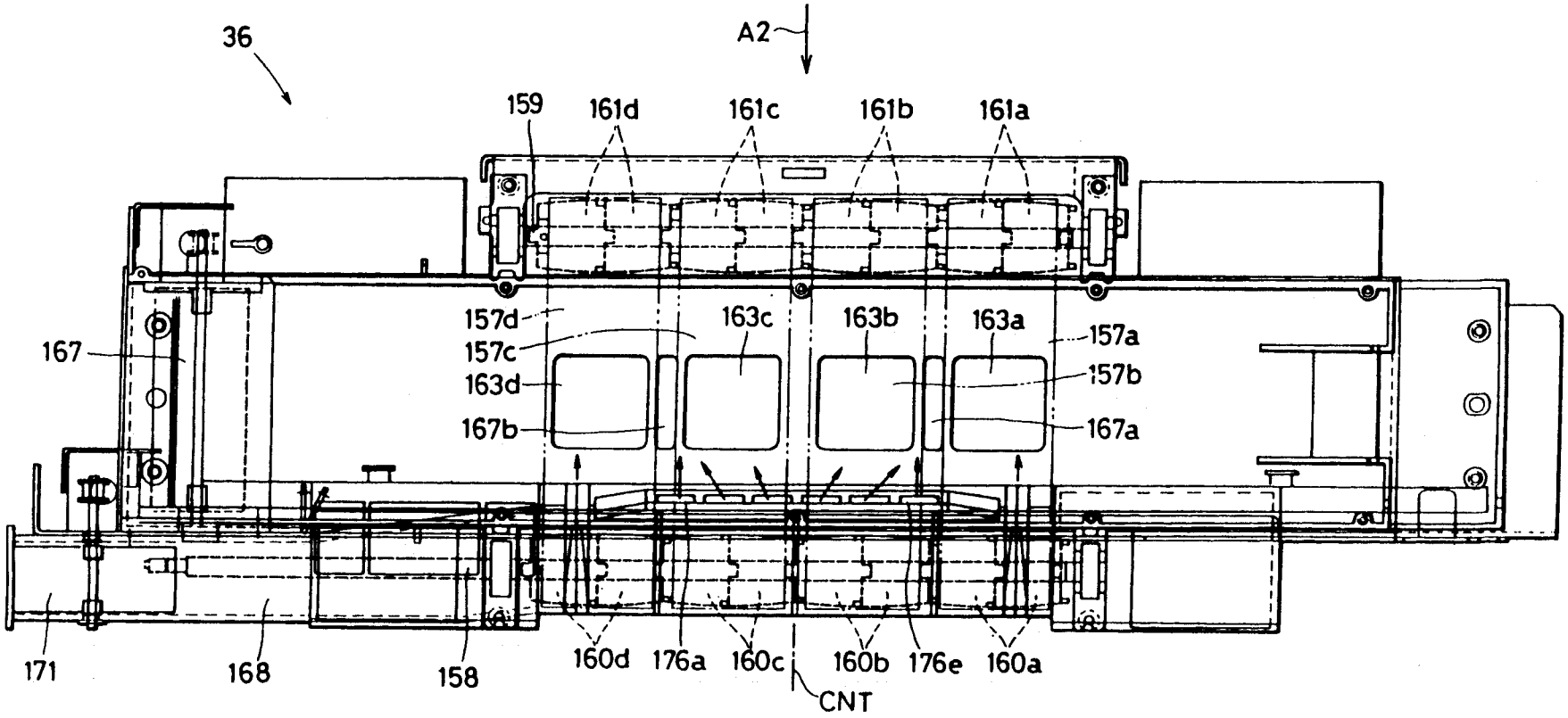
FIG. 29 is a plan view near a belt 157 stretched for feeding paper in the paper feeder 38.
Figure 30:
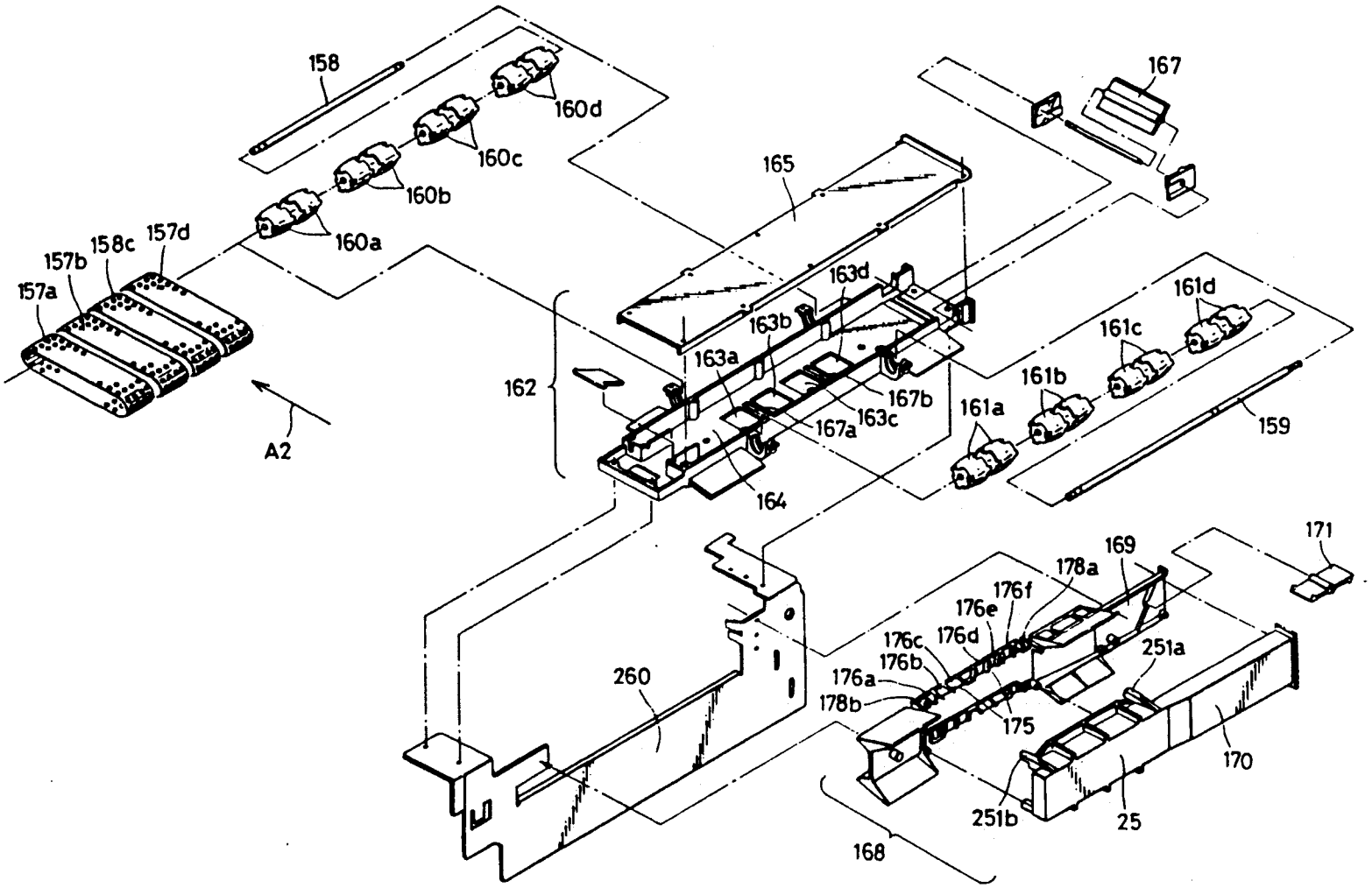
FIG. 30 is an exploded perspective view of the composition shown in FIG. 29.
Figure 31:
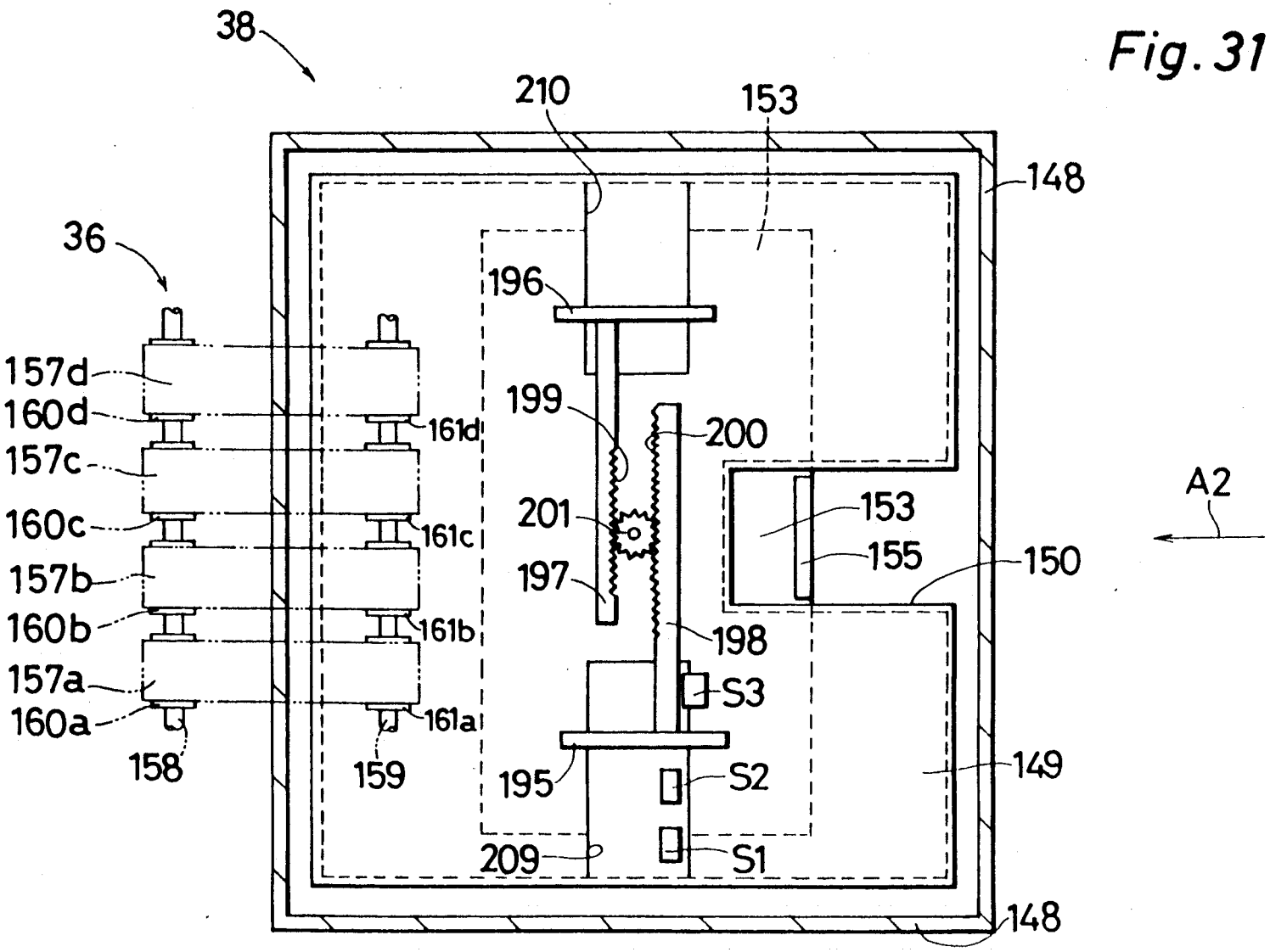
FIG. 31 is a plan view for explaining a paper width detecting mechanism 135 in the paper feeder 38.

FIG. 28 is a side view showing a section of a paper feeder 38 in a copying machine 22, FIG. 29 is a plan view of FIG. 28, FIG. 30 is an exploded perspective view of the paper feeder 38, and FIG. 31 is a simplified plan view of the paper feeder 38. Referring now to these drawings, the constitution of the paper feeder 38 is explained below. The other paper feeders 39, 40 are composed alike. Meanwhile, the constituent elements of the paper feeder in this embodiment are similar to the constituent elements in the paper feeder 21 in the foregoing embodiments, except that this embodiments relates to the top-taking structure while the paper feeder 21 is of so-called bottom-taking top-returning structure.

The paper feeder 38 comprises a frame body 148 in which recording papers are stacked and stored, and a feeding unit 220 for separating and feeding one by one the recording papers stacked and stored in the frame body 148, and the frame body 148 incorporates a laying plate 149 being driven vertically by a lifting mechanism mentioned below on which recording papers P are stacked up. The laying plate 149 has a slot 150 extending in the feeding direction A2, and a guide rail 151 extending along the feeding direction A2 is formed beneath the laying plate 149. This guide rail 151 is provided with a mounting part 153 of a rear end defining member 152, slidably in the longitudinal direction, through plural insertion holes 154 in the mounting part 153. The rear end defining member 152 is provided with a defining part 155 extending above the laying plate 149 through the slots 150 of the laying plate 149 disposed in the mounting part 153. At a predetermined position of the defining part 155, an upper limit sensor 156 such as limit switch is provided, and when an excessive recording paper P is put on the laying plate 149, it is detected.

At a position predetermined with respect to the laying plate 149 of the machine body of the copying machine 22, an upper limit switch 185 realized, for example, by a limit switch is provided, and it is detected that the top recording paper P1 of the recording papers P stacked up on the laying plate 149 has a predetermined gap of H4 to the feeding stretch belt 157. That is, when the top recording paper P1 approaches abnormally, exceeding the distance of H4 to the feeding stretch belt 157, the upper limit sensor 185 is actuated to stop elevation of the recording paper.

The paper feeder 36 is provided with, for example, four feeding stretch belts 157*a* to 157*d* at predetermined positions with respect to the frame body 148. These feeding stretch belts 157*a* to 157*d* are stretched respectively on the rollers 160*a* to 160*d*; 161*a* to 161*d* fixed on the rotary shafts 158, 159. Between the rollers 160 and 161, a vacuum attracting box 162 is stored, which comprises a main body 164 forming attracting ports 163*a* to 163*d* opposite to the feeding stretch belts 157*a* to 157*d*, and a cover body 165 covering the main body 164. A damper 166 is contained in the vacuum attracting box 162, and a vacuum source (not shown) to which the vacuum attracting box 162 and the vacuum attracting box 162 are communicated/shut off. The attracting box 162 is supported by a support member 260 fixed on the frame body 148. Between attracting ports 163*a*, 163*b* and the attracting ports 163*c*, 163*d* of the main body 164, protrusions 167*a*, 167*b* extending along the feeding direction A2 and projecting downward are formed, and they project downward from between the feeding stretch belts 157*a*, 157*b*, and feeding stretch belts 157*c*, 157*d*.

At the downstream side of the feeding direction A2 of the frame body 148 and beneath the feeding stretch belt 157, a nozzle member 168 is provided. The nozzle member 168 contains the main body 169 and cover body 170, and a damper 171 is included in an internal air passage 216, thereby communicating/shutting off the blower (not shown) and the nozzle member 168.

The laying plate 149 in the frame body 148 is provided with slots 209, 210 along the widthwise direction, and lateral end defining plates 195, 196 are inserted from top to bottom of the laying plate 149. Near the rear side end of the laying plate 149 of the lateral end defining plates 195, 196, one longitudinal end of the driving members 197, 198 extending along the widthwise direction is fixed. At the mutually confronting end parts along the feeding direction A2 of the driving members 197, 198, racks 199, 200 are formed, and these racks 199, 200 are engaged mutually from the opposite sides with a pinion 201 rotatably disposed on a support plate 149 disposed between the driving members 197, 198.

Regarding the lateral end defining plate 195, a widthwise displacement position is detected, for example, by three positions sensors S1, S2, S3 which are disposed from outward to inward in the widthwise direction. The lateral end defining plates 195, 196 cooperate with each other by means of the racks 199, 200 and pinion 201, and by aligning the distance of the lateral end defining plates 195 in the widthwise length of the stored recording papers P, the widthwise length of the stored recording papers can be detected on the basis of the output from the position sensors S1 to S3.

Figure 32:
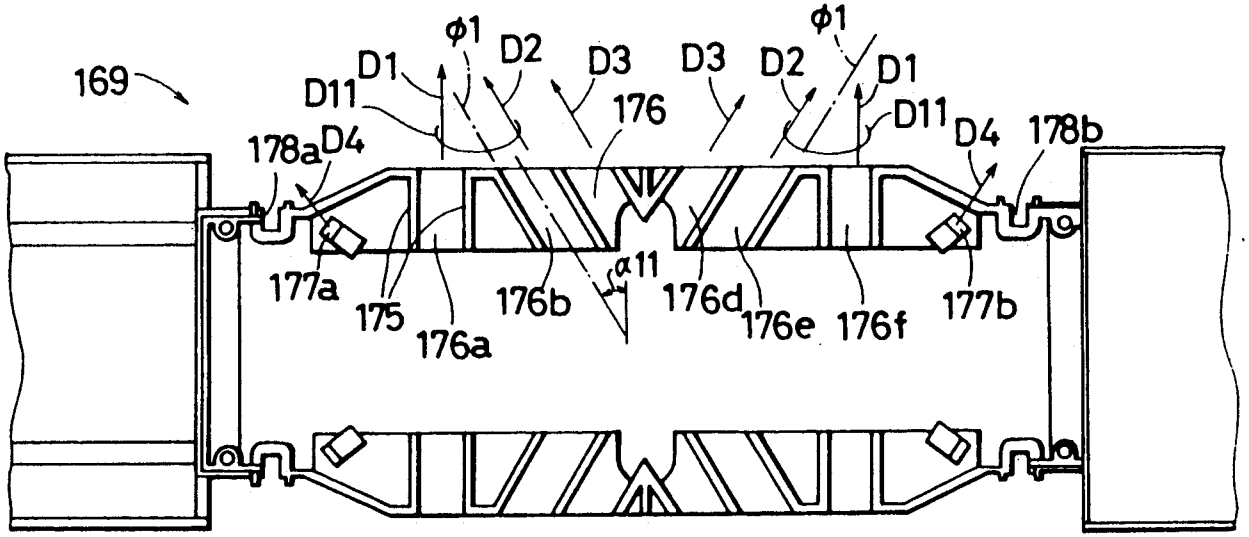
FIG. 32 is a front view of a main body 169 of a draft duct 168.
Figure 33:
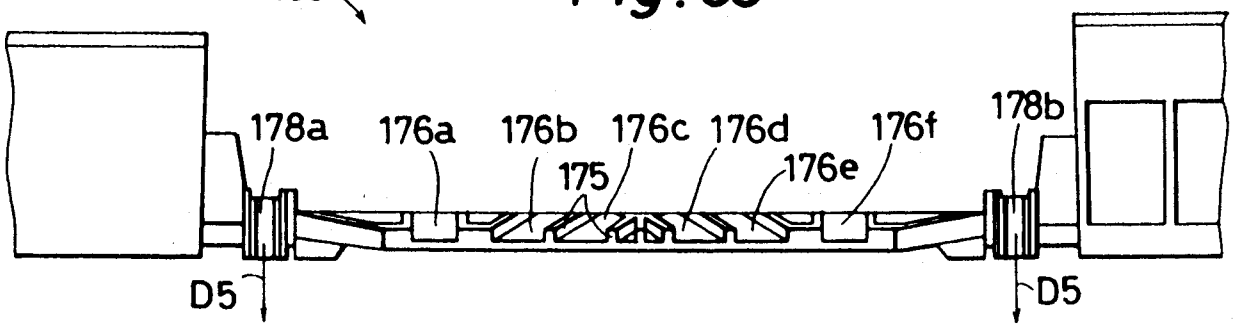
FIG. 33 is a plan view of the main body 169.
Figure 34:
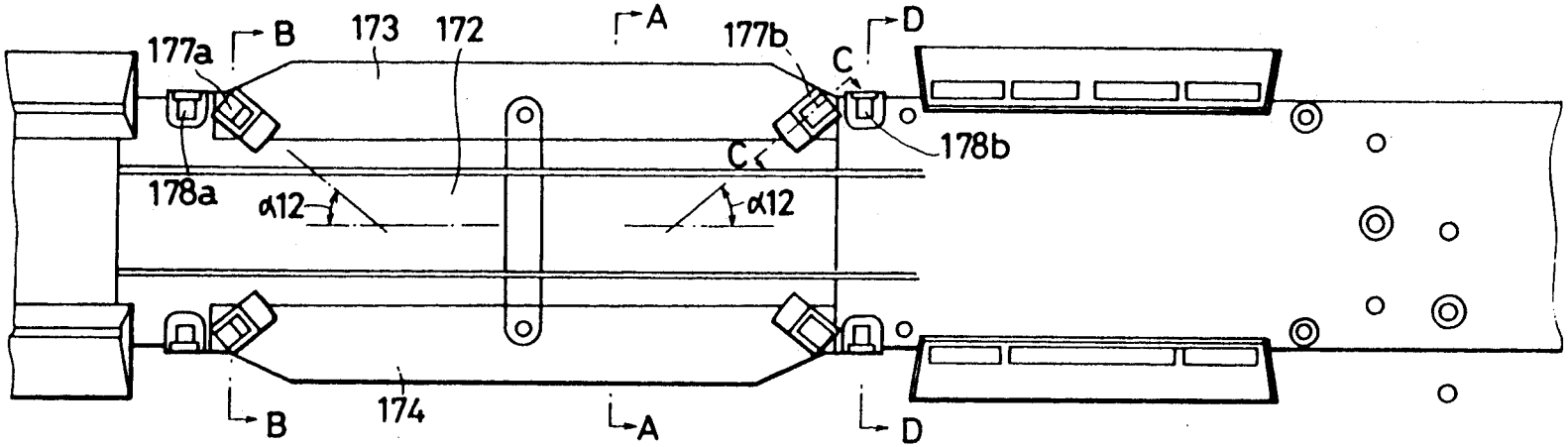
FIG. 34 is a rear view of the main body 169.

FIG. 32 is a front view of the main body 169, FIG. 33 is a plan view of the main body 169, FIG. 34 is a back view of the main body 169, and FIGS. 35 to 38 are sectional views seen from the sectional lines A—A, B—B, C—C, D—D in FIG. 34. Referring together to these drawings, the composition of the nozzle member 168 is described in detail below. The main body 169 comprises a flat plate 172 extending in the widthwise direction, and slopes 173, 174 consecutive to the vertical direction thereof and inclined by an angle $\theta 3$ (e.g. 20 degrees) to the main body 148 side. At the downstream side of the feeding direction A2 of the slopes 173, 174, plural guide pieces 175 are formed, and when the cover body 170 is put on the main body 169, nozzle holes 176*a* to 176*f* forming the same jet flows D1 to D3 as the jet flows C1 to C3 by the nozzle 96 in the foregoing embodiment are formed by the adjacent guide pieces 175, and the nozzle is composed of the nozzle holes 176*a* to 176*f* and the adjacent guide pieces 175.

The nozzle holes 176*a*, 176*f* forms a jet flow of arrow D1 toward the feeding stretch belt 157, in the vertical plane parallel to the feeding direction A2. The nozzle holes 176*b*, 176*f* have an angle of $\alpha 11$ (e.g. 30 degrees) to the feeding direction A2 in a plan view, and form a jet flow expressed by arrow D2 directed to the feeding stretch belt 157. The nozzle holes 176*c*, 176*d* form a jet flow and an air flow parallel to the arrow D2 and indicated by arrow D3. The jet flows D1, D2 are converged and synthesized on the central line 11 to form an air flow D11. In the lower stretched part 215 of the feeding stretch belt 157, the flow is injected to the position remote to the downstream side by the predetermined distance L5 from the downstream side end part of the feeding direction of the recording paper attracted so as to cover the attracting region 108 defined by the attracting vacuum box 162 and the range exceeding to the downstream side of the feeding direction A2. The reflected air flow from the feeding stretch belt 157 is blown and injected between the top recording paper P1 and the second recording paper P2. The injected air flow is inflated in the vertical direction, thereby separating the recording papers P1, P2.

Figure 37:
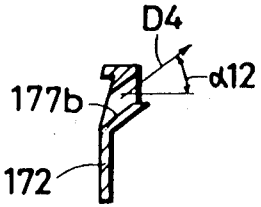
Figure 36:
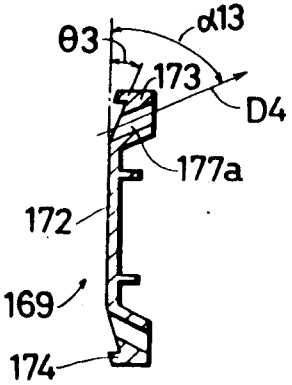

Further outward of the nozzle holes 176*a*, 176*f* of the main body 169, there are formed nozzle holes 177*a*, 177*b* having the sectional shapes as shown in FIGS. 36 and 37. The nozzle holes 177*a*, 177*b* are composed at an inclination outward in the widthwise direction as going upstream in the feeding direction at an angle of $\alpha 12$ (e.g. 40 degrees) with respect to the widthwise direction as shown in FIG. 34 outward in the widthwise direction, and are composed at an inclination to the upstream side of the feeding direction A2 as going from downward topward by an angle of $\alpha 13$ (e.g. 65.7 degrees) from the vertical direction as shown in FIG. 36.

Figure 38:
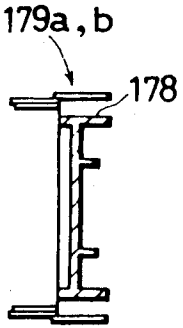
FIG. 35 through FIG. 38 are sectional views seen from sectional lines A—A, B—B, C—C, D—D in FIG. 34.

That is, to the upstream side of the feeding direction A2 than the jet flow of the nozzle holes 176*a* to 176*f*, the jet flow and air flow are injected as indicated by arrow D4. Further outward in the widthwise direction from the nozzle holes 177*a*, 177*b* of the main body 169, grooves 178*a*, 178*b* parallel to the feeding direction A2 are formed as the sectional shape is shown in FIG. 38. The grooves 178*a*, 178*b* are covered with the cover body 170 as shown in FIG. 38, and form a jet flow and an air flow parallel to the feeding direction A2 (indicated by arrow D5).

Figure 35:
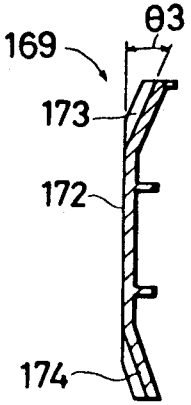

The cover body 170 shown in FIG. 35 is put on thus composed main body 169. At both sides of the cover body 170 in the widthwise direction, fitting projections 251*a* and 251*b* having a pair of upper and lower nozzle holes 252*a* and 252*b* are formed. These projections 251*a* and 251*b* are projected in the feeding direction A2, and the nozzle holes 252*a* and 252*b* are composed by the holes 250*a*, 178*a*; 250*b* and 178*b* in the state of being fitted to the grooves 178*a* and 178*b* of the main body. 169. From these nozzle holes 252*a* and 252*b*, a jet flow may be formed in the direction of arrow D5 as shown in FIG. 38. A pair of upper and lower ribs 254 and 255 are integrally formed on the end plate 253 of such cover body 170, and by these ribs 254 and 255, the nozzle holes 176*a* to 176*e* are defined in the state of communicating in the direction of jet flows D1 to D3.

Figure 40:
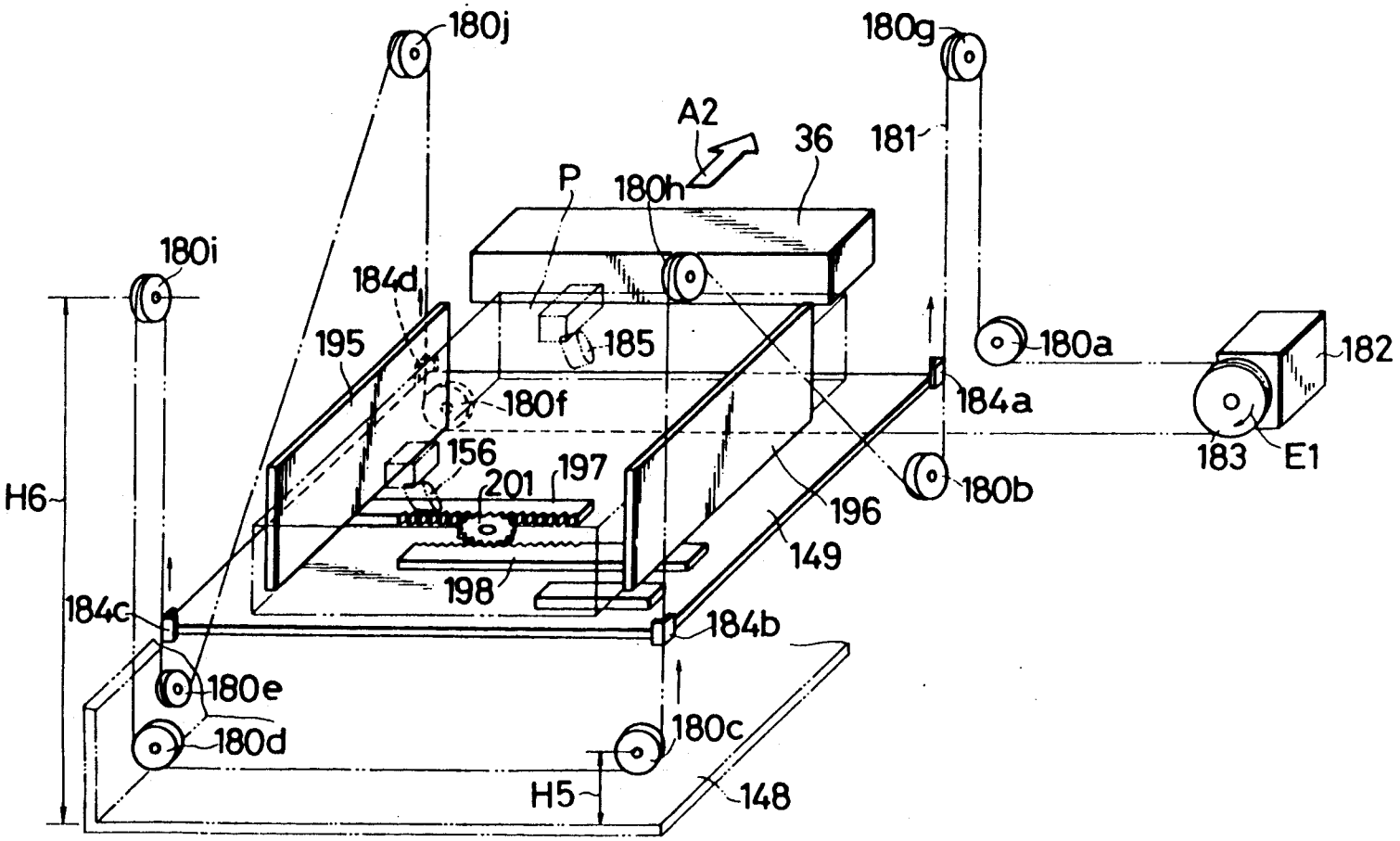
FIG. 40 is a block diagram for explaining a lifting mechanism of the laying plate 149 in the paper feeder 38.

FIG. 40 is a perspective view showing the composition of elevating the laying plate 149 in the paper feeder 38. In the frame body 148, plural pulleys 180*a* to 180*f* are disposed as shown in the drawing at a predetermined height H5 from the bottom of the frame body 148, and pulleys 180*g* to 180*j* are disposed at a position of a predetermined height H6 from the bottom. A wire 181 is applied on these pulleys 180*a* to 180*j*, and the both ends of the wire 181 are wound around a driving roller 183 rotated by a pulse motor 182. In the portions stretching vertically at four corners of the frame body 148 of this wire 181, support pieces 184*a* to 184*d* from mounting the four corners of the laying plate 149 are fixed.

That is, when the driving roller 183 is rotated in the direction of arrow E1 by the pulse motor 182, the laying plate 149 is elevated, while the laying plate 149 is lowered. Thus, as shown in FIG. 28, the highest recording paper P1 in the vertical direction of the recording papers P put on the laying plate 149 is maintained at a position remote by a predetermined distance of H4 from the feeding stretch belts 157*a* to 157*d*. Consequently, a favorable vacuum attracting action of the top recording paper P by the feeding stretch belts 157*a* to 157*d* may be realized.

Figure 41:
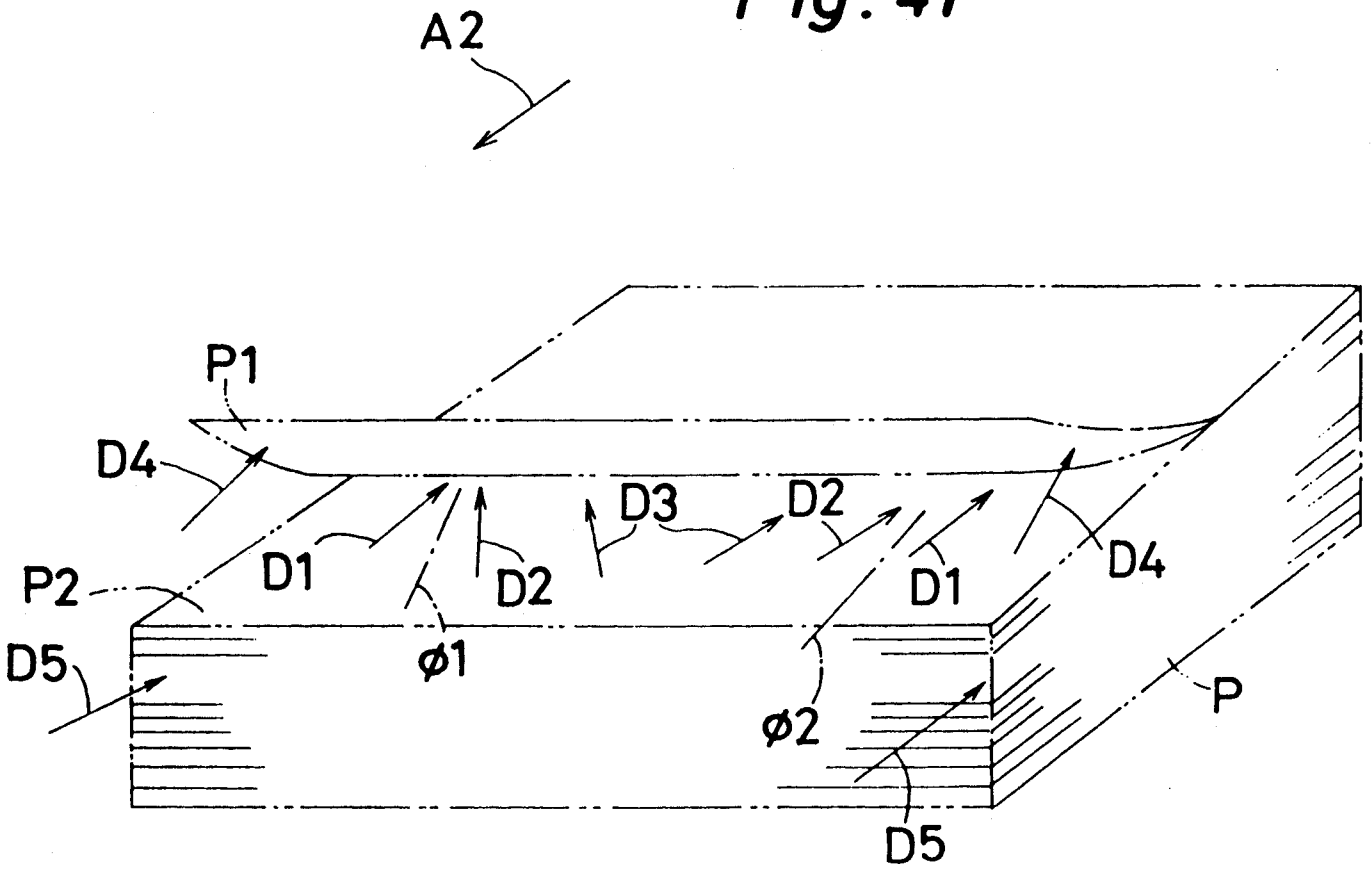
FIG. 41 is a perspective view for explaining the action of air streams in the embodiment.

FIG. 41 is a perspective view for explaining the basic function of each air flow indicated by arrows D1 to D5 and D11 from the nozzle holes 176*a* to 176*f*; 177*a*, 177*b*; 178*a* and 178*b*. The jet flows of arrows D1 and D2 are concentrated as an air flow D11 in the widthwise direction of the recording paper P, and it is blown in and injected in the gap formed as shown below between the top recording paper P1 and the second recording paper P2, and is inflated in the vertical direction to separate the recording papers P1 and P2. The air flow indicated by arrow D3 also separates the recording papers P1 and P2 as mentioned below.

The air flow D5 from the nozzle holes 178*a* and 178*b* is an air stream injected parallel to the feeding direction A2 in the relatively upward portion of the stacked recording papers P, and it maintains a plurality of recording papers P near the upper part always in a lifted state. On the other hand, the air flow indicated by arrow D4 from the nozzle holes 177*a* and 177*b* pushes up the uppermost recording paper P1 of the plurality of recording papers P lifted by the air flow of arrow D5 to the feeding stretch belt 157 side, and the recording paper P1 is attracted in vacuum to the feeding stretch belt 157 by the negative pressure by the vacuum attracting box 162. At this time, in order that the plural recording papers P may not be attracted at the same time, the recording papers P are separated by the air flows indicated by arrows D11 and D3.

Figure 42:
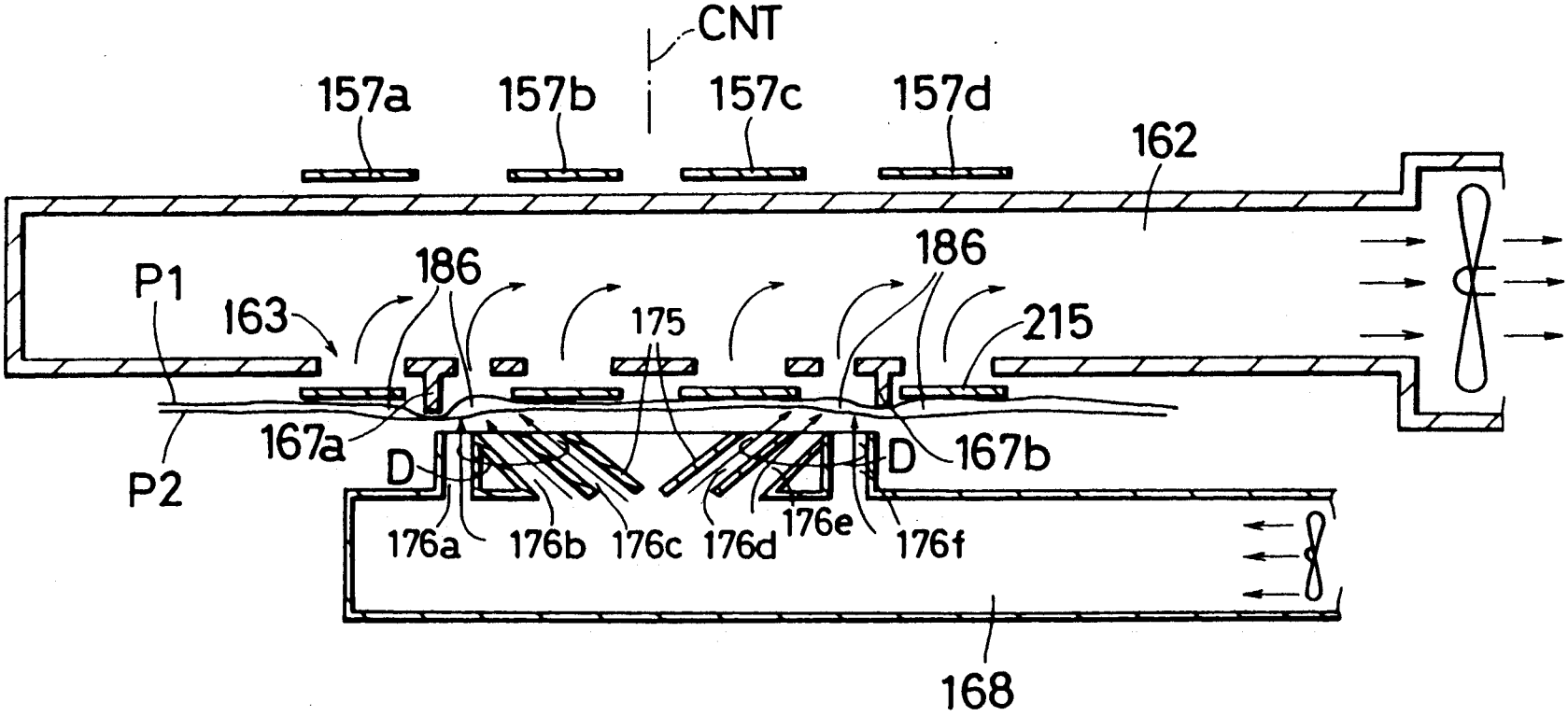
FIG. 42 is a sectional view for explaining the action of the embodiment.

FIG. 42 is a sectional view explaining the separating action of the recording papers P in the paper feeder 38. For the sake of simplicity of explanation, the structure is shown in a simplified form in FIG. 42. Hereinafter, the nozzle holes 176*a* to 176*f* and the guide pieces 175 for defining them are collectively called a handling nozzle and indicated by same reference number. Besides, the nozzle holes 177*a*, 177*b*; 179*a* and 179*b* and guide pieces 175 for defining them are called pushing nozzle and lifting nozzle, respectively, and indicated by same reference numbers. As shown in FIG. 28 and FIG. 41, when the air flow indicated by arrow D5 is injected from the lifting nozzle 179 of the nozzle member 168 to the recording papers P stacked up on the laying plate 149, the relatively upper recording papers of the stacked recording papers P are lifted within the frame body 148.

At this time, when a negative pressure is generated in the vacuum attracting box 162, the floating recording papers P are attracted vacuum to the lower stretching part 215 of the feeding stretch belt 157. The top recording paper P1 at this time is attracted in vacuum to the lower stretching part 215 of the feeding stretch belt 157 while being lifted by the protrusions 167*a*, 167*b* projecting downward from within the feeding stretch belt 157, being formed in the vacuum attracting box 162. The second recording paper P2 is prevented from being attracted to the feeding stretch belt 157 because almost entire portion of the lower stretched part 215 of the feeding stretch belt 157 is covered by the recording paper P1. If attracted, it is only relatively weakly attracted. Accordingly, as shown in FIG. 42, a gap 186 is produced between the recording papers P1 and P2, near the protrusions 167*a* and 167*b*.

The air flow D from the handling nozzles 176*a* to 176*f* collides against the portion not opposing the attracting port 163, once at the feeding stretch belt 157, as mentioned above, and its reflected flow is injected between the recording papers P1 and P2. Therefore, the air flow injected downward in the gap 186 is inflated in the vertical direction, and the recording papers P1 and P2 are separated by this positive pressure. The air flow in the direction of arrow D3 from the handling nozzles 176*c* and 176*d* is attracted into the gap 186, and realizes the same separating action. The pushing nozzles 177*a* and 177*b* are to lift one or plural recording papers P of the uppermost area of the floating recording papers P to the feeding stretch belt 157 side.

In this embodiment, too, air flows C11 and C3 inflating in the vertical direction are formed at symmetrical positions about the widthwise central position CNT of the recording paper, and a satisfactory separating action is realized whether the recording papers P being used are relatively large or small in size. What is more, the air flow from the nozzle member 168 is concentrated in the widthwise plural positions to the recording papers P, and if the recording papers are relatively small in size or weight, scattering of the recording papers P by the air flow from the handling nozzles 176*a* to 176*f* without being attracted to the feeding stretch belt 157 may be avoided. Besides, although the air flow from the handling nozzle 176*e* is directed from inward to the outward side in the widthwise direction, this air flow is blocked by the air flow from the handling nozzles 176*a* and 176*f*, and leakage from both ends of the widthwise direction of the recording papers P may be prevented. Hence, it is possible to avoid flapping of the both ends in the widthwise direction of the recording papers P, disturbance of stacked state, or generation of noise.

Figure 43:
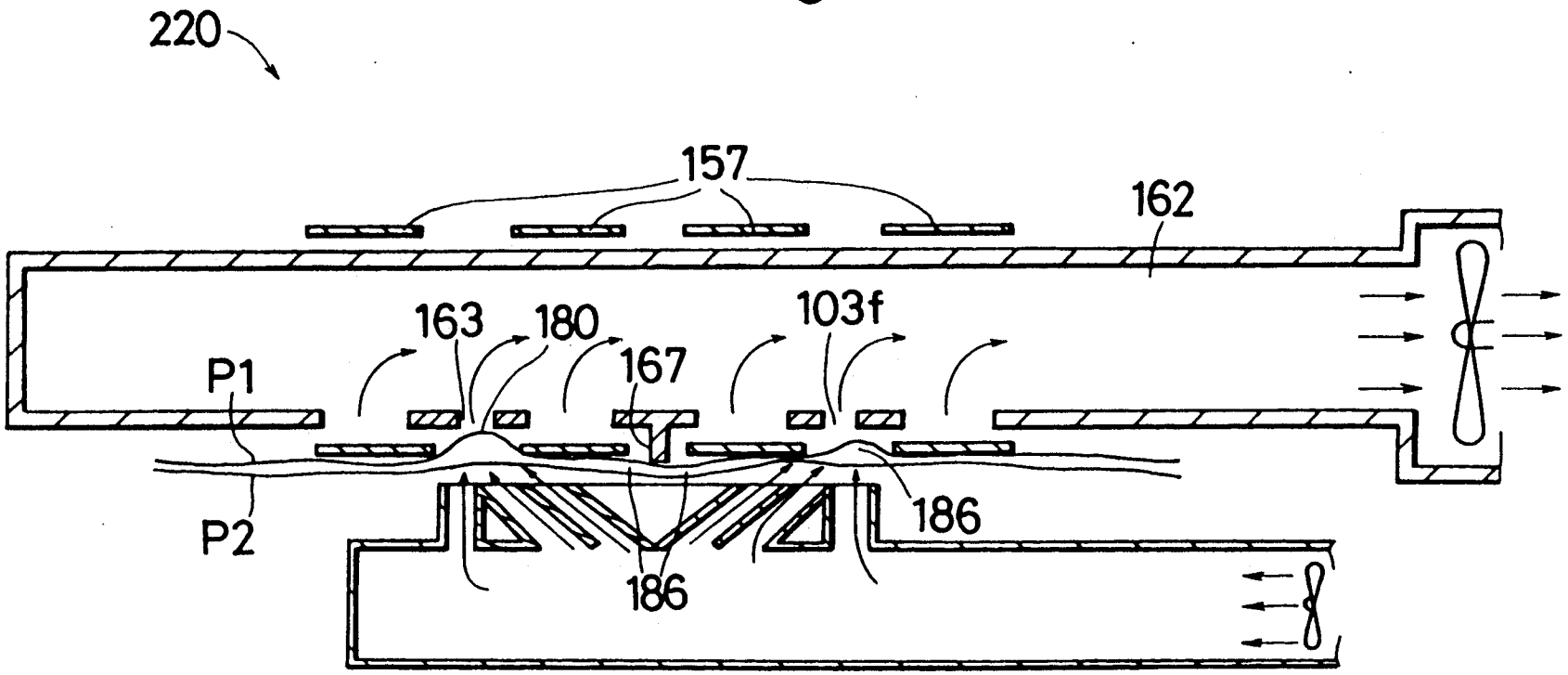
FIG. 43 is a sectional view for explaining other constitution of the embodiment.

FIG. 43 is a sectional view showing other constitutional example of the feeding unit 220 of the paper feeder 38. This embodiment is similar to the foregoing embodiments, and corresponding parts are identified with same reference numbers. What is of note in this embodiment is that the protrusion 167 formed in the vacuum attracting box 162 is determined so as to be positioned in the widthwise central position CNT between the feeding stretch belts 157*b* and 157*c*, and that attracting ports 163*e* and 163*f* are disposed in the vacuum attracting box 162 between the feeding stretch belts 157*a* and 157*b*, and between the feeding stretch belts 157*c* and 157*d*.

Figure 39:
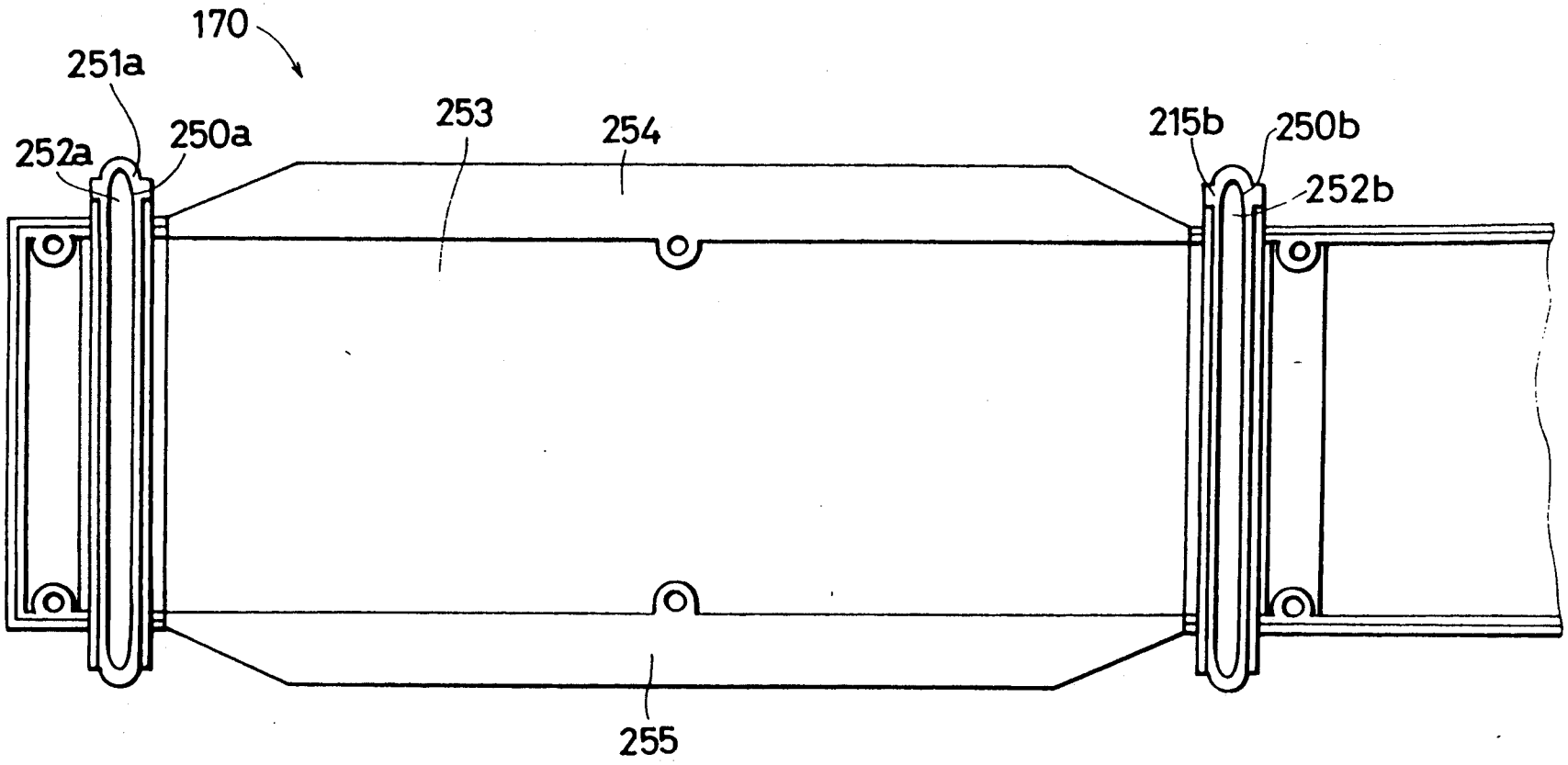
FIG. 39 is a front view of a cover main body 170.

Employing such constitution, as explained by reference to FIGS. 28 and 41, the recording paper P on the laying plate 149 is lifted by the lifting nozzles 179*a* and 179*b*, and the lifted recording paper P is pushed up by the pushing nozzles 177*a* and 177*b* to the feeding stretch belt 157 side. When the vacuum attracting box 162 generates a negative pressure, the top recording paper P1 is attracted to the feeding stretch belt 157, but the range opposing the attracting ports 163*e* and 163*f* is the gap of the feeding stretch belt 157, and therefore the recording paper p1 is attracted and dented to the vacuum attracting box 162 side as shown in FIG. 39. It is the same with the recording paper P1 opposing the attracting port 163*f*. Furthermore, the recording paper P1 is lifted in the direction of going away from the vacuum attracting box 162 by the protrusion 167 formed in the central position CNT.

Therefore, between the recording papers P1 and P2, a gap 186 is formed at the position corresponding to the attracting ports 163*e*, 163*f* and protrusion 167. Therefore, the air flows C11, C3 due to handling nozzles 176*a* to 176*f* are injected into the gap 186, and inflated in the vertical direction as mentioned above to separate the recording papers P1 and P2. In such embodiment, too, the same effect as mentioned in the foregoing embodiments is achieved.

Figure 44:
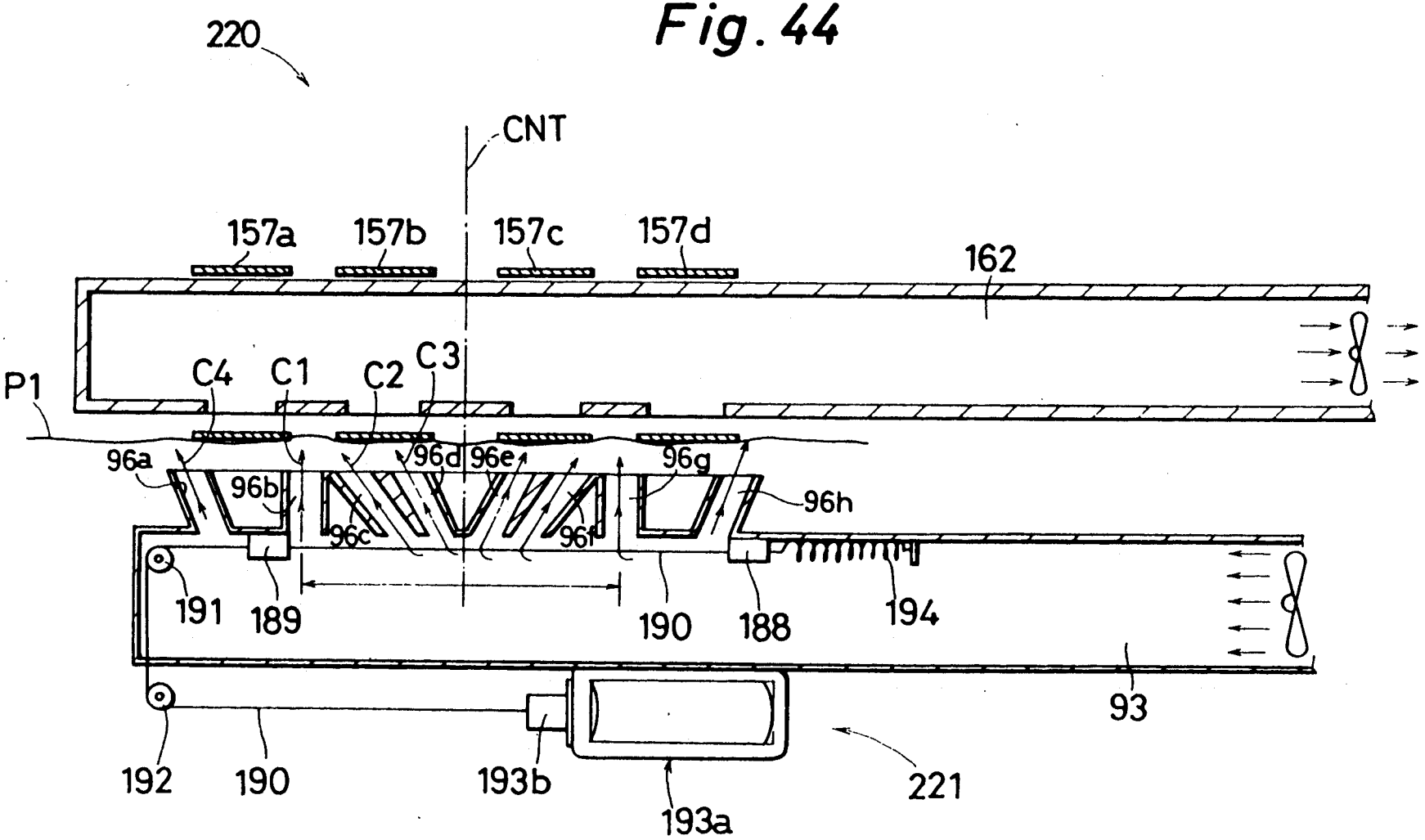
FIG. 44 is a sectional view for explaining the constitution of the embodiment.

FIG. 44 is a sectional view showing other constitutional example of the nozzle member 93 in the feeding unit 21. This embodiment is similar to the foregoing embodiments, and corresponding parts are identified with the same reference numbers. The nozzle member 93 comprise nozzles 96*a* to 96*h* in the configuration as mentioned above, and injection flows C1, C2, C3 and C4 as mentioned in the preceding embodiments are formed. In the nozzle member 93, the valve body 188 is disposed outward in the widthwise direction of the nozzle 96*h*, and the valve body 189 is disposed inward in the widthwise direction of the nozzle 96*a*. These valve bodies 188 and 189 are disposed so as to be reciprocally displaceable only in the widthwise direction, and are mutually coupled with a wire 190. This wire 190 connects the valve body 189 to the plunger 193*b* of the electromagnetic solenoid 193*a* disposed outside the nozzle member 93 through the pulleys 191 and 192. The valve body 188 has a spring 194, and it is thrust in the opposite direction of the valve body 189. The wire 190, pulleys 191 and 192, electromagnetic solenoid 193*a* and plunger 193*b* are combined to compose the opening and closing driving means 221.

More specifically, the valve bodies 188 and 189 are determined at the positions shown in FIG. 44 by the spring force of the spring 194 as far as the electromagnetic solenoid 193*a* is not actuated, and the nozzles 96*a* and 96*h* are fully open. On the other hand, when the electromagnetic solenoid 193*a* is actuated to contract the plunger 193*b*, the valve bodies 188 and 189 are pulled in the arrow E3 direction by the wire 190, and are moved to the base part of the nozzles 96*a* and 96*h*, thereby shielding these nozzles 96*a* and 96*h*. At this time, the jet flow obtained from the nozzles member 93 is only the flows indicated by arrows C1 to C3.

Figure 45:
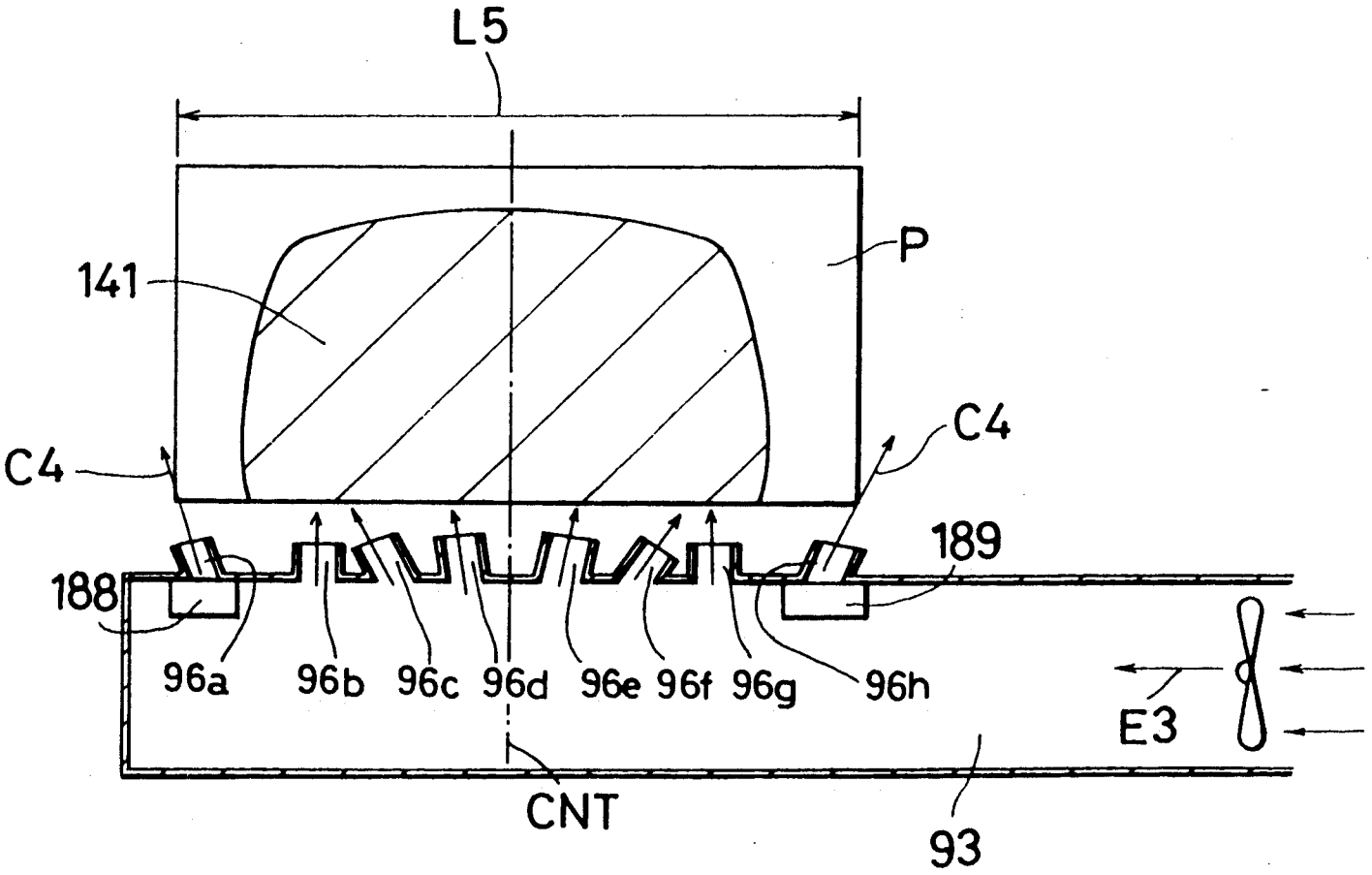
FIG. 45 and FIG. 46 are plan views for explaining the action of the embodiment.
Figure 46:
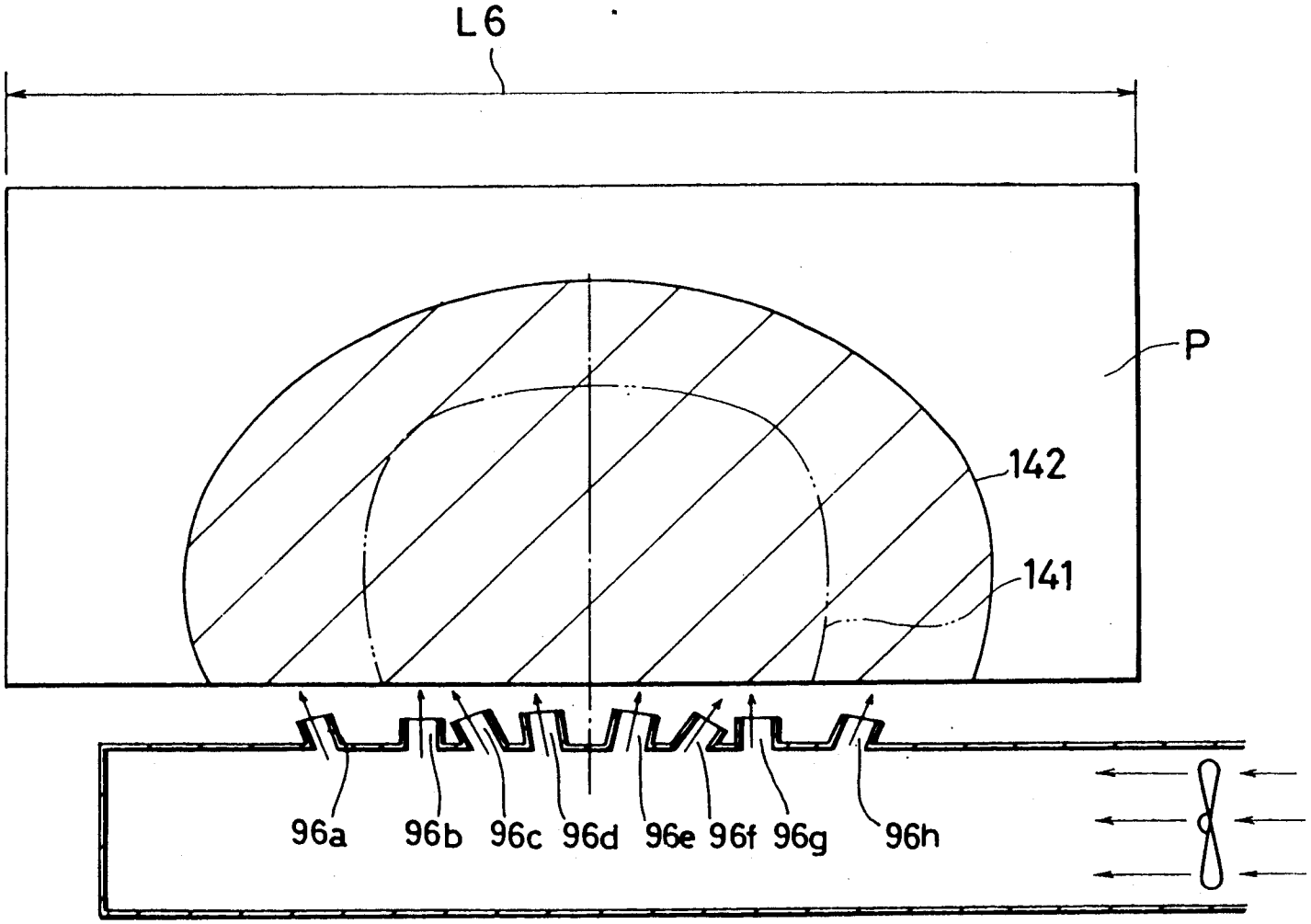

FIG. 45 and FIG. 46 are plane views for explaining the action of the embodiment. The type of the recording paper carried into feeding unit 21 is determined by selecting any one of the paper feeders 38 to 40 in the foregoing embodiment. That is, for example, in the selected paper feeder 38, the paper width detection mechanism 222 as explained by reference to FIG. 31 is disposed, and the CPU 132 shown in FIG. 11 can detect the width of the set recording paper, by the dislocating position of the lateral end defining members 195 and 196 set manually, for example.

When the size of the selected recording paper is relatively small, for instance, width L5 shown in FIG. 45, if the air flow C4 from the nozzles 96*a* and 96*h* is formed, this air flow C4 leaks from both ends of the widthwise direction of the recording paper P outward in the widthwise direction, and both widthwise ends of the recording paper P come to flap. In this case, the stacked state of the recording papers P in the paper feeder 21 is disturbed, and duplicate feed, defective feed or noise may be caused.

In this embodiment, in order to avoid such trouble, when the paper P is relatively small in size, the electromagnetic solenoid 193*a* is actuated by controlling the CPU 132, and the valve bodies 188 and 189 are moved in the direction of arrow E3 to the base part of the nozzles 96*a* and 96*h* so as not to form air flow C4. As a result, concerning the stacked recording papers P, the separating region 141 as indicated by the shaded area in FIG. 45 is realized, and a favorable separating action is realized for the recording papers P of small size.

On the other hand, when the selected recording paper P is relatively large in size, for example, width L6 as shown in FIG. 46, if the air flow C4 is not formed, only the separating region 141 by the nozzles 96*b* to 96*g* indicated by shaded area in FIG. 46 is formed, and separation may be defective in the case of large-sized recording paper P, and duplicate feed or other trouble may occur. Therefore, in this embodiment, when the selected recording paper P is relatively large in size, the electromagnetic solenoid 193*a* is de-excited by the control of the CPU 132, and the valve bodies 188 and 189 move and return in the direction of arrow E4 to the position shown in FIG. 44. In consequence, the nozzles 96*a* and 96*h* are fully open, and the air flow C4 is formed. As a result, the separating region 142 far wider than the separating region 141 is formed, and a favorable separating action is realized in large-sized recording papers P.

Figure 47:
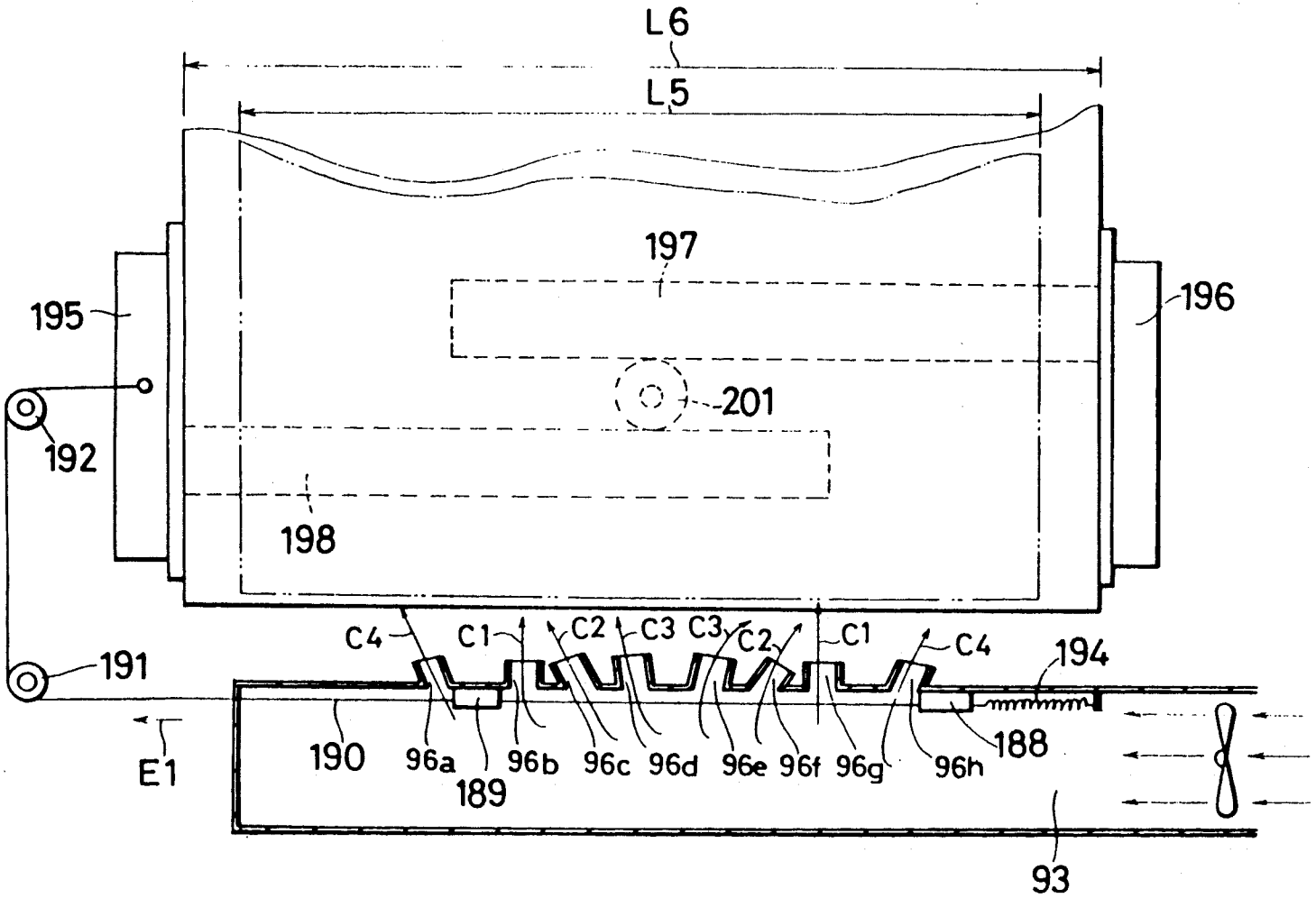
FIG. 47 is a plan view showing other constitution of the embodiment.

FIG. 47 is sectional view showing another constituent example of the nozzle member 93 in the feeding unit 21. This embodiment is similar to the foregoing embodiments, and the corresponding parts are identified with the same reference numbers. In this embodiment, too, the valve bodies 188 and 189 are arranged in the nozzle member 93 in the same configuration as in the preceding embodiment, and the wire 190 mutually connects the valve bodies 188 and 189, and is connected to either one of the lateral end defining members 195 or 196 through the pulleys 191 and 192. In this embodiment, it is connected to the lateral end defining member 195.

The lateral end defining members 195 and 196 are respectively fixed to the driving members 197 and 198 forming racks 199 and 200 at the mutually confronting sides as explained by reference to FIG. 31, and the racks 199 and 200 are engaged with the pinion 201 disposed between them mutually from the opposite sides. Therefore, the lateral end defining members 195 and 196 are interlocked with each other by the driving members 197 and 198, and pinion 201, and when the one side is moved outward in the widthwise direction manually, for example, the other side also moves outward in cooperation. That is, in this embodiment, as far as the lateral end defining members 195 and 196 are spaced at a distance L6 corresponding to the large-sized recording papers P, the valve bodies 188 and 189 are in the position not to shield the nozzles 96*a* and 96*g*, and a favorable separating action is effected on the recording paper P of large size as explained by reference to FIG. 43.

Incidentally, using a relatively small recording paper P, when the lateral end defining members 195 and 196 mutually approach to have a spacing of width L5, the wire 190 is pulled in the direction of arrow E3, resisting the spring force of the spring 194, and the valve bodies 188 and 189 shield the nozzles 96*a* and 96*h*. Hence, even in the case of relatively small recording paper P, a favorable separating action is realized as explained by reference to FIG. 42.

Figure 48:
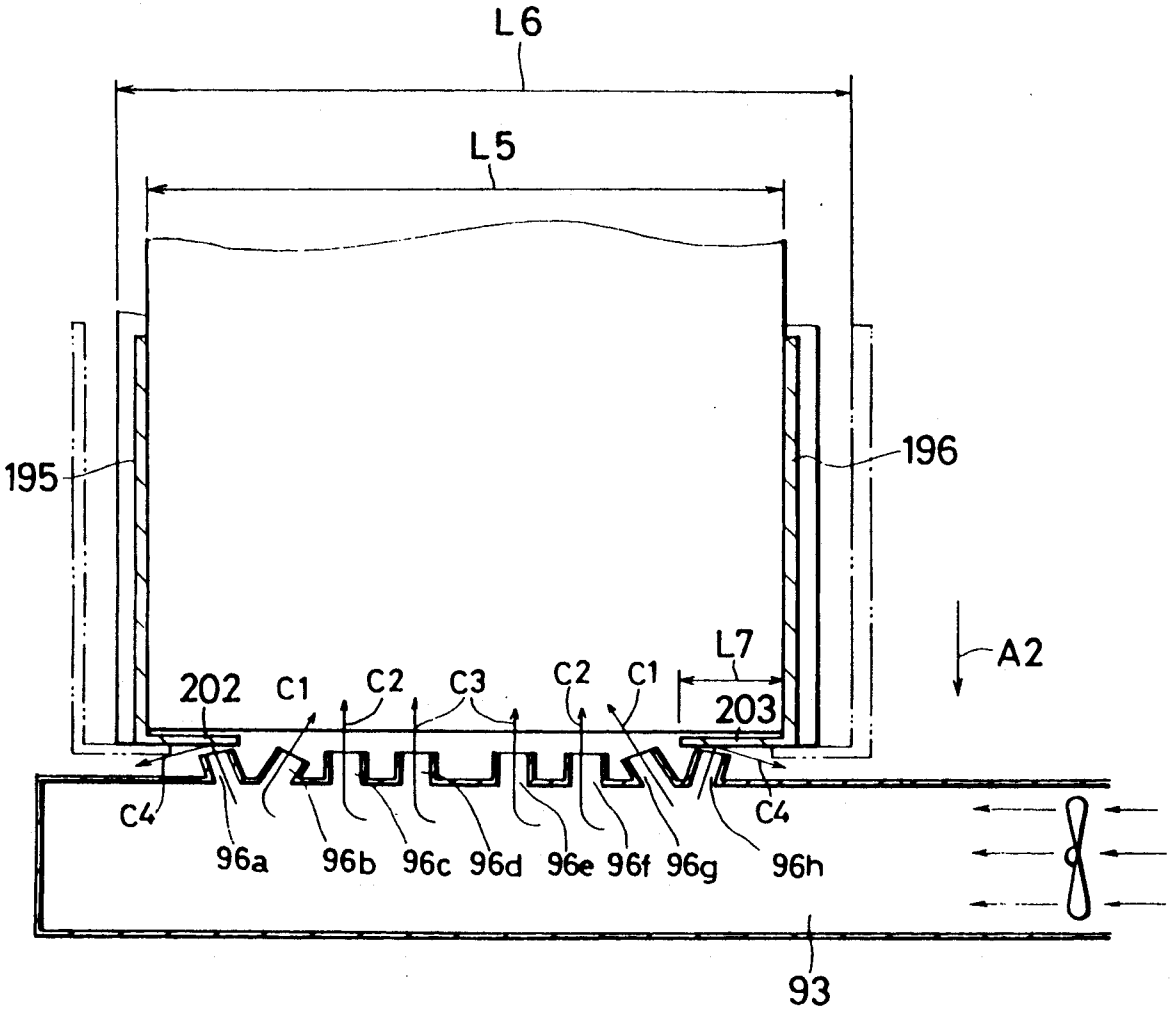
FIG. 48 is a sectional view showing a different constitution of the embodiment.
Figure 49:
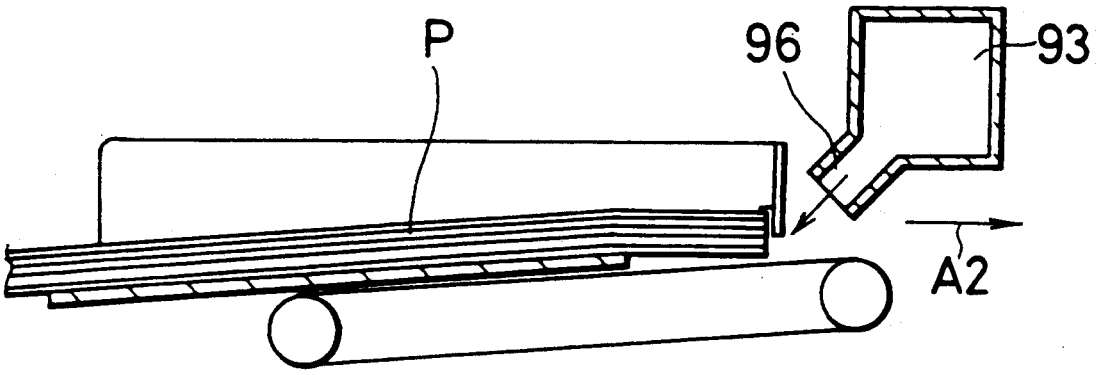
FIG. 49 is a side view of the embodiment.

FIG. 48 is a plane view showing a sectional view of a further different constitutional example around the nozzle member 93, and FIG. 49 is a front view of FIG. 48. This embodiment is similar to the foregoing embodiments, and the corresponding parts are identified with same reference numbers. In this embodiment, at the downstream end part of the feeding direction A2 of the lateral end defining plates 195 and 196, there are shielding pieces 202 and 203 extending mutually in the widthwise direction. When the lateral end defining plates 195 and 196 are space at a width L5 corresponding to the small-sized recording paper, the nozzles 96*a* and 96*h* of the nozzle member 93 are shielded by the shielding pieces 202 and 203, respectively, and the air flow C4 directed to the recording papers P is shielded.

On the other hand, when the lateral end defining plates 195 and 196 are spaced at a width L6 corresponding to the large-sized recording papers P, the nozzles 96*a* and 96*h* are not shielded by the shielding pieces 202 and 203, and are fully open. Besides, the length L7 in the widthwise direction of the shielding pieces 202 and 203 is determined to freely open or close the nozzles 96*a* and 96*h* on the basis of the difference of the gap of the lateral end defining members 195 and 196.

In such embodiment, too, the nozzles 96*a* and 96*h* may be opened or closed depending on the size of recording paper, and the same effect as in the foregoing embodiments may be attained.

Figure 50:
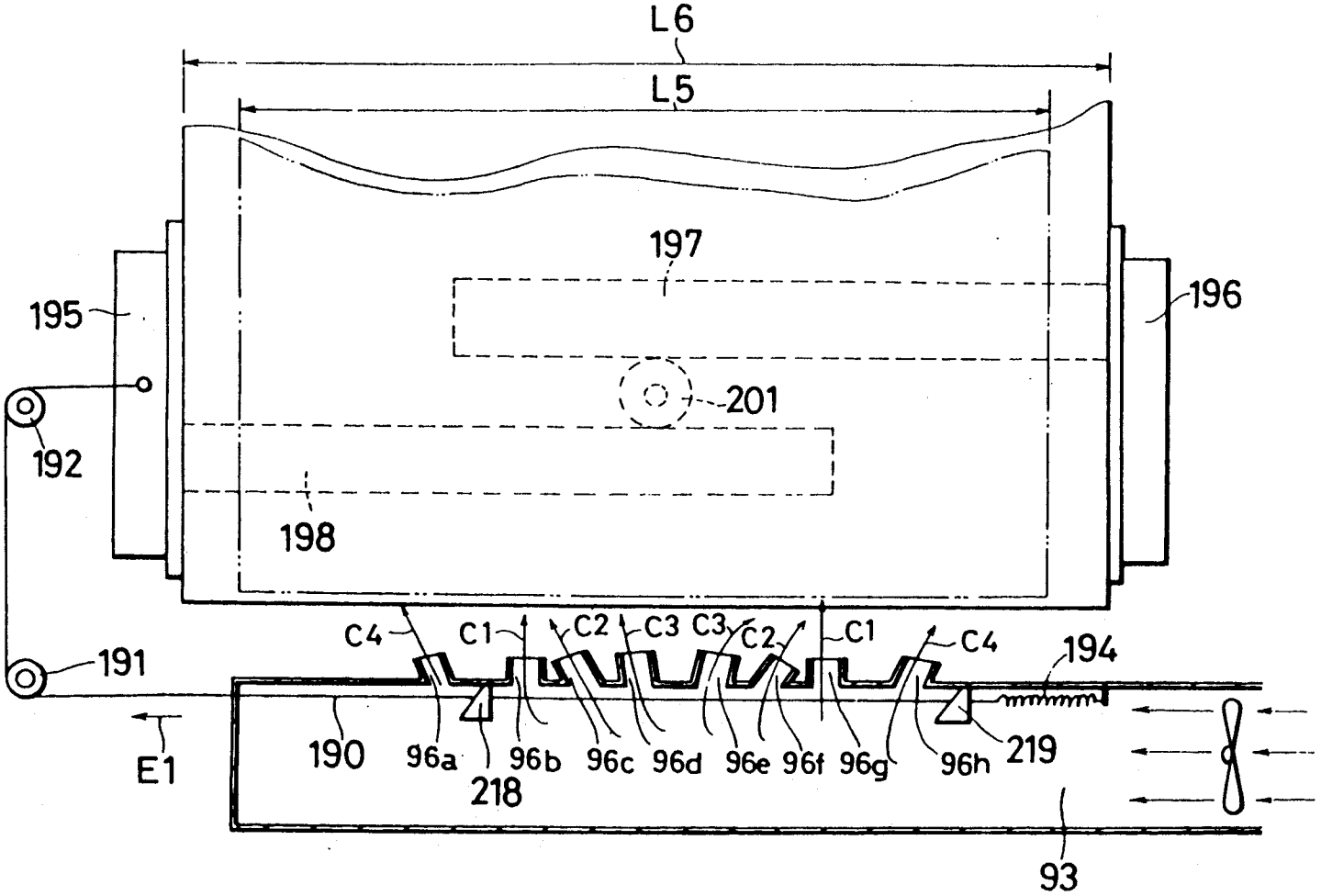
FIG. 50 is a sectional view showing other constitution of the embodiment.

FIG. 50 is a plan view showing a sectional view of another different constitutional example around the nozzle member 93. This embodiment is similar to the foregoing embodiments, and the corresponding parts are identified with the same reference numbers. In the preceding embodiment, the valve bodies 188 and 189 disposed in the nozzle member 93 realized the action of changing over the nozzles 96*a* and 96*c* between shielding and full opening. The feature of this embodiment is that value bodies 217 and 218 are disposed in the nozzle member 93, and that the shape of the valve bodies 217 and 218 is designed so as not to completely shut off the nozzles 96*a* and 96*h* even if the electromagnetic plunger 193*a* is actuated as mentioned above. As a result, the air flow C4 generated by the nozzles 96*a* and 96*h* is designed to vary between the maximum flow rate and the intermediate flow rate determined by the half open state mentioned above. By properly setting the intermediate flow rate, the same effect as in the preceding embodiments may be achieved.

Figure 51:
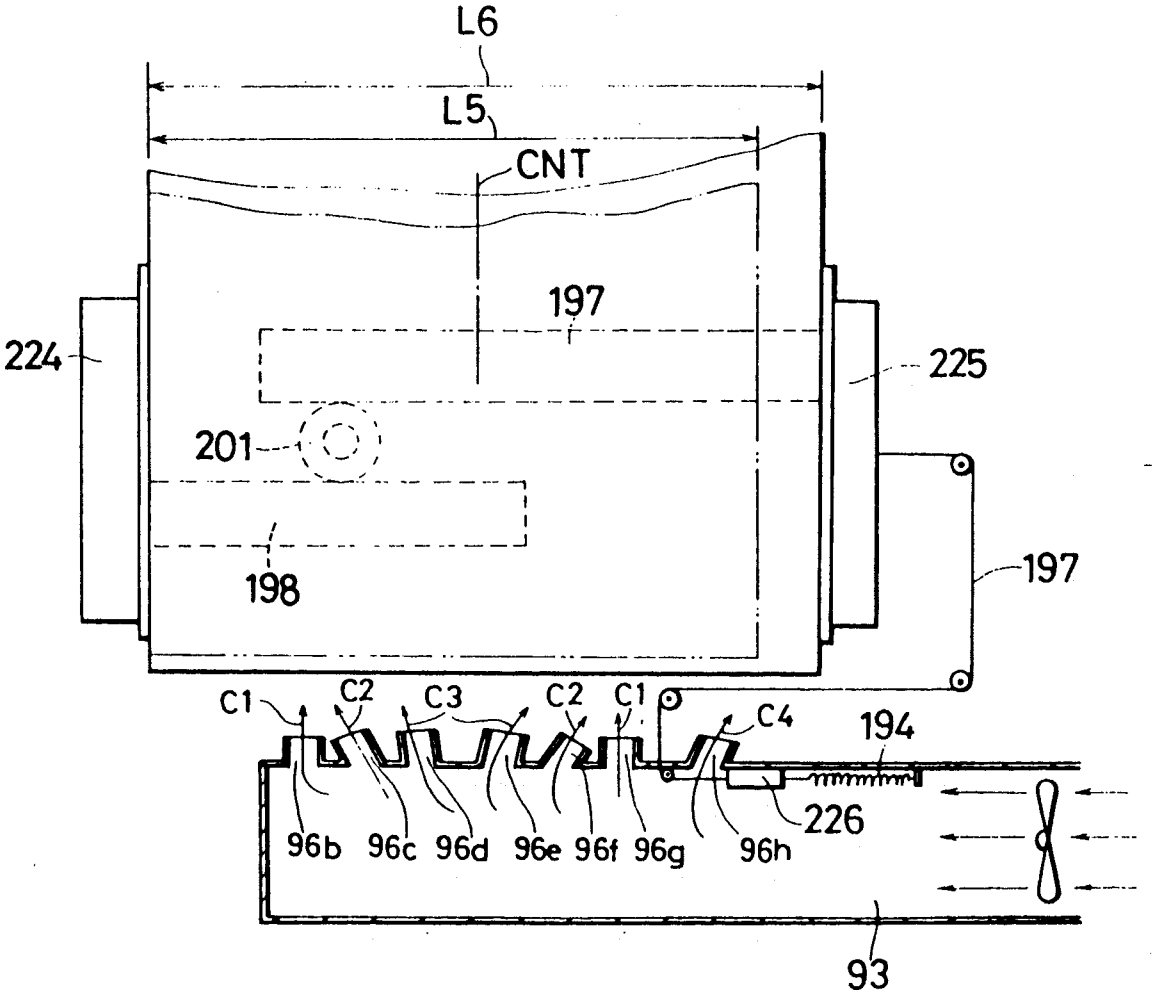
FIG. 51 is a sectional view showing other constitution of the embodiment.

FIG. 51 is a sectional view showing a further different constituent example of the nozzle member 93. This embodiment is similar to the foregoing embodiments, and the corresponding parts are identified with the same reference numbers. In the preceding embodiments, it is designed to match the widthwise central position of the recording paper is matched with the widthwise central position CNT of the laying plates 45 and 149, while the present embodiment is characterized by that one end in the widthwise direction of the recording paper is matched with one end in the widthwise direction of the laying plates 45 and 149. Therefore, the fixed side lateral end defining plate 224 is disposed at one end in the widthwise direction of the laying plates 45 and 149, while the movable lateral end defining plate 225 is disposed at the other end. Accordingly, the valve body 226 disposed in the nozzle member 93 is selected in the shape of opening and closing the nozzle 96*h* around the lateral end part of the configuration of the lateral end defining plate 225 of the nozzle member 93. In such embodiment, too, the same effect as in the preceding embodiments will be achieved.

Incidentally, the nozzles 96*a*, 96*d*, 96*e* and 96*h*, the nozzle hole 175*c*, and handling nozzles 187*a*, 187*d*, 187*e* and 187*h* in the foregoing embodiments may not be always employed from the viewpoint of the important aspect of the invention, and even such cases are included in the true spirit of the invention. Meanwhile, the protrusions 107*a*, 107*b*; 167*a*, 167*b*; 206 and 207 are not limited to the shape continuous on a straight line, but may be formed in a shape of single projection of circular head, for example, and a plurality of such protrusions may be composed along the feeding direction A2. In the preceding embodiments, it is composed so that the recording paper may be attracted to the feeding stretch belts 46*a* to 46*c*, 157*a* to 157*d* and 208, in a range exceeding the attracting region 108, and that the air flow for separation is once injected to a remote position preliminarily to the downstream side in the feeding direction from the downstream side end part of the feeding direction A2 of the recording paper as mentioned above, thereby the reflected flow acts to separate the recording papers. As other example of the invention, for example, when the recording paper is relatively small in size, it may be also designed that the recording paper may be exposed, not covered, near the downstream side end portion of the attracting region 108. In such a case, the air flow for separating is attracted into the attracting region 108, and the flow rate is suppressed. Therefore, scatter of the small-sized recording paper by the air flow of large flow rate may be avoided. In the case of recording papers of relatively large size or large weight, it is enough to suck as in the preceding embodiment.

In other embodiment of the invention, the ends of one side in the widthwise direction of sheets may be stacked up on the laying plate, and the papers may be fed in this end aligned state.

Furthermore, in a different embodiment of the invention, the rear end defining members 58 and 152 may be designed to detect the size of the sheets (that is, width or length) or the pile of the stack by detecting means, thereby driving to displace forward or backward in the feeding direction.

The invention may be applied in a wide range, not only for feeding the recording papers of copying machine, but for feeding the recording papers of a printer, or feeding other sheets than recording papers.

The invention may be modified in a range not departing from the scope of the claims thereof, easily by those skilled in the art, and such modifications and changes are embraced within the true spirit of the invention.

What is claimed is:

1. A sheet feeding apparatus comprising:

(a) a laying plate having a centerline running in a feeding direction for receiving a stack of sheets, (b) a feeding means for feeding a sheet to be fed from the stack, the feeding means located adjacent to the position of the sheet to be fed and (c) an air stream forming means disposed at the downstream side in the feeding direction for injecting a plurality of air flows between the sheets from plural positions in directions directed outwardly from the centerline of the laying plate and in directions toward the feeding means and in directions toward the position of sheets in the laying plate, the air flows between the sheets being concentrated at the upstream side in the feeding direction of the sheets.

2. A sheet feeding apparatus according to claim 1, wherein:

the laying plate is symmetrical on both sides of the centerline, and the air flows are formed symmetrically on the right and left sides of the centerline.

3. A sheet feeding apparatus comprising:

(a) a laying plate having a centerline running in a feeding direction for receiving a stack of sheets and having deforming parts for deforming the sheets plural positions in a direction outwardly from the centerline, (b) a feeding means for vacuum feeding a sheet to be fed from the stack, the feeding means located adjacent to the position of the sheet to be fed and (c) an air stream forming means, disposed at the downstream side in the feeding direction of the laying plate, for injecting a plurality of air flows between the sheets from plural positions in directions directed outwardly from the centerline of the laying plate and in directions toward the deforming parts.

4. A sheet feeding apparatus according to claim 3, wherein the laying plate is symmetrical on both sides of the centerline, and the deforming parts and the corresponding air flows are formed symmetrically on the right and left sides of the centerline.

5. A sheet feeding apparatus according to claim 3 wherein the air flow forming means provides air flows that are essentially concentrated along the centerline of each air flow.

6. A sheet feeding apparatus according to claim 1 or 3 wherein the air flow forming means provides air flows that are essentially parallel to the centerline of each air flow.

7. A sheet feeding apparatus according to claim 1 or 3 wherein the air flow forming means comprises a nozzle member forming at least one tubular nozzles disposed for every air flow having nozzle holes, and a passage for commonly leading air into the nozzle holes of the nozzles.

8. A sheet feeding apparatus according to claim 7, wherein the nozzle members contain guide pieces oriented in proximity to the nozzle holes for guiding the air flow from the passage.

9. A sheet feeding apparatus according to claim 1 or 3, wherein the air flow forming means possesses plural nozzle members for each of the plurality of air flows, and central nozzles in the widthwise direction of the nozzle members injects air outward in the widthwise direction and upstream in the feeding direction and outward nozzles in the widthwise direction of the nozzle members injects air essentially parallel to the feeding direction.

10. A sheet feeding apparatus of claim 9, wherein the central nozzle in the widthwise direction has an angle of $\alpha 2$ of 20 to 45 degrees outward in the widthwise direction to the feeding direction.

11. A sheet feeding apparatus of claim 10, wherein the central nozzle in the widthwise direction has an angle of $\alpha 2$ of about 30 degrees outward in the widthwise direction to the feeding direction.

12. A sheet feeding apparatus of claim 11, wherein another nozzle is disposed at the further central side in the widthwise direction from the central nozzle in the widthwise direction, and this nozzle has an angle of $\alpha 1$ of 0 to 45 degrees outward in the widthwise direction to the feeding direction.

13. a sheet feeding apparatus of claim 11, wherein another nozzle is disposed at the further central side in the widthwise direction from the central nozzle in the widthwise direction, and this nozzle has an angle of $\alpha 1$ of about 15 degrees outward in the widthwise direction to the feeding direction.

14. A sheet feeding apparatus in claim 9, wherein another air flow is disposed further outward in the widthwise direction from the outward air flow in the widthwise direction, and the central line of this air flow has an angle of $\alpha 3$ to 0 to 45 degrees outward in the widthwise direction to the feeding direction.

15. A sheet feeding apparatus of claim 9, wherein another air flow is disposed further outward in the widthwise direction from the outward air flow in the widthwise direction, and the central line of this air flow has an angle of $\alpha 3$ of about 30 degrees outward in the widthwise direction to the feeding direction.

16. A sheet feeding apparatus of claim 1 or 3, wherein the air flow forming means possesses plural nozzles for every air flow, and the central nozzle in the widthwise direction of the nozzles for every air flow injects air outward in the widthwise direction as going upstream in the feeding direction, while the outward nozzle in the widthwise direction injects air inward in the widthwise direction as going upstream in the feeding direction.

17. A sheet feeding apparatus of claim 1, wherein the air flow forming means forms plural sets of air flows making a pair on the right and left sides of the symmetrical surface, the first air flow of the set disposed at the central side in the widthwise direction is directed inward in the widthwise direction from both sides in the widthwise direction of the stacked-up sheets small in width, and the second air flow of the set disposed outward in the widthwise direction is directed outward in the widthwise direction than the first air flow, outward in the widthwise direction than the both sides of the sheets of small width, and inward in the widthwise direction from both ends in the widthwise direction of stacked-up sheets large in width.

18. A sheet feeding apparatus of claim 17, wherein flow rate control means for the air flow to control the flow rate of the second air flow is disposed.

19. A sheet feeding apparatus of claim 1 or 3, wherein the laying plate is formed almost horizontally, a notch open to the downstream side in the feeding direction is formed in the central position in the widthwise direction of laying plate, and the feeding means for feeding the bottom sheet of the stack-up sheets is opposite to this notch, and a projection is set up on the laying plate outward in the widthwise direction form the notch, and the air flow forming means injects an air flow toward the notch area.

20. A sheet feeding apparatus of claim 19, wherein the protrusion has a slender shape extending along the feeding direction.

21. A sheet feeding apparatus of claim 1 or 3, wherein the feeding means feeds the bottom sheet of the stacked-up sheets, and the air flow forming means injects an air flow toward the position in the feeding route at the downstream side in the feeding direction further from the end part of the downstream side in the feeding direction of the sheets stacked up on the laying plate, and the bottom sheet and the other remaining sheets are separated by the air flow after reflection of this air flow.

22. A sheet feeding apparatus comprising:

a laying plate for receiving a stack of sheets and having a centerline running in a feeding direction and having a nearly horizontal central laying part and lateral laying parts extending from boundaries along both of the sides of the central laying part that are outward from the centerline of the laying plate and are parallel to the feeding direction, the central laying part and the lateral laying parts each having end parts at the downstream side in the feeding direction, the laying plate having an end part at the downstream side in the feeding direction of the central laying part being upstream in the feeding direction from end parts at the downstream side in the feeding direction of the lateral laying parts thereby forming a notch in the laying plate, and a feeding means for feeding a bottom sheet of the stack of sheets located in sufficient proximity to the notch to enable vacuum feeding of the bottom sheet, and the air flow forming means provides a plurality of air flows toward the boundaries of the central laying part and the lateral laying parts of the laying plate.

23. A sheet feeding apparatus comprising:

(a) a laying plate for receiving a stack of sheets and having a centerline running in a feeding direction and having a nearly horizontal central laying part and lateral laying parts extending from boundaries along both of the sides of the central laying part that are outward from the centerline of the laying plate and are parallel to the feeding direction, the central laying part and the lateral laying parts each having end parts at the downstream side in the feeding direction, and having deforming parts for deforming the sheets at plural positions in a direction outwardly from the centerline, the laying plate having an end part at the downstream side in the feeding direction of the central laying part being upstream in the feeding direction from end parts at the downstream side in the feeding direction of the lateral laying parts thereby forming a notch in the laying plate, and a feeding means for feeding a bottom sheet of the stack of sheets located in sufficient proximity to the notch to enable vacuum feeding of the bottom sheet, and the air flow forming means provides a plurality of air flows toward the boundaries of the central laying part and the lateral laying parts of the laying plate and between the sheets from plural positions in directions directed outwardly from the centerline of the laying plate and in directions toward the deforming parts.

24. A sheet feeding apparatus according to claim 22 or 23, wherein a vertical step difference is formed between the inner end part of the lateral laying part and the feeding surface of the feeding means, and the air flow forming means injects an air flow from the central side in the widthwise direction toward the step difference.

25. A sheet feeding apparatus according to claim 24, wherein the height $\delta$ of the step difference is 1 to 5 mm vertically.

26. A sheet feeding apparatus of claim 24, wherein the height $\delta$ of the step difference is about 2 mm vertically.

27. A sheet feeding apparatus according to claim 22 or 23 wherein, the lateral laying parts are inclined upwardly in directions away from the boundary with the central laying part.

28. A sheet feeding apparatus of claim 27, wherein the central laying part and the lateral laying parts form an angle $\beta$ of 3 to 10 degrees.

29. A sheet feeding apparatus of claim 27, wherein the central laying part and the lateral laying parts form an angle $\beta$ of about 3.5 degrees.

30. A sheet feeding apparatus according to claim 22 or 23, wherein the lateral laying parts are almost horizontal, and are formed higher than the central laying part through a step difference.

31. A sheet feeding apparatus according to claim 22 or 23, wherein the boundary of the central laying part and lateral laying parts is formed continuously in bend.

32. A sheet feeding apparatus according to claim 22 or 23, wherein a projection is set up at the position where the notch is formed, and the air flow forming means injects an air flow toward the vicinity of this projection.

33. A sheet feeding apparatus of claim 32, wherein the air flow is injected toward the side surface of the projection.

34. A sheet feeding apparatus of claim 33, wherein the air flow is injected from inward in the widthwise direction toward the side surface of the projection.

35. A sheet feeding apparatus in accordance with claim 32 wherein the protrusion has a slender shape extending along in the feeding direction.

36. A sheet feeding apparatus of claim 22 or 23, wherein a step difference becoming lower at the downstream side in the feeding direction of the laying plate is formed, and the air flow forming means injects an air flow to the vicinity of this step difference, and the flow rate of the air to the end part of the downstream side in the feeding direction of the stacked-up sheets is controlled by it.

37. A sheet feeding apparatus of claim 22 or 23, wherein the feeding means has a feeding stretch belt with multiple air passage holes extended along the feeding direction, and this belt is rotated and driven, and a vacuum attraction box open upward is disposed immediately beneath the upper stretching part of the belt.

38. A sheet feeding apparatus of claim 37, wherein the end part at the downstream side in the feeding direction of stacked-up sheets is located at the downstream side of the vacuum attraction box.

39. A sheet feeding apparatus of claim 37, wherein a rear end defining member for aligning the ends of the stacked-up sheets at the upstream side in the feeding direction is disposed reciprocally movable in the feeding direction, and the rear end defining member is dislocated so that the end part at the downstream side in the feeding direction of the large sheets may be at the downstream side from the vacuum attraction box when the sheets are large, and that the end part at the downstream side in the feeding direction of the small sheets may be positioned as being deviated to the upstream side in the feeding direction from the end part at the downstream side in the feeding direction of the vacuum attraction box when the sheets are small.

40. A sheet feeding apparatus of claim 39, wherein means for driving the rear end defining member, means for detecting the size of the sheets to be detected or the amount of stacking, and control means for actuating the driving means in response to the output from the detecting means are included.

41. A sheet feeding apparatus of claim 1 or 3, wherein the feeding means is located above the stacked-up sheets.

* * * * *